US009179729B2

(12) United States Patent
Cotterman et al.

(10) Patent No.: US 9,179,729 B2
(45) Date of Patent: Nov. 10, 2015

(54) TIGHTENING SYSTEMS

(71) Applicant: Boa Technology, Inc., Denver, CO (US)

(72) Inventors: Jesse Daniel Cotterman, Evergreen, CO (US); Christopher Hoyt Converse, Boulder, CO (US)

(73) Assignee: Boa Technology, Inc., Denver, CO (US)

( * ) Notice: Subject to any disclaimer, the term of this patent is extended or adjusted under 35 U.S.C. 154(b) by 139 days.

(21) Appl. No.: 13/793,919

(22) Filed: Mar. 11, 2013

(65) Prior Publication Data

US 2013/0239303 A1 Sep. 19, 2013

Related U.S. Application Data

(60) Provisional application No. 61/610,401, filed on Mar. 13, 2012.

(51) Int. Cl.

| | |
|---|---|
| ***A42B 3/14*** | (2006.01) |
| ***A42B 3/08*** | (2006.01) |
| ***A42B 3/32*** | (2006.01) |

(52) U.S. Cl.

CPC . *A42B 3/145* (2013.01); *A42B 3/08* (2013.01); *A42B 3/324* (2013.01)

(58) Field of Classification Search

CPC ..... A42B 3/145; A42B 3/324; A42B 3/08

USPC ..... 2/417–421, 410, 183, 195.2

See application file for complete search history.

(56) References Cited

U.S. PATENT DOCUMENTS

| | | | |
|---|---|---|---|
| 59,332 | A | 10/1866 | White et al. |
| 80,834 | A | 8/1868 | Prussia |
| 117,530 | A | 8/1871 | Foote |
| 228,946 | A | 6/1880 | Schulz |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

U.S. Appl. No. 09/956,601, including its prosecution history, filed Sep. 18, 2001, Gary R. Hammerslag.

(Continued)

*Primary Examiner* — Shaun R Hurley
*Assistant Examiner* — Andrew W Sutton
(74) *Attorney, Agent, or Firm* — Knobbe, Martens, Olson & Bear, LLP

(57) ABSTRACT

A tightening system can be used with a helmet or other wearable article. The tightening system can have a forehead strap that is space apart from a yoke, which can be configured to engage a back side of a wearer's head. A lace can extend between the forehead strap and the yoke and a tightening mechanism can be configured to adjust tension on the lace. One or more intermediate tenders can engage the lace in the gap between the forehead strap and the yoke so that the lace path between the forehead strap and the yoke is non-linear. The yoke can have a height adjustment mechanism. The tightening mechanism can be configured to provide a clicking sound during rotation in both the tightening direction and the loosening direction. The tightening mechanism can include a rotation limiter to prevent over-tightening and/or over-loosening of the tightening mechanism.

44 Claims, 29 Drawing Sheets

(56) References Cited

U.S. PATENT DOCUMENTS

| | | | | |
|---|---|---|---|---|
| 230,759 | A | | 8/1880 | Drummond |
| 288,115 | A | * | 11/1883 | Ray ..... 2/410 |
| 568,056 | A | | 9/1896 | Vail, Jr. |
| 746,563 | A | | 12/1903 | McMahon |
| 908,704 | A | | 1/1909 | Sprinkle |
| 1,060,422 | A | | 4/1913 | Bowdish |
| 1,062,511 | A | | 5/1913 | Short |
| 1,090,438 | A | | 3/1914 | Worth et al. |
| 1,170,472 | A | | 2/1916 | Barber |
| 1,288,859 | A | | 12/1918 | Feller et al. |
| 1,393,188 | A | | 10/1921 | Whiteman |
| 1,469,661 | A | | 2/1922 | Migita |
| 1,412,486 | A | | 4/1922 | Paine |
| 1,416,203 | A | | 5/1922 | Hobson |
| 1,481,903 | A | | 4/1923 | Hart |
| 1,466,673 | A | | 9/1923 | Solomon et al. |
| 1,530,713 | A | | 2/1924 | Clark |
| 1,995,243 | A | | 6/1934 | Clarke |
| 2,088,851 | A | | 8/1937 | Gantenbein |
| 2,109,751 | A | | 3/1938 | Matthias et al. |
| 2,124,310 | A | | 9/1938 | Murr, Jr. |
| 2,316,102 | A | | 4/1943 | Preston |
| 2,539,026 | A | | 1/1951 | Mangold |
| 2,611,940 | A | | 9/1952 | Cairns |
| 2,673,381 | A | | 3/1954 | Dueker |
| 2,802,212 | A | | 8/1957 | Finken |
| 2,869,137 | A | | 1/1959 | Sherz |
| 2,907,086 | A | | 10/1959 | Ord |
| 2,991,523 | A | | 7/1961 | Del Conte |
| 3,028,602 | A | * | 4/1962 | Miller ..... 2/6.1 |
| 3,035,319 | A | | 5/1962 | Wolff |
| 3,112,545 | A | | 12/1963 | Williams |
| 3,163,900 | A | | 1/1965 | Martin |
| 3,169,325 | A | | 2/1965 | Fesl |
| 3,197,155 | A | | 7/1965 | Chow |
| 3,221,384 | A | | 12/1965 | Aufenacker |
| 3,276,090 | A | | 10/1966 | Nigon |
| 3,329,968 | A | | 7/1967 | Gordon |
| 3,357,026 | A | | 12/1967 | Wiegandt |
| 3,401,437 | A | | 9/1968 | Christpohersen |
| 3,430,303 | A | | 3/1969 | Perrin et al. |
| 3,491,465 | A | | 1/1970 | Martin |
| 3,545,106 | A | | 12/1970 | Martin |
| 3,618,232 | A | | 11/1971 | Shnuriwsky |
| 3,668,791 | A | | 6/1972 | Salzman et al. |
| 3,678,539 | A | | 7/1972 | Graup |
| 3,703,775 | A | | 11/1972 | Gatti |
| 3,729,779 | A | | 5/1973 | Porth |
| 3,738,027 | A | | 6/1973 | Schoch |
| 3,793,749 | A | | 2/1974 | Gertsch et al. |
| 3,808,644 | A | | 5/1974 | Schoch |
| 3,834,048 | A | | 9/1974 | Maurer |
| 3,860,997 | A | | 1/1975 | Van Riper |
| 3,934,346 | A | | 1/1976 | Sasaki et al. |
| 3,975,838 | A | | 8/1976 | Martin |
| 3,992,720 | A | | 11/1976 | Nicolinas |
| 4,051,555 | A | | 10/1977 | Daly |
| 4,095,354 | A | | 6/1978 | Annovi |
| 4,130,949 | A | | 12/1978 | Seidel |
| 4,142,307 | A | | 3/1979 | Martin |
| 4,227,322 | A | | 10/1980 | Annovi |
| 4,261,081 | A | | 4/1981 | Lott |
| 4,267,622 | A | | 5/1981 | Burnett-Johnston |
| 4,279,037 | A | | 7/1981 | Morgan |
| 4,292,692 | A | | 10/1981 | Moretti |
| 4,408,403 | A | | 10/1983 | Martin |
| 4,433,456 | A | | 2/1984 | Baggio |
| 4,433,679 | A | | 2/1984 | Mauldin et al. |
| 4,463,761 | A | | 8/1984 | Pols et al. |
| 4,480,395 | A | | 11/1984 | Schoch |
| 4,551,932 | A | | 11/1985 | Schoch |
| 4,555,830 | A | | 12/1985 | Petrini et al. |
| 4,574,500 | A | | 3/1986 | Aldinio et al. |
| 4,616,524 | A | | 10/1986 | Bidoia |
| 4,619,057 | A | | 10/1986 | Sartor et al. |
| 4,620,378 | A | | 11/1986 | Sartor |
| 4,631,839 | A | | 12/1986 | Bonetti et al. |
| 4,631,840 | A | | 12/1986 | Gamm |
| 4,633,599 | A | | 1/1987 | Morell et al. |
| 4,654,985 | A | | 4/1987 | Chalmers |
| 4,660,300 | A | | 4/1987 | Morell et al. |
| 4,660,302 | A | | 4/1987 | Arieh et al. |
| 4,680,878 | A | | 7/1987 | Pozzobon et al. |
| 4,719,670 | A | | 1/1988 | Kurt |
| 4,719,709 | A | | 1/1988 | Vaccari |
| 4,719,710 | A | | 1/1988 | Pozzobon |
| 4,722,477 | A | | 2/1988 | Floyd |
| 4,727,630 | A | | 3/1988 | Alan |
| 4,741,115 | A | | 5/1988 | Pozzobon |
| 4,748,726 | A | | 6/1988 | Schoch |
| 4,760,653 | A | | 8/1988 | Baggio |
| 4,780,969 | A | | 11/1988 | White, Jr. |
| 4,787,124 | A | | 11/1988 | Pozzobon et al. |
| 4,790,081 | A | | 12/1988 | Benoit et al. |
| 4,793,001 | A | | 12/1988 | Accardi |
| 4,796,829 | A | | 1/1989 | Pozzobon et al. |
| 4,799,297 | A | | 1/1989 | Baggio et al. |
| 4,802,291 | A | | 2/1989 | Sartor |
| 4,811,503 | A | | 3/1989 | Iwama |
| 4,826,098 | A | | 5/1989 | Pozzobon et al. |
| 4,827,796 | A | | 5/1989 | Horian |
| 4,841,649 | A | | 6/1989 | Baggio et al. |
| 4,856,207 | A | | 8/1989 | Datson |
| 4,870,723 | A | | 10/1989 | Pozzobon et al. |
| 4,870,761 | A | | 10/1989 | Tracy |
| 4,884,760 | A | | 12/1989 | Baggio et al. |
| 4,937,953 | A | | 7/1990 | Walkhoff |
| 4,942,628 | A | | 7/1990 | Freund |
| 4,961,544 | A | | 10/1990 | Bidoia |
| 4,999,846 | A | | 3/1991 | Ball et al. |
| 5,001,817 | A | | 3/1991 | De Bortoli et al. |
| 5,016,327 | A | | 5/1991 | Klausner |
| 5,042,177 | A | | 8/1991 | Schoch |
| 5,062,225 | A | | 11/1991 | Gorza |
| 5,065,480 | A | | 11/1991 | De Bortoli |
| 5,065,481 | A | | 11/1991 | Walkhoff |
| 5,108,216 | A | | 4/1992 | Geyer et al. |
| 5,117,567 | A | | 6/1992 | Berger |
| 5,129,130 | A | | 7/1992 | Lecouturier |
| 5,152,038 | A | | 10/1992 | Schoch |
| 5,157,813 | A | | 10/1992 | Carroll |
| 5,158,428 | A | | 10/1992 | Gessner et al. |
| 5,167,612 | A | | 12/1992 | Bonutti |
| 5,177,882 | A | | 1/1993 | Berger |
| 5,178,137 | A | | 1/1993 | Goor et al. |
| 5,181,331 | A | | 1/1993 | Berger |
| 5,184,378 | A | | 2/1993 | Batra |
| D333,552 | S | | 3/1993 | Berger et al. |
| 5,213,094 | A | | 5/1993 | Bonutti |
| 5,249,377 | A | | 10/1993 | Walkhoff |
| 5,259,094 | A | | 11/1993 | Zepeda |
| 5,267,967 | A | | 12/1993 | Schneider |
| 5,315,741 | A | | 5/1994 | Dubberke |
| 5,319,868 | A | | 6/1994 | Hallenbeck |
| 5,325,613 | A | | 7/1994 | Sussmann |
| 5,327,662 | A | | 7/1994 | Hallenbeck |
| 5,331,687 | A | | 7/1994 | Kronenberger |
| 5,335,401 | A | | 8/1994 | Hanson |
| 5,341,583 | A | | 8/1994 | Hallenbeck |
| 5,345,697 | A | | 9/1994 | Quellais |
| 5,346,461 | A | | 9/1994 | Heinz et al. |
| 5,355,596 | A | | 10/1994 | Sussmann |
| 5,357,654 | A | | 10/1994 | Hsing-Chi |
| 5,365,947 | A | | 11/1994 | Bonutti |
| 5,381,609 | A | | 1/1995 | Hieblinger |
| 5,384,916 | A | | 1/1995 | Portney |
| 5,395,304 | A | | 3/1995 | Tarr et al. |
| 5,425,161 | A | | 6/1995 | Schoch |
| 5,425,185 | A | | 6/1995 | Gansler |
| 5,430,960 | A | | 7/1995 | Richardson |
| 5,433,648 | A | | 7/1995 | Frydman |
| 5,437,617 | A | | 8/1995 | Heinz et al. |
| 5,456,268 | A | | 10/1995 | Bonutti |
| 5,463,822 | A | | 11/1995 | Miller |

(56) References Cited

U.S. PATENT DOCUMENTS 5,477,593 A 12/1995 Leick
5,502,902 A 4/1996 Sussmann
5,511,251 A 4/1996 Brakas
5,511,325 A 4/1996 Hieblinger
5,526,585 A 6/1996 Brown et al.
5,535,531 A 7/1996 Karabed et al.
5,537,763 A 7/1996 Donnadieu et al.
5,557,864 A 9/1996 Marks
5,566,474 A 10/1996 Leick et al.
5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
5,619,747 A 4/1997 Boisclair et al.
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,685,830 A 11/1997 Bonutti
5,718,021 A 2/1998 Tatum
5,718,065 A 2/1998 Locker
5,732,483 A 3/1998 Cagliari
5,736,696 A 4/1998 Del Rosso
5,737,854 A 4/1998 Sussmann
5,755,044 A 5/1998 Veylupek
5,761,777 A 6/1998 Leick
5,772,146 A 6/1998 Kawamoto et al.
5,784,809 A 7/1998 McDonald
5,815,847 A * 10/1998 Holden, Jr. ..... 2/418
5,819,378 A 10/1998 Doyle
5,833,640 A 11/1998 Vazquez, Jr. et al.
5,891,061 A 4/1999 Kaiser
5,934,599 A 8/1999 Hammerslag
5,950,245 A 9/1999 Binduga
5,956,823 A 9/1999 Borel
5,971,946 A 10/1999 Quinn et al.
6,032,297 A * 3/2000 Barthold et al. ..... 2/416
6,038,791 A 3/2000 Cornelius et al.
6,052,921 A 4/2000 Oreck
6,070,886 A 6/2000 Cornelius et al.
6,070,887 A 6/2000 Cornelius et al.
6,102,412 A 8/2000 Staffaroni
D430,724 S 9/2000 Matis et al.
6,119,318 A 9/2000 Maurer
6,128,836 A 10/2000 Barret
6,148,489 A 11/2000 Dickie et al.
6,202,953 B1 3/2001 Hammerslag
6,219,889 B1 4/2001 Lovato et al.
6,240,657 B1 6/2001 Weber et al.
6,256,798 B1 * 7/2001 Egolf et al. ..... 2/421
6,267,390 B1 7/2001 Maravetz et al.
6,289,558 B1 9/2001 Hammerslag
6,314,587 B1 11/2001 Fang
6,416,074 B1 7/2002 Maravetz et al.
6,457,210 B1 10/2002 Shirai et al.
6,464,657 B1 10/2002 Castillo
6,467,195 B2 10/2002 Pierre et al.
6,477,793 B1 11/2002 Pruitt et al.
6,543,159 B1 4/2003 Carpenter et al.
6,568,103 B2 5/2003 Durocher
6,685,662 B1 2/2004 Curry et al.
6,689,080 B2 2/2004 Castillo
6,694,643 B1 2/2004 Hsu
6,708,376 B1 3/2004 Landry
6,711,787 B2 3/2004 Jungkind et al.
6,718,557 B2 4/2004 Claro
6,757,991 B2 7/2004 Sussmann
6,775,928 B2 8/2004 Grande et al.
6,793,641 B2 9/2004 Freeman et al.
6,796,951 B2 9/2004 Freeman et al.
6,802,439 B2 10/2004 Azam et al.
6,877,256 B2 4/2005 Martin et al.
6,918,139 B2 7/2005 Okot
6,922,917 B2 8/2005 Kerns et al.
6,938,913 B2 9/2005 Elkington
6,941,581 B1 9/2005 England et al.
6,942,632 B2 9/2005 Cho
6,945,543 B2 9/2005 De Bortoli et al.
6,962,571 B2 11/2005 Castillo
6,976,972 B2 12/2005 Bradshaw
6,993,859 B2 2/2006 Martin et al.
7,000,262 B2 * 2/2006 Bielefeld ..... 2/418
7,024,702 B2 4/2006 Kronenberger
D521,226 S 5/2006 Douglas et al.
7,043,772 B2 * 5/2006 Bielefeld et al. ..... 2/418
7,076,843 B2 7/2006 Sakabayashi
7,082,701 B2 8/2006 Dalgaard et al.
7,120,939 B1 * 10/2006 Howard et al. ..... 2/416
7,134,224 B2 11/2006 Elkington et al.
7,182,740 B1 2/2007 Castillo
7,198,610 B2 4/2007 Ingimundarson et al.
7,246,383 B2 7/2007 Musal
7,278,173 B2 10/2007 Turner
7,281,341 B2 10/2007 Reagan et al.
7,290,293 B2 11/2007 Kanitz
7,293,373 B2 11/2007 Reagan et al.
7,314,458 B2 1/2008 Bodenschatz
7,331,126 B2 2/2008 Johnson
7,367,522 B2 5/2008 Chen
7,386,947 B2 6/2008 Martin et al.
7,402,147 B1 7/2008 Allen
7,442,177 B1 10/2008 Garelick et al.
7,490,458 B2 2/2009 Ford
7,516,914 B2 4/2009 Kovacevich et al.
7,584,528 B2 9/2009 Hu
7,591,026 B2 9/2009 Kronenberger
7,591,050 B2 9/2009 Hammerslag
7,597,675 B2 10/2009 Ingimundarson et al.
7,600,660 B2 10/2009 Kasper et al.
7,614,090 B2 11/2009 Kronenberger
7,617,573 B2 11/2009 Chen
7,618,386 B2 11/2009 Nordt, III et al.
7,618,389 B2 11/2009 Nordt, III et al.
7,648,404 B1 1/2010 Martin
7,662,122 B2 2/2010 Sterling
7,665,154 B2 2/2010 Costello
7,694,354 B2 4/2010 Philpott et al.
7,704,219 B2 4/2010 Nordt, III et al.
7,713,225 B2 5/2010 Ingimundarson et al.
7,752,682 B2 * 7/2010 VanDerWoude et al. ..... 2/410
7,789,844 B1 9/2010 Allen
7,794,418 B2 9/2010 Ingimundarson et al.
7,806,842 B2 10/2010 Stevenson et al.
7,819,830 B2 10/2010 Sindel et al.
7,871,334 B2 1/2011 Young et al.
7,877,845 B2 2/2011 Signori
7,878,998 B2 2/2011 Nordt, III et al.
7,887,500 B2 2/2011 Nordt, III et al.
7,896,827 B2 3/2011 Ingimundarson et al.
7,908,769 B2 3/2011 Pellegrini
7,922,680 B2 4/2011 Nordt, III et al.
7,935,068 B2 5/2011 Einarsson
7,947,005 B2 5/2011 Castillo
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
7,993,296 B2 8/2011 Nordt, III et al.
8,015,625 B2 9/2011 Grim et al.
8,016,781 B2 9/2011 Ingimundarson et al.
D646,790 S 10/2011 Castillo et al.
8,032,993 B2 * 10/2011 Musal ..... 24/68 B
8,056,150 B2 11/2011 Stokes et al.
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
D663,850 S 7/2012 Joseph
D663,851 S 7/2012 Joseph
D663,852 S 7/2012 Joseph

(56) References Cited

U.S. PATENT DOCUMENTS

| | | | | |
|---|---|---|---|---|
| D664,259 | S | 7/2012 | Joseph | |
| 8,231,074 | B2 | 7/2012 | Hu et al. | |
| 8,231,560 | B2 | 7/2012 | Ingimundarson et al. | |
| D665,088 | S | 8/2012 | Joseph | |
| D666,301 | S | 8/2012 | Joseph | |
| D666,302 | S | 8/2012 | Joseph | |
| 8,235,321 | B2 | 8/2012 | Chen | |
| 8,245,371 | B2 | 8/2012 | Chen | |
| 8,277,401 | B2 | 10/2012 | Hammerslag et al. | |
| 8,303,527 | B2 | 11/2012 | Joseph | |
| 8,308,098 | B2 | 11/2012 | Chen | |
| 8,381,362 | B2 | 2/2013 | Hammerslag et al. | |
| 8,424,168 | B2 | 4/2013 | Soderberg et al. | |
| 8,434,200 | B2 * | 5/2013 | Chen | 24/68 SK |
| 8,468,657 | B2 | 6/2013 | Soderberg et al. | |
| 8,679,042 | B2 | 3/2014 | Kausek | |
| 2002/0052568 | A1 | 5/2002 | Houser et al. | |
| 2002/0095750 | A1 | 7/2002 | Hammerslag | |
| 2002/0108165 | A1 | 8/2002 | Porter et al. | |
| 2002/0178548 | A1 | 12/2002 | Freed | |
| 2003/0093853 | A1 * | 5/2003 | Maloney | 2/425 |
| 2003/0131396 | A1 | 7/2003 | Park | |
| 2003/0177662 | A1 | 9/2003 | Elkington et al. | |
| 2005/0034222 | A1 * | 2/2005 | Durocher | 2/425 |
| 2005/0081403 | A1 | 4/2005 | Mathieu | |
| 2005/0087115 | A1 | 4/2005 | Martin | |
| 2005/0098673 | A1 | 5/2005 | Huang | |
| 2005/0102861 | A1 | 5/2005 | Martin | |
| 2005/0198866 | A1 | 9/2005 | Wiper et al. | |
| 2005/0273025 | A1 | 12/2005 | Houser | |
| 2006/0015988 | A1 * | 1/2006 | Philpott et al. | 2/410 |
| 2006/0156517 | A1 | 7/2006 | Hammerslag et al. | |
| 2006/0179685 | A1 | 8/2006 | Borel et al. | |
| 2006/0195974 | A1 * | 9/2006 | Burkhart et al. | 2/421 |
| 2007/0113524 | A1 | 5/2007 | Lander | |
| 2007/0128959 | A1 | 6/2007 | Cooke | |
| 2007/0169378 | A1 | 7/2007 | Sodeberg et al. | |
| 2007/0226875 | A1 | 10/2007 | Lee | |
| 2007/0245456 | A1 | 10/2007 | Cho | |
| 2007/0276306 | A1 | 11/2007 | Castillo | |
| 2008/0016717 | A1 | 1/2008 | Ruban | |
| 2008/0060167 | A1 | 3/2008 | Hammerslag et al. | |
| 2008/0184451 | A1 * | 8/2008 | Lemke et al. | 2/8.2 |
| 2009/0031482 | A1 * | 2/2009 | Stokes et al. | 2/414 |
| 2009/0124948 | A1 | 5/2009 | Ingimundarson et al. | |
| 2009/0172928 | A1 | 7/2009 | Messmer et al. | |
| 2009/0287128 | A1 | 11/2009 | Ingimundarson et al. | |
| 2010/0050324 | A1 | 3/2010 | Musal | |
| 2010/0081979 | A1 | 4/2010 | Ingimundarson et al. | |
| 2010/0094189 | A1 | 4/2010 | Ingimundarson et al. | |
| 2010/0101061 | A1 | 4/2010 | Ha | |
| 2010/0154254 | A1 | 6/2010 | Fletcher | |
| 2010/0174221 | A1 | 7/2010 | Ingimundarson et al. | |
| 2010/0175163 | A1 | 7/2010 | Litke | |
| 2010/0217169 | A1 | 8/2010 | Ingimundarson | |
| 2010/0319216 | A1 | 12/2010 | Grenzke et al. | |
| 2010/0331750 | A1 | 12/2010 | Ingimundarson | |
| 2011/0000173 | A1 | 1/2011 | Lander | |
| 2011/0071647 | A1 | 3/2011 | Mahon | |
| 2011/0098618 | A1 | 4/2011 | Fleming | |
| 2011/0099690 | A1 | 5/2011 | Higgins et al. | |
| 2011/0144554 | A1 | 6/2011 | Weaver, II et al. | |
| 2011/0167543 | A1 | 7/2011 | Kovacevich et al. | |
| 2011/0178448 | A1 | 7/2011 | Einarsson | |
| 2011/0184326 | A1 | 7/2011 | Ingimundarson et al. | |
| 2011/0191946 | A1 * | 8/2011 | Fang | 2/418 |
| 2011/0197362 | A1 | 8/2011 | Chella et al. | |
| 2011/0214223 | A1 * | 9/2011 | Rogers et al. | 2/418 |
| 2011/0218471 | A1 | 9/2011 | Ingimundarson et al. | |
| 2011/0225843 | A1 | 9/2011 | Kerns et al. | |
| 2011/0266384 | A1 | 11/2011 | Goodman et al. | |
| 2011/0283440 | A1 | 11/2011 | Higgins et al. | |
| 2011/0288461 | A1 | 11/2011 | Arnold et al. | |
| 2011/0301521 | A1 | 12/2011 | Weissenb ck et al. | |
| 2011/0306911 | A1 | 12/2011 | Tran | |
| 2012/0000091 | A1 | 1/2012 | Cotterman et al. | |
| 2012/0004587 | A1 | 1/2012 | Nickel et al. | |
| 2012/0005995 | A1 | 1/2012 | Emery | |
| 2012/0010547 | A1 | 1/2012 | Hinds | |
| 2012/0029404 | A1 | 2/2012 | Weaver, II et al. | |
| 2012/0101417 | A1 | 4/2012 | Joseph | |
| 2012/0102783 | A1 | 5/2012 | Swigart et al. | |
| 2012/0144565 | A1 * | 6/2012 | Huh | 2/421 |
| 2012/0157902 | A1 | 6/2012 | Castillo et al. | |
| 2012/0159696 | A1 * | 6/2012 | Polstein et al. | 2/417 |
| 2012/0204330 | A1 * | 8/2012 | Albouy | 2/421 |
| 2012/0216341 | A1 * | 8/2012 | Manzella et al. | 2/424 |
| 2012/0228419 | A1 | 9/2012 | Chen | |
| 2012/0246974 | A1 | 10/2012 | Hammerslag et al. | |
| 2012/0253252 | A1 | 10/2012 | Weaver, II | |
| 2013/0012856 | A1 | 1/2013 | Hammerslag et al. | |
| 2013/0025100 | A1 | 1/2013 | Ha | |
| 2013/0092780 | A1 | 4/2013 | Soderberg et al. | |
| 2013/0111653 | A1 * | 5/2013 | Huh | 2/421 |
| 2013/0239303 | A1 * | 9/2013 | Cotterman et al. | 2/417 |
| 2013/0269219 | A1 | 10/2013 | Nickel et al. | |
| 2013/0277485 | A1 | 10/2013 | Soderberg et al. | |
| 2014/0013553 | A1 | 1/2014 | Soderberg et al. | |
| 2014/0117140 | A1 | 5/2014 | Goodman et al. | |

FOREIGN PATENT DOCUMENTS

| | | | |
|---|---|---|---|
| CA | 2112789 | | 8/1994 |
| CA | 2114387 | | 8/1994 |
| CH | 41765 | | 9/1907 |
| CH | 111341 | | 11/1925 |
| CH | 199766 | | 11/1938 |
| CH | 204 834 | A | 8/1939 |
| DE | 555211 | | 7/1932 |
| DE | 641976 | | 2/1937 |
| DE | 1 661 668 | | 8/1953 |
| DE | 7043154.8 | | 3/1971 |
| DE | 7045778.2 | | 3/1971 |
| DE | 1 785 220 | | 5/1971 |
| DE | 2 062 795 | | 6/1972 |
| DE | 7047038 | | 1/1974 |
| DE | 23 41 658 | | 3/1974 |
| DE | 24 14 439 | | 10/1975 |
| DE | 29 00 077 | A1 | 7/1980 |
| DE | 29 14 280 | A1 | 10/1980 |
| DE | 31 01 952 | A1 | 9/1982 |
| DE | 81 01 488.0 | | 7/1984 |
| DE | 38 13 470 | A1 | 11/1989 |
| DE | 3822113 | C2 | 1/1990 |
| DE | 43 02 401 | A1 | 8/1994 |
| DE | 94 13 147 | U | 10/1994 |
| DE | 93 15 776.2 | | 2/1995 |
| DE | 295 03 552.8 | | 4/1995 |
| DE | 196 24 553 | A1 | 1/1998 |
| DE | 19945045 | A1 | 9/1999 |
| DE | 201 16 755 | U1 | 1/2002 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 651 954 | A1 | 5/1995 |
| EP | 0 693 260 | B1 | 1/1996 |
| EP | 0 734 662 | A1 | 10/1996 |
| EP | 0 898 904 | | 8/1998 |
| EP | 1 236 412 | A | 9/2002 |
| FR | 1 349 832 | | 1/1964 |
| FR | 1 374 110 | | 10/1964 |
| FR | 1 404 799 | | 7/1965 |
| FR | 2 019 991 | A | 7/1970 |
| FR | 2 108 428 | | 5/1972 |
| FR | 2 173 451 | | 10/1973 |
| FR | 2 175 684 | | 10/1973 |
| FR | 2 399 811 | | 3/1979 |
| FR | 2 565 795 | A1 | 12/1985 |
| FR | 2 598 292 | A1 | 11/1987 |
| FR | 2 770 379 | A1 | 5/1999 |
| FR | 2 814 919 | A1 | 4/2002 |
| GB | 11673 | | 6/1899 |
| GB | 216400 | | 5/1924 |

(56) References Cited

FOREIGN PATENT DOCUMENTS

| | | | |
|---|---|---|---|
| GB | 2449722 | A | 5/2007 |
| IT | 1220811 | | 3/1998 |
| IT | PD 2003 A 00197 | | 3/2005 |
| IT | PD 2003 A 000198 | | 3/2005 |
| JP | 8-9202 | | 6/1933 |
| JP | 49-28618 | | 3/1974 |
| JP | 51-2776 | | 1/1976 |
| JP | 51-121375 | | 10/1976 |
| JP | 51-131978 | | 10/1976 |
| JP | 53-124987 | | 3/1977 |
| JP | 54-108125 | | 1/1978 |
| JP | 62-57346 | | 4/1987 |
| JP | 63-80736 | | 5/1988 |
| JP | 3030988 | | 3/1991 |
| JP | 3031760 | | 3/1991 |
| JP | 5-228169 | | 9/1993 |
| JP | 7-208 | | 1/1995 |
| JP | 10-199366 | | 7/1998 |
| JP | 2004-016732 | | 1/2004 |
| JP | 2004-041666 | | 2/2004 |
| KR | 20-0367882 | | 11/2004 |
| KR | 20-0400568 | | 11/2005 |
| KR | 10-0598627 | | 7/2006 |
| KR | 10-0953398 | | 4/2010 |
| KR | 10-1028468 | | 4/2011 |
| KR | 10-1053551 | | 7/2011 |
| KR | 10-1099458 | | 12/2011 |
| WO | WO 94/27456 | | 12/1994 |
| WO | WO 95/03720 | | 2/1995 |
| WO | WO 98/37782 | | 9/1998 |
| WO | WO 99/15043 | A1 | 4/1999 |
| WO | WO 00/53045 | | 9/2000 |
| WO | WO 00/76337 | A1 | 12/2000 |
| WO | WO 01/08525 | A1 | 2/2001 |
| WO | WO 2007/016983 | A1 | 2/2007 |

OTHER PUBLICATIONS

U.S. Appl. No. 13/865,951, filed Apr. 18, 2013, Soderberg, et al.
U.S. Appl. No. 13/924,426, filed Jun. 21, 2013, Soderberg, et al.
U.S. Appl. No. 13/829,601, filed Mar. 14, 2013, Nickel, et al.
ASOLO® Boot Brochure Catalog upon information and belief date is as early as Aug. 22, 1997.
International Preliminary Report on Patentability for PCT/CA2008/000819 dated Jul. 20, 2010, in 7 pages, which corresponds to US 2011/0099690.
Written Opinion of the International Searching Authority for PCT/CA2008/000819 dated Sep. 25, 2008, in 6 pages, which corresponds to US 2011/0099690.
International Search Report for PCT/CA2008/000819 dated Sep. 25, 2008, in 2 pages, which corresponds to US 2011/0099690.
International Preliminary Report on Patentability for PCT/CA2009/000044 dated Jul. 20, 2010, in 6 pages, which corresponds to US 2011/0283440.
Written Opinion of the International Searching Authority for PCT/CA2009/000044 dated Apr. 23, 2009, in 5 pages, which corresponds to US 2011/0283440.
International Search Report for PCT/CA2009/000044 dated Apr. 23, 2009, in 2 pages, which corresponds to US 2011/0283440.
Images of helmet available at least as early as Feb. 22, 2011. Believed to be the Specialized Prevail Helmet.
Images of helmet available at least as early as Feb. 22, 2011. Believed to be a helmet from POC.
Images of helmet available at least as early as Feb. 22, 2011. Believed to be the K2 Clutch Helmet.
Images of helmet available at least as early as Feb. 22, 2011. Believed to be the Giro G10 Helmet.
Images of helmet available at least as early as Feb. 22, 2011. Believed to be the Giro Athlon Helmet.
Images of helmet available at least as early as Feb. 22, 2011. Believed to be the Casco Rebell Helmet.
Images of helmet available at least as early as Feb. 22, 2011. Believed to be the Bell Sequence Helmet.
U.S. Appl. No. 14/228,075, filed Mar. 27, 2014, Hammerslag, et al.
U.S. Appl. No. 14/268,498, filed May 2, 2014, Kerns, et al.

* cited by examiner

TIGHTENING SYSTEMS

CROSS-REFERENCE TO RELATED APPLICATIONS

This application claims the benefit under 35 U.S.C. §119(e) of U.S. Provisional Patent Application No. 61/610,401, filed on Mar. 13, 2012, and titled TIGHTENING SYSTEMS, the entirety of which is hereby incorporated by reference for all that it discloses and is made a part of this specification.

BACKGROUND

1. Field of the Disclosure

This disclosure relates to tightening systems for use with a wearable article, such as a helmet or other headwear.

2. Description of the Related Art

Helmets are commonly used to provide protection to the head of a wearer, such as during sporting activities. A helmet that does not fit properly to the wearer's head can cause discomfort and can provide insufficient protection in some cases. For example, if a helmet is worn that is too large for the wearer's head, the helmet can shift positions during use and may even fall off. Helmets can be made of different sizes by using different sized shells and/or by using different amounts of padding in the helmet. Some helmets provide an air bladder or straps inside the helmet which can be used to adjust the size of the helmet. However, existing helmets suffer from various drawbacks. For example, some existing helmets do not provide sufficient adjustability to comfortably fit to a wide variety of head shapes and sizes. Some existing helmets apply pressure unevenly across the head of the wearer, which can cause discomfort.

SUMMARY OF CERTAIN EMBODIMENTS

Various embodiments disclosed herein can be configured to address one or more drawbacks found in existing helmets.

Various embodiments disclosed herein relate to a tightening system for use with a helmet or other headwear. The tightening system can include a front support member and a rear support member spaced apart from the front support member forming a gap therebetween. A lace can be coupled to the front support member and to the rear support member, and the lace can extend across the gap between the front support member and the rear support member. A tightening mechanism can be configured to adjust tension on the lace. The tightening system can include at least one intermediate tender, which can be configured to engage the lace between the front support member and the rear support member.

In some embodiments, the at least one intermediate tender can be configured to engage the lace to form a non-linear lace path across the gap between the front support member and the rear support member.

The front support member can include a forehead strap configured to engage a forehead portion of a wearer's head. The front support member can include one or more temple guides configured to be positioned near the temples of a wearer's head. The rear support member can include a yoke configured to engage the back of the wearer's head.

The lace can form a single lace loop that extends across a right side of the tightening system and across a left side of the tightening system, can provide a dynamic fit between the right side and the left side.

In some embodiments, the angle between the lace path from the intermediate tender towards front support member and the lace path from the intermediate tender towards the rear support member is between about 30° and 60°.

In some embodiments, the rear support can include a height adjustment system configured to allow the rear support to slide across a range of motion, wherein the rear support is infinitely positionable within the range of motion. The height adjustment system can be configured to allow movement of the rear support while the helmet or other headwear is worn. The height adjustment system can include a strap and a slide clamp, which can be configured to slidably receive the strap. The slide clamp can include one or more retaining members configured to apply friction on the strap to resist sliding of the strap relative to the slide clamp. A pulling force on the strap below a threshold value can be insufficient to overcome the friction and slide the strap relative to the slide clamp, and a pulling force on the strap above the threshold value can overcome the friction and causes the strap to slide relative to the slide clamp. The slide clamp can be configured to be coupled to the helmet or other headwear, and the strap can be coupled to the yoke.

In some embodiments the at least one intermediate tender can be configured such that tightening the lace causes the at least one intermediate tender to move inwardly to apply a tightening force to a wearer's head.

The at least one intermediate tender can include a first lace guide path, a second lace guide path, and dividing element disposed between the first lace guide path and the second lace guide path. An opening can be configured to allow a lace to move from the second lace guide path to the first lace guide path. The at least one intermediate tender can include one or more cover portions configured to retain the lace in the first lace guide path and the second lace guide path. A distance between the dividing element and the one or more cover portions can narrow in a direction from the second lace guide path to the first lace guide path. The dividing element can include a sloped or tapered surface. The one or more cover portions can be angled with respect to the dividing element. The distance between the dividing element and the one or more cover portions can be less than the thickness of the lace for at least a portion of the dividing element. The intermediate tender can include one or more flexible portions that are configured to flex to increase the distance between the dividing element and the one or more cover portions to allow the lace to pass through the area between the dividing element and the one or more cover portions. A surface of the dividing element can define a portion of the first lace guide path.

The front support member can include a lace guide configured to receive the lace, and the lace guide can include a lace channel and one or more tabs extending over the lace channel. The tabs can be configured to retain the lace in the lace channel. The lace guide can include a lace entry portion configured to facilitate entry of the lace into the lace channel. The lace entry portion can include a recessed or inclined portion adjacent to the one or more tabs. The lace guide can further include a hole configured to receive an end of the lace such that the lace terminates at the lace guide. The recessed or inclined portion can have a width that is at least as wide as the thickness of the lace. The lace channel can include the lace entry portion in some embodiments. At least a portion of the lace channel can have a width that is wide enough such that a distance between an end of the one or more tabs and the edge of the lace channel is at least as wide as the thickness of the lace. The one or more tabs can include a protrusion configured to retain the lace in the lace channel. The lace can be coupled into the lace channel by positioning the lace in or on the lace entry portion and pulling the lace generally towards the one or more tabs.

The tightening mechanism can include a housing, a spool rotatable relative to the housing, a plurality of teeth, a first pawl configured to engage the teeth to prevent rotation of the spool in a first direction and to allow rotation of the spool in a second direction, and a second pawl configured to engage the teeth to prevent rotation of the spool in the second direction and to allow rotation of the spool in the first direction. The tightening mechanism can include a sweeper configured to displace the first pawl away from the teeth to allow rotation of the spool in the first direction. Rotation of the spool in the first direction causes the second pawl to ratchet across the teeth. The first pawl can be coupled to the second pawl such that displacement of first pawl increases the force with which the second pawl presses against the teeth.

The spool can include a first lace channel configured to gather a first lace side, and a second lace channel configured to gather a second lace side. Rotation of the spool in a tightening direction can cause the first lace side to be gathered into the first lace channel and the second lace side to be gathered into the second lace channel, and rotation of the spool in a loosening direction can cause the first lace side to be released from the first lace channel and the second lace side to be released from the second lace channel.

Various embodiments disclosed herein relate to a lace guide for use with a wearable article. The lace guide can include a first lace guide path, a second lace guide path, and a dividing element disposed between the first lace guide path and the second lace guide path. The lace guide can include an opening configured to allow a lace to move from the second lace guide path to the first lace guide path. The lace guide can further include one or more cover portions configured to retain the lace in the first lace guide path and the second lace guide path. A distance between the dividing element and the one or more cover portions can narrow in a direction from the second lace guide path to the first lace guide path. Various other features and components described herein can be applicable to the lace guide.

Various embodiments disclosed herein relate to a lace guide (e.g., for use with a wearable article) that includes a lace channel, and one or more tabs extending over the lace channel. The tabs can be configured to retain the lace in the lace channel. The lace guide an include a lace entry portion configured to facilitate entry of the lace into the lace channel. The lace entry portion can include a recessed or inclined portion adjacent to the one or more tabs. Various other features and components disclosed herein can be applicable to the lace guide.

Various embodiments disclosed herein relate to an adjustment system that includes a strap and a slide clamp configured to slidably receive the strap. The slide clamp can have one or more retaining members configured to apply friction on the strap to resist sliding of the strap relative to the slide clamp. A pulling force on the strap below a threshold value can be insufficient to overcome the friction and slide the strap relative to the slide clamp. A pulling force on the strap above the threshold value can overcome the friction and cause the strap to slide relative to the slide clamp.

In some embodiments, the strap can be coupled to a support member of a tightening system for an article such that movement of the strap causes movement of the support member, and the clamp can be coupled to the article. In some embodiments, the strap can be coupled to an article, and the clamp can be coupled to a support member of a tightening system for the article such that movement of the clamp causes movement of the support member.

The slide clamp can include a channel formed between a pair of openings, and the channel can be configured to slidably receive the strap. The slide clamp can include one or more leaf springs configured to press against the strap. In some embodiments, the slide clamp is infinitely positionable with respect to the strap across a range of motion.

Various embodiments disclosed herein relate to a helmet or other headwear that includes a support member and a height adjustment system coupled to the support member. The height adjustment system can be configured to allow the support member to move across a range of motion, and the support member can be infinitely positionable within the range of motion.

The height adjustment system can allow the height of the support member to be adjusted while the headwear is worn on a wearer's head without removal of the headwear. The height adjustment system can allow the support member to slide smoothly across the range of motion. The height adjustment system can allow the support member to move across the range of motion with substantially uniform resistance.

Various embodiments disclosed herein relate to a tightening mechanism that includes a housing, a spool rotatable relative to the housing, a plurality of teeth, a first pawl configured to engage the teeth to prevent rotation of the spool in a first direction and to allow rotation of the spool in a second direction, and a second pawl configured to engage the teeth to prevent rotation of the spool in the second direction and to allow rotation of the spool in the first direction.

In some embodiments, a sweeper can be configured to displace the first pawl away from the teeth to allow rotation of the spool in the first direction. Rotation of the spool in the first direction can cause the second pawl to ratchet across the teeth. In some embodiments, the first pawl can be coupled to the second pawl such that displacement of first pawl increases the force with which the second pawl presses against the teeth. The sweeper can also be configured to displace the second pawl away from the teeth to allow rotation of the spool in the second direction.

The spool can include a first lace channel configured to gather a first lace side, and a second lace channel configured to gather a second lace side. The first lace side and the second lace side can be sides of the same lace. The first lace side can be a side of a first lace, and the second lace side can be a side of a second lace. Rotation of the spool in a tightening direction can cause the first lace side to be gathered into the first lace channel and the second lace side to be gathered into the second lace channel. Rotation of the spool in a loosening direction can cause the first lace side to be released from the first lace channel and the second lace side to be released from the second lace channel. In some embodiments, rotation of the spool in a first direction can cause the first lace side to be gathered into the first lace channel and the second lace side to be released from the second lace channel, and rotation of the spool in a second direction can cause the first lace side to be released from the first lace channel and the second lace side to be gathered into the second lace channel.

A ring spring can couple the first pawl to the second pawl.

BRIEF DESCRIPTION OF THE DRAWINGS

Various embodiments are depicted in the accompanying drawings for illustrative purposes, and should in no way be interpreted as limiting the scope of the inventions.

DETAILED DESCRIPTION OF CERTAIN EMBODIMENTS

Figure 1:
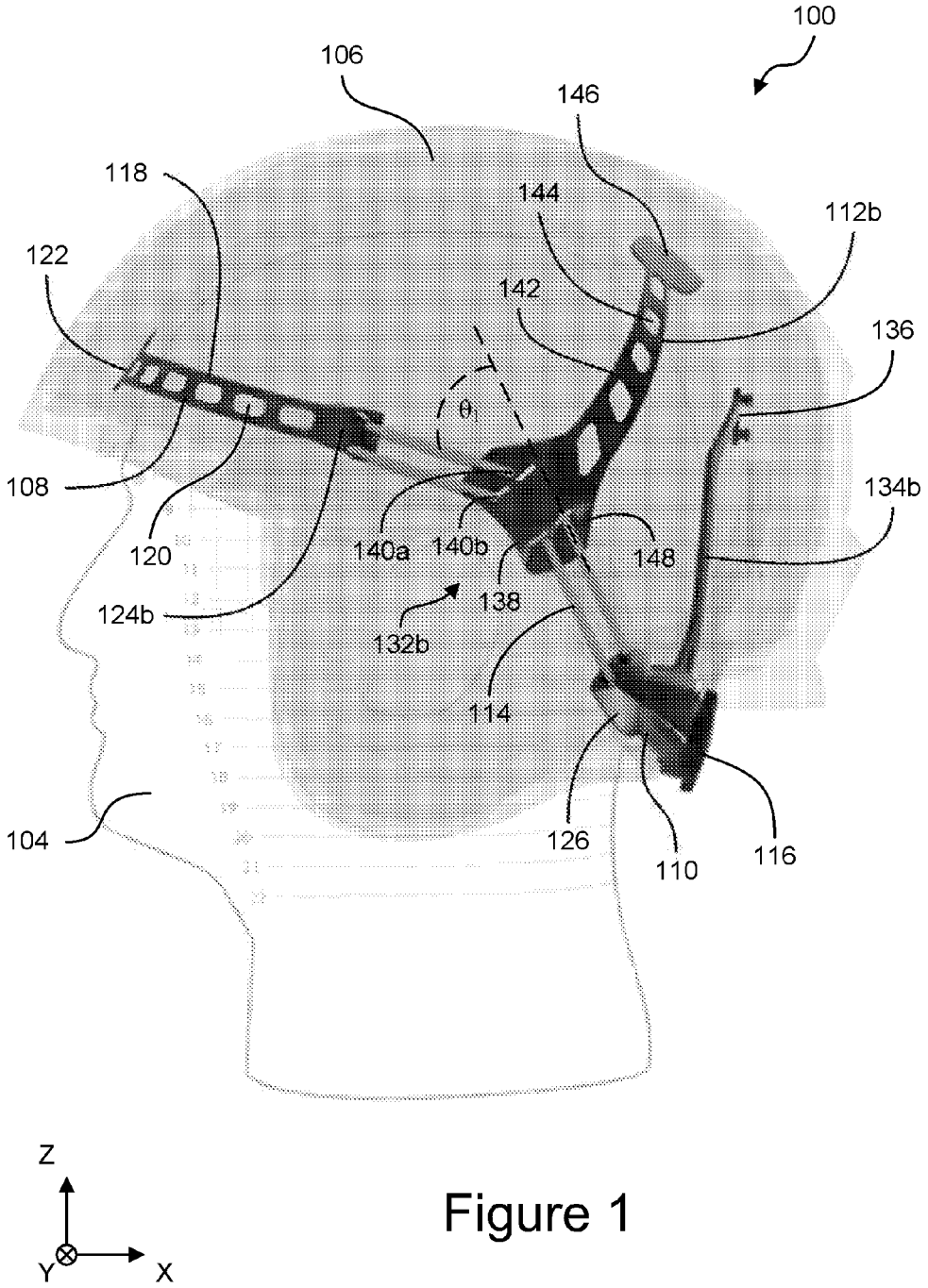
FIG. 1 is a side view of an example embodiment of a helmet that includes a tightening system configured adjust the fit of the helmet on the head of a wearer.
Figure 2:
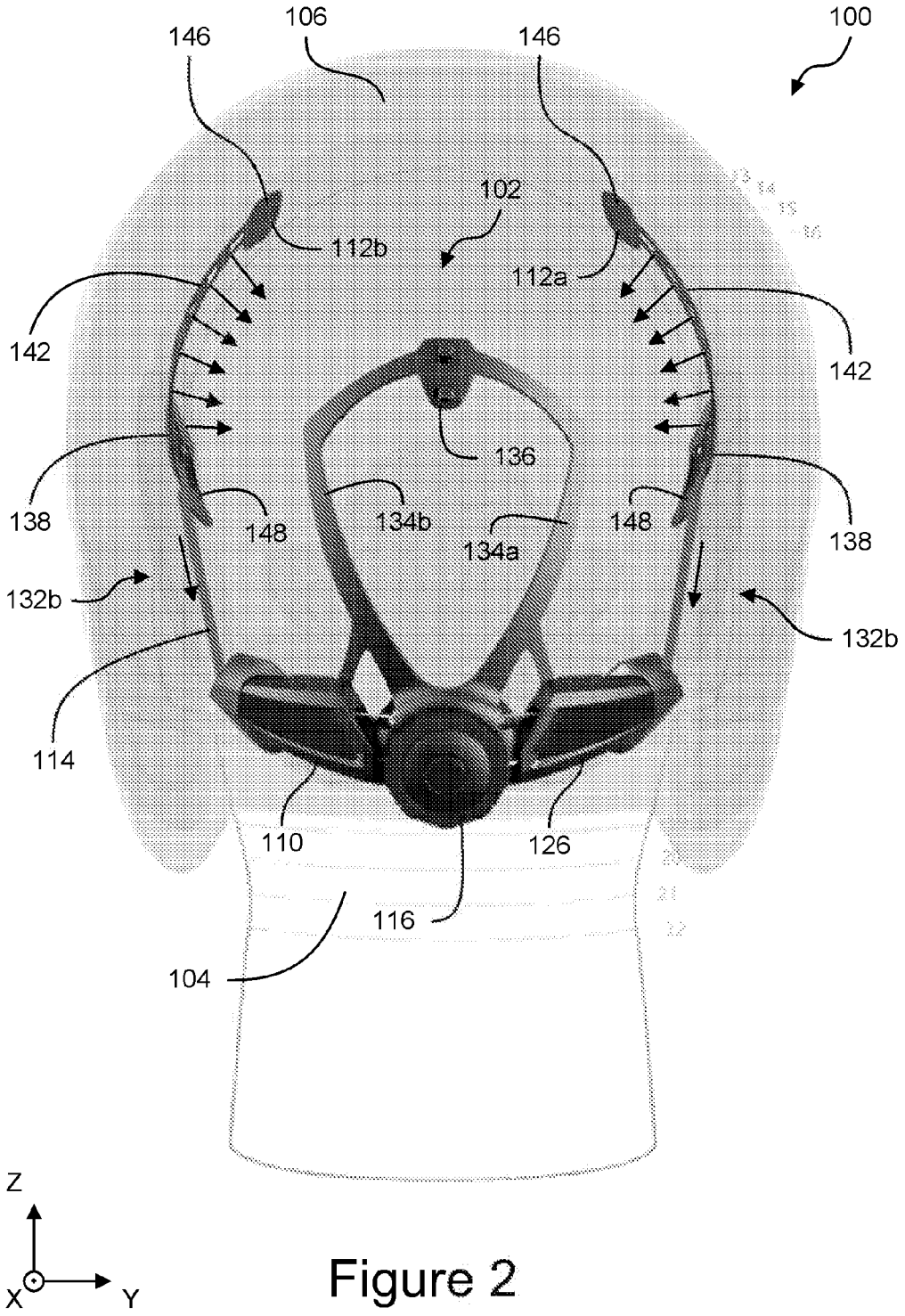
FIG. 2 shows a back view of the helmet of FIG. 1.
Figure 3:
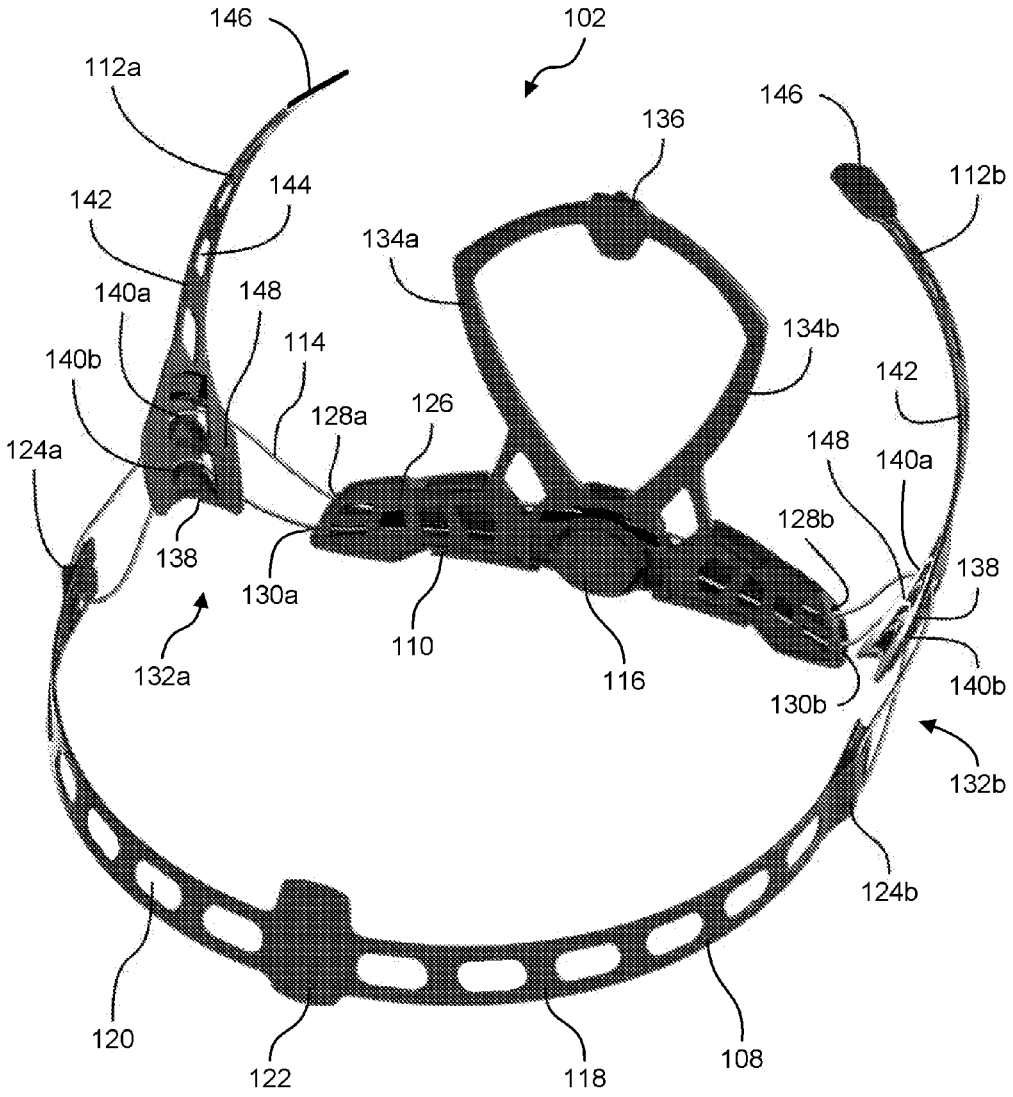
FIG. 3 shows an isometric view of the tightening system of FIG. 1.
Figure 3:
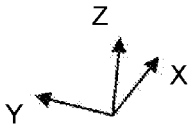

FIG. 1 is a side view of an example embodiment of a helmet 100 that includes a tightening system 102 configured adjust the fit of the helmet 100 on the head 104 of a wearer. FIG. 2 shows a back view of the helmet 100. FIG. 3 shows an isometric view of the tightening system 102. Although various embodiments are discussed herein in connection with helmets 100, various features of this disclosure can be used with other wearable articles (e.g., shoes, boots, other footwear, bindings, braces, belts, hats, headwear, gloves, backpacks, jackets, shirts, pants, etc.), or with other devices that have a variable distance between multiple objects or parts that can be adjusted using a tightening system.

The helmet 100 can include a shell 106 configured to fit around the head 104 of the wearer. The shell 106 can be made from a hard plastic or other hard material to provide protection against impacts to the wearer's head. In some embodiments, the helmet 100 can include padding on the inside of the shell 106 to provide a comfortable fit and/or to absorb the force of an impact delivered to the helmet 100. The helmet 100 can be configured for various uses, such as, but not limited to, cycling or snow sports (e.g., skiing and snowboarding). In FIGS. 1 and 2, the shell 106 of the helmet 100 is shown semi-transparent so that the tightening system 102 is visible therein.

The tightening system 102 can include a front support member, such as a forehead strap 108, that is configured to extend generally horizontally across the wearer's forehead. A rear support member, such as a yoke 110, can be positioned at the rear of the helmet 100 and can be configured to engage the back of the wearer's head 104, such as at the base of the head 104 near the neck. One or more intermediate tenders 112*a* and 112*b* can be positioned on the sides of the helmet 100 to direct tightening forces of the closure system 102. In the illustrated embodiment, a first intermediate tender 112*a* is positioned on the right side of the helmet 100, and a second intermediate tender 112*b* is positioned on the left side of the helmet 100. In some embodiments, additional lace tenders can be positioned on the sides of the helmet 100. A lace 114 can extend between the yoke 110, the intermediate tenders 112*a* and 112*b*, and the forehead strap 108. Although various embodiments are disclosed herein as using a lace 114 to apply tension to the tightening system 102, other tensioning members can be used, such as a strap. A tightening mechanism 116 can be configured to adjust the tension in the lace 114. For example, the tightening mechanism 116 can be a reel-based tightening mechanism that is configured to rotate to gather lace 114 for tightening the tightening system 102. Although shown as attaching to the ends of various straps, in some embodiments, the lace 114 may extend along and/or overlap some or all of certain straps.

The forehead strap 108 can include an elongate strap 118, which can have holes 120 therein to improve air circulation. In some embodiments, the forehead strap 108 can be secured to the helmet 100. For example, an attachment portion 122 of the forehead strap 108 can be attached (e.g., removably attached) to the inside of the front of the helmet 100, such as by an adhesive, or by engagement members that provide a snap-fit, hook and loop engagement, friction-fit, or the like. The attachment portion 122 of the forehead strap 108 can be positioned at or near the center of the forehead strap 108. A first lace guide 124*a* can be positioned on the right side of the forehead strap 108 and a second lace guide 124*b* can be positioned on the left side of the forehead strap 108. The lace guides 124*a* and 124*b* can engage the lace 114 so that tightening the lace 114 pulls the forehead strap 108 generally back towards the yoke 110. In some embodiments, tightening the lace 114 can pull portions, e.g., the sides, of the strap 118 inward in the y-direction to wrap around the curvature of the wearer's head 104. In some embodiments, when the lace 114 is tightened, the force can be distributed across substantially the entire length of the strap 118.

The yoke 110 can have the tightening mechanism 116 attached (e.g., removably attached) thereto, such as by an adhesive, a snap-fit connection, friction-fit connection, or the like. In some embodiments, a housing of the tightening mechanism 116 can be integrally molded with some or all of the yoke 110. In some embodiments, the tightening mechanism 116 can be mounted separate from the yoke 110, such as on the shell 106 on the side of the helmet 100, and the lace 114 can extend from the tightening mechanism 116 to the yoke 110. The yoke 110 can include a yoke base 126, which can extend generally horizontally across the bottom of the back of the wearer's head 104. In some embodiments, the yoke base 126 can include lace channels 130*a* and 130*b* that provide pathways for the lace 114 to extend through the yoke base 126 to the tightening mechanism 116. The yoke base 110 can also include one or more lace channels 128*a* and 128*b* that provide an additional lace path through the yoke base 126.

In some embodiments, the lace 114 can form a loop that extends to both sides of the helmet 100. For example, a first end of the lace 114 can be coupled to the tightening mechanism 116 (e.g., to a spool, as described herein), and the lace can extend out of the tightening mechanism, through the channel 130*a* on the right side of the yoke base 110, across a right-side gap 132*a* between the yoke 110 and forehead strap 108, through the right lace guide 124*a* on the right side of the forehead strap 108, back across the right-side gap 132*a*, through the lace channels 128*a* and 128*b* to the left side of the yoke base 126, across a left-side gap 132*b* between the yoke 110 and forehead strap 108, through the left lace guide 124*b* on the left side of the forehead strap 108, back across the left-side gap 132*b*, through the lace channel 128*b* on the left side of the yoke base 126, to the tightening mechanism 116. The second end of the lace 114 can be coupled to the tightening mechanism 116 (e.g., to a spool, as described herein). Thus, tightening the lace 114 can tighten both the right and left sides of the helmet 110. The single lace 114 extending to both sides of the helmet 100 can produce a dynamic fit between the right and left sides of the helmet 100. For example, as lace 114 is drawn into the tightening mechanism 116, forces on the system (e.g., caused by the shape of the wearer's head 104) can cause the lace to slide through the lace guides and channels so that different amounts of the lace 114 are disposed on the different sides of the helmet 100. For example, if the wearer's head 104 is larger on the right side than on the left side, tightening the lace 114 can cause the lace 114 to shift through the lace guides and channels so that the portion of the lace loop on the right side of the helmet 100 is larger than the portion of the lace loop on the left side of the helmet 100. Thus, one side of the helmet 100 can have more of the lace 114 than the other side due to the dynamic fit of the single lace loop that extends across both sides of the helmet 100. In some embodiments, the lace 114 may extend through one or more lace guides 140*a* and 140*b* (e.g., on the intermediate lace tenders 112*a* and 112*b*) as the lace 114 passes through the right-side gap 132*a* and the left-side gap 132*b*. In some embodiments separate laces can be used for the left and right sides.

The lace 114 can extend to the forehead strap 108 and then loop back across the back of the helmet to the other side. Thus, the lace loop can create a 2:1 ratio between the amount of lace 114 drawn into the tightening mechanism 116 and the amount of closure applied to the tightening system 102. Thus, the lace loop and the lace guides 124*a* and 124*b* can operate as a pulley system to increase the precision and the mechanical resolution of the tightening system by a factor of two. Other lacing configurations can be used to provide other ratios between the amount of lace 114 drawn into the tightening mechanism 116 and the amount of closure applied to the tightening system 102. For example, in some embodiments, the lace 114 can extend once across each of the gaps 132*a* and 132*b*, and a 1:1 ratio can be provided between the amount of lace 114 drawn into the tightening mechanism 116 and the amount of closure applied to the tightening system 102. In some embodiments, the lace 114 can extend three times across each gap 132*a* and 143*b*, and a 3:1 ratio can be provided between the amount of lace 114 drawn into the tightening mechanism 116 and the amount of closure applied to the tightening system 102.

Arms 134*a* and 134*b* can extend upward from the yoke base 126. The arms 134*a* and 134*b* can be configured to wrap around the back of the wearer's head 104 to distribute the tightening force across the back of the wearer's head 104. The yoke 110 can be attached (e.g., removably attached) to the helmet 100 (e.g., to the shell 106) by an attachment portion 136 of the yoke 110, such as by an adhesive, a snap-fit connection, a friction-fit connection, hood and loop fasteners, or the like. In some embodiments, the yoke 110 can be height adjustable, as discussed elsewhere herein. The engagement portion 136 can be positioned at the top of the yoke 110, such as at the ends of the arms 134*a* and 134*b*, which, in some embodiments, can diverge from the center region of the yoke base 126, and can converge towards the engagement portion 136. As the lace 114 is tightened, the yoke base 126 can be pulled forward towards the forehead strap 108 so that the arms 134*a* and 134*b* and/or the sides of the yoke base bend and tighten around the back of the wearer's head 104. Thus, arms 134*a* and 134*b* can cooperate to form a load dispersing portion that can accommodate a rounded head surface there between.

The intermediate tenders 112*a* and 112*b* can include a base portion 138 that includes one or more lace guides 140*a* and 140*b* to guide the lace 114 therethrough. Other numbers of lace guides can be included on the intermediate tenders 112*a* and 112*b* (e.g., 1 lace guide, 3 lace guides, or more) depending on the lacing configuration (e.g., how many times the lace 114 extends across the gaps 132*a* and 132*b*). In the illustrated embodiment, the intermediate tenders 112*a* and 112*b* can include a first (e.g., upper) lace guide 140*a* and a second (e.g., lower) lace guide 140*b*. The intermediate tenders 112*a* and 112*b* can include a strap 142 that can extend upward from the base portion 138. The straps 142 can have holes 144 to increase air flow. The intermediate tenders 112*a* and 112*b* can be attached (e.g., removably attached) to the helmet 100 (e.g., to the shell 106), such as by an attachment portion 146 located at the end of the strap 142 (e.g., using an adhesive, snap-fit connections, hook and loop connections, friction-fit connections, or the like). In some embodiments, the intermediate tenbers 112*a* and 112*b* can be coupled together or integrally formed with each other. For example a strap (not shown) can extend between the first and second intermediate tenders 112*a* and 112*b* (e.g., such that the strap extends over the top of the wearer's head 104 when the helmet 100 is worn).

The intermediate tenders 112*a* and 112*b* can be positioned in the gaps 132*a* and 132*b* between the yoke 110 and the forehead strap 108, and the intermediate tenders 112*a* and 112*b* can pull the lace 114 upward in the gaps 132*a* and 132*b* between the yoke 110 and forehead strap 108, as can be seen in FIG. 1. The lace 114 can travel a non-linear lace path between the forehead strap 108 and the yoke 110. For example, the intermediate tenders 112*a* and 112*b* can pull the lace 114 so that the lace path between the forehead strap 108 and the intermediate tenders 112*a* and 112*b* is offset from the lace path between the yoke 110 and the intermediate tenders 112*a* and 112*b* by an angle $\theta_1$, as shown in FIG. 1. The angle $\theta_1$ of offset can be at least about 5° and/or less than or equal to about 85°, or the angle $\theta_1$ of offset can be at least about 15° and/or less than or equal to about 75°, or the angle $\theta_1$ of offset can be at least about 30° and/or less than or equal to about 60°, or the angle $\theta_1$ of offset can be at least about 40° and/or less than or equal to about 50°, although values outside these ranges can also be used in some embodiments. In some embodiments, the angle $\theta_1$ of offset can be about 45°. Because of the dynamic fit, in some embodiments, the angle $\theta_1$ may be offset different amounts on the right side than on the left side of the system 102.

Tightening the lace 114 can pull the base portions 138 of the intermediate tenders 112*a* and 112*b* downward, which can distribute the tightening force through the intermediate tenders 112*a* and 112*b* to the sides of the wearer's head, as shown in FIG. 2. The attachment portions 146 can attach to the helmet 100 at locations that are inward in the y-direction from the widest part of the wearer's head 104 so that pulling down on the intermediate tenders 112*a* and 112*b* causes the intermediate tenders 112*a* and 112*b* to move inward in the y-direction and wrap around the curvature of the wearer's head 104. In some embodiments, the tightening force can be substantially evenly distributed across the intermediate tenders 112*a* and 112*b* between the attachment portions 146 and the base portions 138.

In some embodiments, the angle $\theta_1$ of offset can vary depending on the tension applied to the lace 114. For example, tightening the lace 114 can pull the lace guides 140*a* and 140*b* downward thereby changing the angle $\theta_1$ of offset between the lace paths between the intermediate tenders 112*a* and 112*b* and the forehead strap 108 and the lace paths between the intermediate tenders 112*a* and 112*b* and the yoke 110. In some embodiments, even when the lace 114 is tightened, the lace path across the gaps 132*a* and 132*b* can be non-linear, thereby providing the angle $\theta_1$ of offset. In some embodiments, the angle $\theta_1$ of offset can vary by about 5° or less, or about ° 10 or less, or about 15° or less, or about 30° or less between the loosened and tightened positions, or by about 1° or more, or about 3° or more, or about 5° or more, or about 10° or more, or about 15° or more, although values outside these ranges may be used in some cases.

The intermediate tenders 112*a* and 112*b* can include a pad 148 that extends from behind the lace guides 140*a* and 140*b* partially along the lace paths leading away from the intermediate tenders 112*a* and 112*b*. The pad 148 can provide a running surface between the lace 114 and the wearer's head 104 to spread the tightening force of the lace 114 across a larger surface area to improve comfort. The pad 148 can be flexible so that it can bend to the contours of the wearer's head. In some embodiments, one or both of the lace guides 140*a* and 140*b* can be broad (in the general x-direction) to spread the tightening force. For example, one or both of the lace guides 140*a* and 140*b* can have a length of at least about 10 mm, at least about 20 mm, at least about 30 mm, at least about 40 mm, at least about 50 mm, less than or equal to about 70 mm, less than or equal to about 60 mm, and/or less than or equal to about 50 mm, although values outside of these ranges can also be used. The lace paths through the lace guides 140*a* and 140*b* can be separated from each other by a distance so that the tightening force applied by the lace 114 is spread broadly across an area (e.g., of the base 138 and/or pad 148). For example, the lace paths through the lace guides 140*a* and 140*b* can be separated by a distance of at least about 5 mm, at least about 10 mm, at least about 15 mm, at least about 20 mm, at least about 30 mm, at least about 40 mm, at least about 50 mm, less than or equal to about 70 mm, less than or equal to about 60 mm, less than or equal to about 50 mm, less than or equal to about 40 mm, and/or less than or equal to about 30 mm, although values outside of these ranges can also be used.

In some embodiments, multiple intermediate tenders can be used on one or both sides of the helmet 100. FIGS. 1-3 shows one intermediate tender 112*a* and 112*b* on each side, but two, three, four, or more intermediate tenders (which can function similar to the intermediate tenders 112*a* and 112*b*) can be positioned on one or both sides of the helmet 100. Intermediate tenders of different lengths and/or coupled to the helmet 100 at different locations can be included in order to adjust the path of the lace 114 and/or to distribute the tightening force around the wearer's head 104. In some embodiments, additional intermediate tenders can increase the distribution of the tightening force across a larger area of the wearer's head 104, which can improve comfort and can improve the fit of the helmet 100. In FIGS. 1-3, the intermediate tenders 112*a* and 112*b* are shown as being symmetrical to each other, although, in some embodiments, the intermediate tenders 112*a* and 112*b* can be asymmetrical and the description herein can apply to a single intermediate tender.

In some embodiments, the yoke 110 can be height adjustable (e.g., in the z-direction), which can enable adjustment of the angle or position of the helmet 100 with respect to the user's head. The height adjustment mechanism can be configured to allow adjustment of the height of the yoke 110 without removal or dismantling of the helmet 100, so that the wearer can adjust the height of the yoke 110 while wearing the helmet 100. The height adjustment mechanism can be infinitely position along a range of motion, and the height adjustment mechanism can allow the yoke 110 to slide across the range of motion without clicking or jumping.

Figure 4:
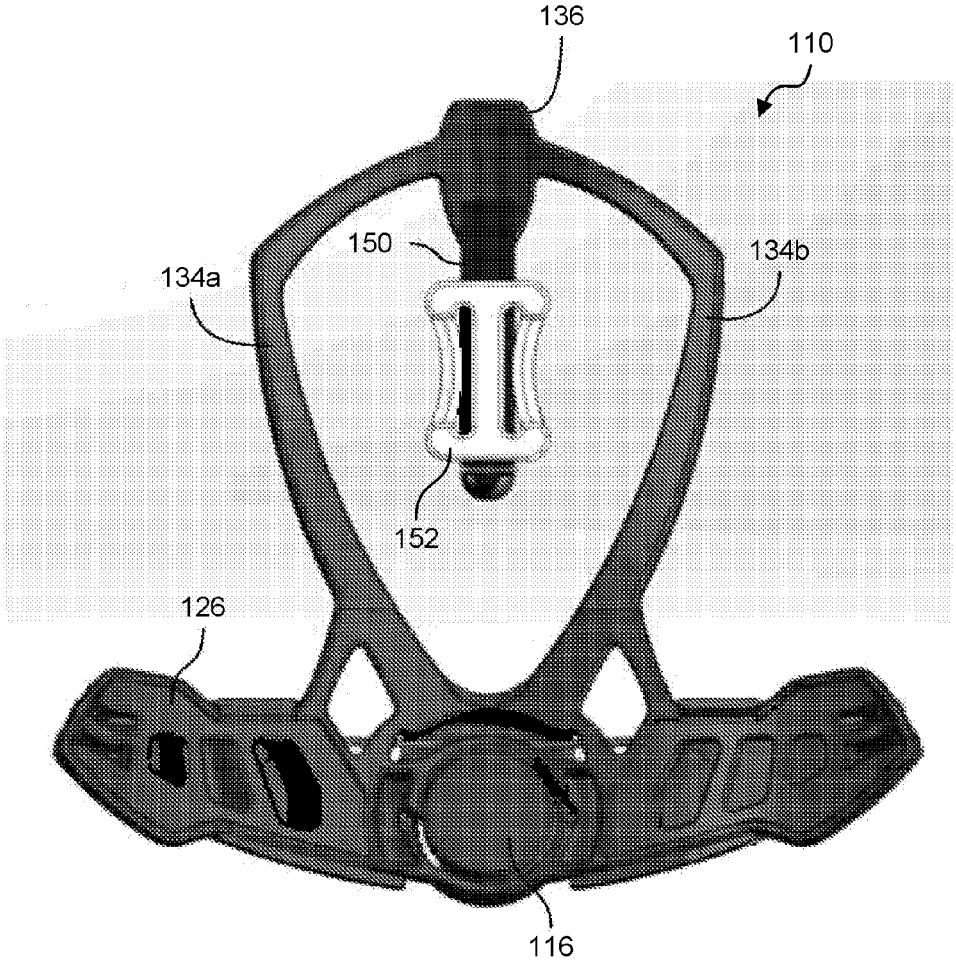
FIG. 4 shows an example embodiment of a yoke having a height adjustment mechanism.
Figure 4:
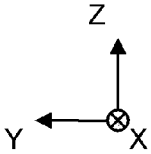
Figure 5A:
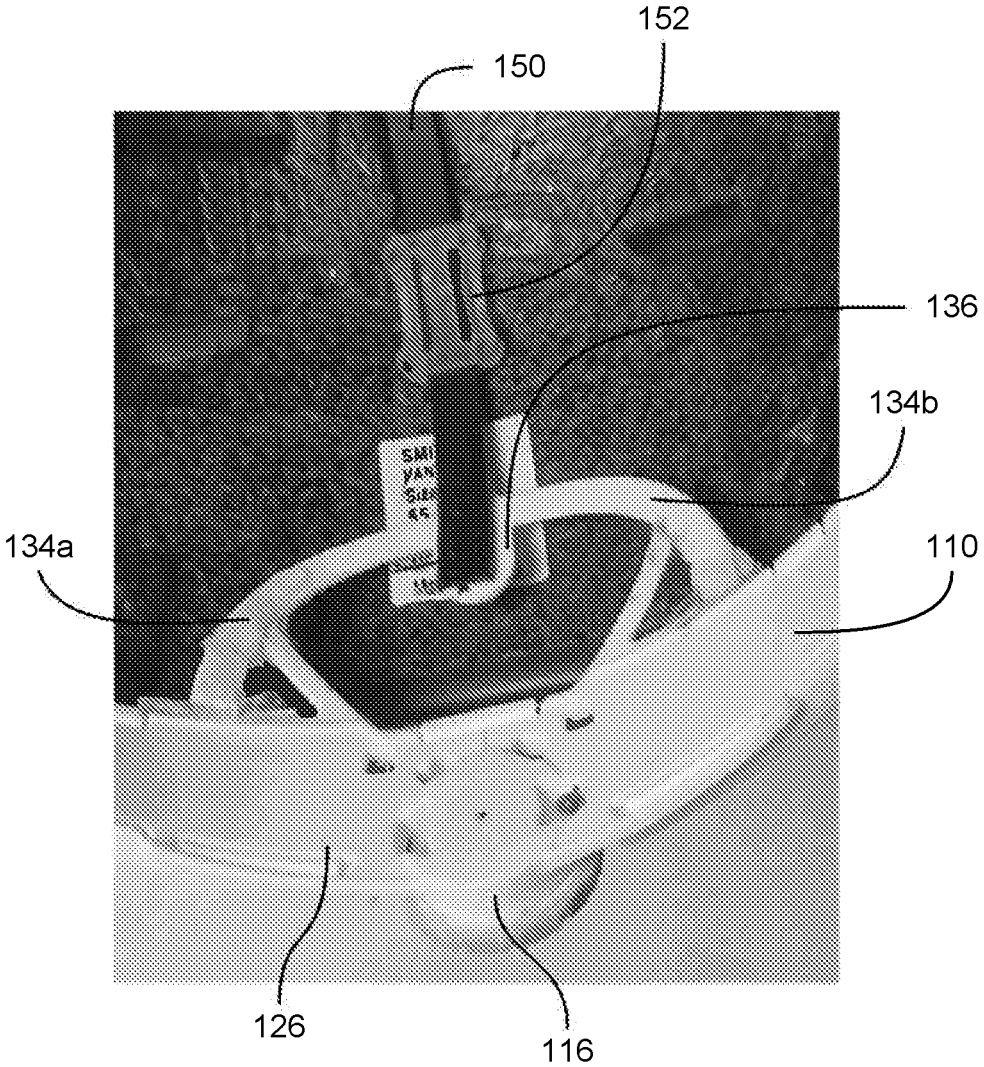
FIG. 5A shows an example embodiment of a helmet having a height adjust mechanism.
Figure 5A:
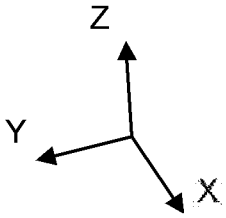
Figure 5B:
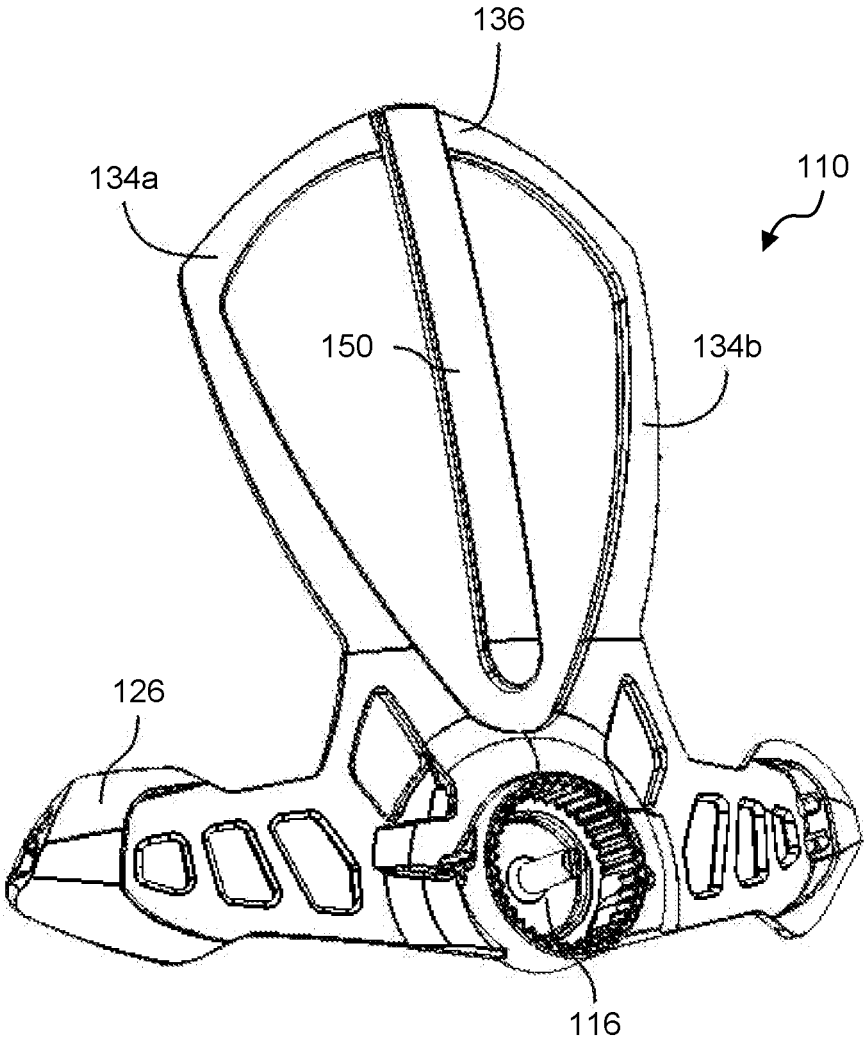
FIG. 5B shows an example of a yoke having a yoke strap.

FIG. 4 shows an example embodiment of a yoke 110 that is height adjustable. FIG. 5A shows another example embodiment of a yoke 110 that is height adjustable. The yoke 110 can include a yoke strap 150, which can extend generally in the z-direction (e.g., extending upward and/or downward from the attachment portion 136). The yoke strap 150 can be integrally formed with, or otherwise coupled to, the attachment portion 136, the arms 134*a* and 134*b*, the yoke base 126, the tightening mechanism 116, and/or other components of the yoke 110 so that movement of the yoke strap 150 (e.g., in the z-direction) causes the other components of the yoke 110 to move along with the yoke strap 150. In some embodiments, the yoke strap 150 can be removably coupled to attachment portion 136 (or other portion of the yoke 110) (e.g., by a snap-fit mechanism, a friction-fit mechanism, a hook and loop mechanism, etc.). A slide clamp 152 can be attached (e.g., removably attached) to the helmet 100 (e.g., using an adhesive, a snap-fit, a friction-fit, a hook and loop combination, etc.), and the slide clamp 152 can be configured to slidably receive the yoke strap 150 therein. FIGS. 5 and 5A shows the slide clamp 152 coupled to the yoke strap 150. FIG. 5B shows an embodiment of the yoke 110 having a yoke strap 150 and the slide clamp 152 omitted from view. By adjusting the position of the yoke strap 150 (which is coupled to the yoke 110) relative to the slide clamp 152 (which is coupled to the helmet 100), the yoke 110 can be adjusted between various height settings (e.g., along the z-direction). In some embodiments, the system does not have a finite number of predetermined height positions, and the yoke strap 150 can be slid to an infinite number of positions with respect to the slide clamp 152. In some embodiments, the slide clamp 152 can be coupled to the yoke 110 (e.g., to the engagement portion 136) and the yoke slide 150 can be coupled to the helmet 100.

The length of the yoke strap 150 and/or other features of the helmet 100 can define a range of motion across which the position of the yoke 110 can be positioned (e.g., generally along the z-axis). In some embodiments, a range of motion of at least about 5 mm, at least about 10 mm, at least about 20 mm, at least about 30 mm, at least about 40 mm, at least about 50 mm, less than or equal to about 100 mm, less than or equal to about 90 mm, less than or equal to about 80 mm, less than or equal to about 70 mm, less than about 60 mm, and/or less than or equal to about 50 mm, although values outside of these ranges can also be used.

Figure 6A:
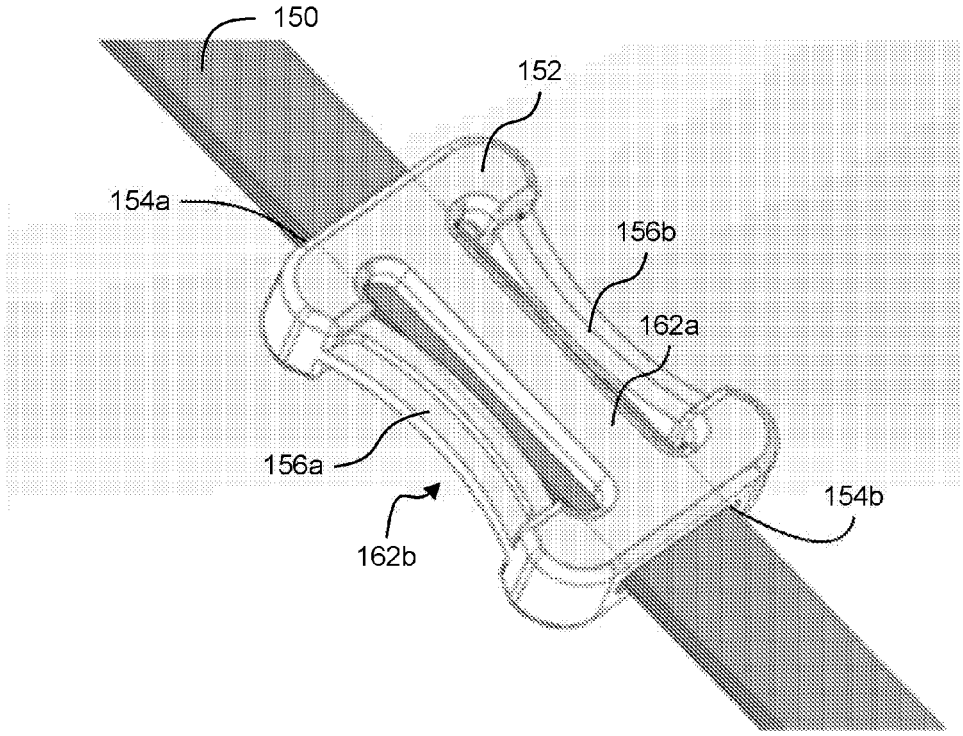
FIG. 6A shows an example implementation of a yoke strap and slide clamp for a height adjustment mechanism.
Figure 6B:
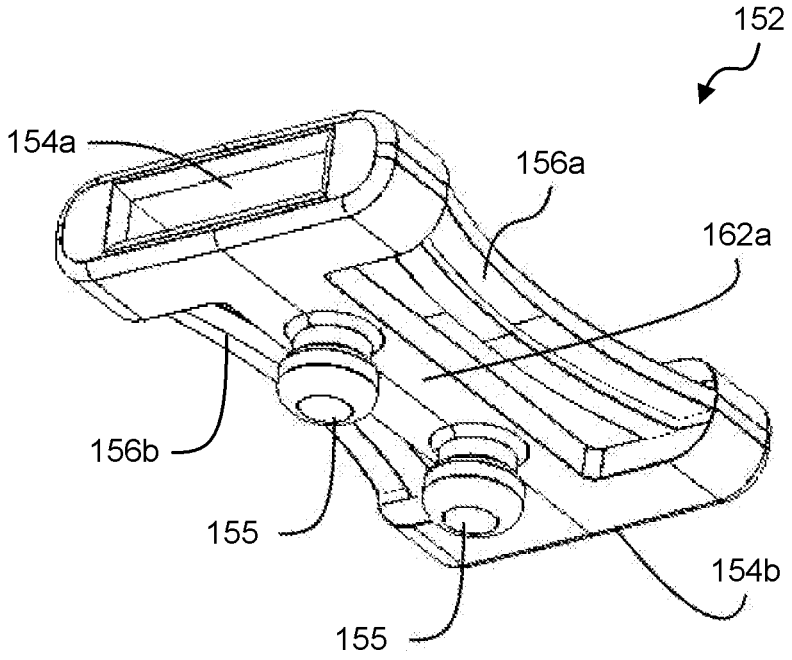
FIG. 6B shows another view of the slide clamp of FIG. 6A.
Figure 7:
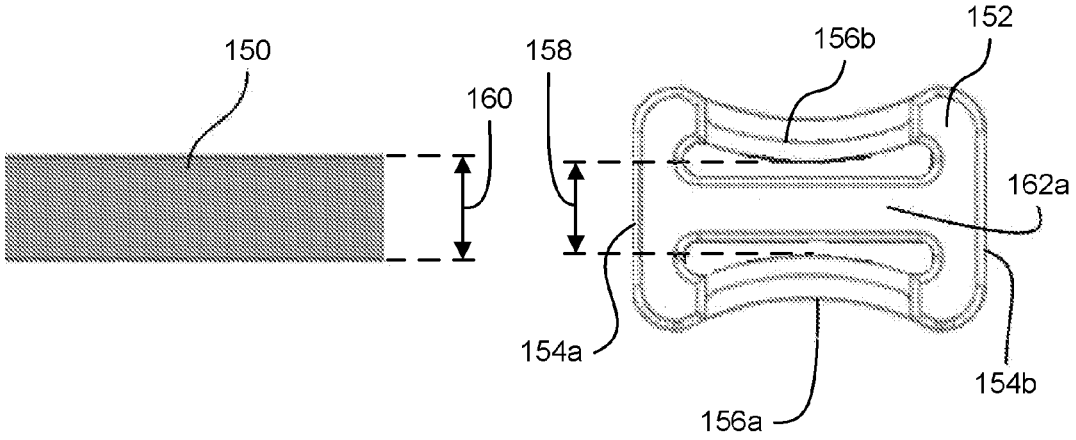
FIG. 7 shows the yoke strap and slide clamp in an unengaged configuration.
Figure 8:
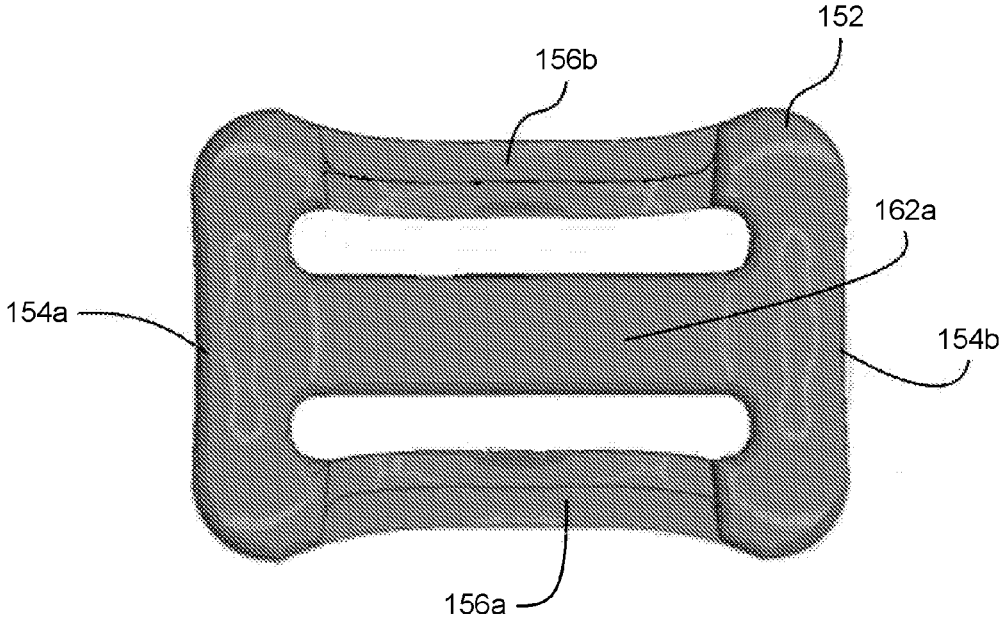
FIG. 8 is a side view of the slide clamp in a flexed configuration.

FIG. 6A is an isometric view of the yoke strap 150 and slide clamp 152. FIG. 6B shows another isometric view of the side clamp 152, but with the yoke strap 150 omitted from view. FIG. 7 is a side view of the yoke strap 150 and the slide clamp 152 in an unengaged configuration. FIG. 8 is a side view of the slide clamp 152 in a flexed position, with the yoke strap 150 hidden from view. The slide clamp 152 can have openings 154*a* and 154*b* shaped to receive the yoke strap 150, and a channel can be formed between the openings 154*a* and 154*b*. The slide clamp 152 can include one or more (e.g., two) coupling mechanisms 155 (e.g., snap fit protrusions) for coupling the slide clamp 152 to the helmet 100, as discussed herein. The slide clamp 152 can include one or more retaining members 156*a* and 156*b* configured to retain the slide claim 152 relative to the yoke strap 150, such as by a friction fitting. For example, the retaining members 156*a* and 156*b* can be leaf springs that are configured to press inwardly against the sides of the yoke strap 150 to create friction that resists movement of the yoke strap 150 relative to the slide clamp 152. FIG. 7 shows the slide clamp 152 with the retaining members 156*a* and 156*b* in a relaxed position. As can be seen in FIG. 7, the distance 158 between the relaxed retaining members 156*a* and 156*b* can be smaller than the width 160 of the yoke strap 150, so that the yoke strap 150 displaces the retaining members 156*a* and 156*b* to a flexed position (e.g., shown in FIG. 8) when the yoke strap 150 is inserted into the slide clamp 152. The force of the retaining members 156*a* and 156*b* pressing against the yoke strap 150 can produce the friction that holds the yoke 110 in place. The frictional force can be adjusted by changing the distance 158 between the relaxed retaining members 156*a* and 156*b*, the materials of the retaining members 156*a* and 156*b*, the surface features (e.g., smooth or bumpy) of the surfaces of the retaining members 156*a* and 156*b* that face the strap 150, and the thickness of the retaining members 156*a* and 156*b*, etc. Alternatively, or additionally, the frictional force can be adjusted by changing features of the strap 150, such as the width 160 of the strap 150, the surface features (e.g., smooth or bumpy) of the strap surfaces that face the retaining members 156*a* and 156*b*, the material of the strap 150, etc.

The position of the yoke 110 can be adjusted (e.g., in the z-direction) by pulling or pushing on the yoke 110 (e.g., in the z-direction) with enough force to overcome the friction of the retaining members 156*a* and 156*b* against the yoke strap 150. For example, in some embodiments the threshold level of force needed to adjust the position of the yoke can be at least about 2 lb. and/or less than or equal to about 15 lb., or at least about 4 lb. and/or less than or equal to about 10 lb., or at least about 6 lb. and/or less than or equal to about 8 lb., although values outside these ranges can be used depending on the configuration of the yoke strap 150 and slide clamp 152. In some embodiments, at least a portion of the yoke base 126 is not covered by the helmet shell 106 so that the at least a portion of the yoke base 126 can be exposed to allow the wearer to grip the yoke base 126 to pull or push the yoke 110 for adjusting the position of the yoke 110. The helmet 100 can allow adjustment of the position of the yoke 110 without removing the helmet 100. The wearer does not need to directly manipulate the slide clamp 152 to cause it to release or to lock. Rather, the user can apply a force to the yoke 100 (e.g., by pressing or pulling on the yoke 110 and/or the shell 106) that is above the threshold force to overcome the friction and unlock the slide clamp 152. The user can reduce the force on the yoke 100 to cause the slide clamp 152 to lock and stop sliding of the yoke strap 150. In some embodiments, the slide clamp 152 can allow the yoke strap 150 to slide smoothly through the slide clamp 152 once the frictional force of the retaining members 156*a* and 156*b* is overcome so that there is not incremental clicking, backlash, or jumpiness, as the yoke strip 150 advances. The retaining members 156*a* and 156*b* can apply a constant force that resists movement of the yoke strap 150 as the yoke strap 150 slides through the strap slide clamp 152 so that the motion is damped, feels precise to the wearer, and allows the wearer to precisely position the yoke 110. In some embodiments, the strap 150 can be infinitely positionable with respect to the clamp 152 across the available range of motion. In some embodiments, the movement of the strap 150 relative to the yoke 110 is incremental with distinct, manufactured steps with an audible or tactile notification (e.g., a click) associated with the movement between steps or engagement with the steps. For example, the strap 150 can be grooves or recesses configured to receive corresponding features (e.g., the retaining members 156*a* and 156*b* or detents (not shown)) of the slide clamp 152 to define the incremental steps.

In some embodiments, extensions 162*a* and 162*b* can extend between the sides of the slide clamp 152, for example, so that the extension 162*a* and 162*b* are positioned along the flat sides of the yoke strap 150. In some embodiments, the extensions 162*a* and 162*b* can be arced inward similar to the leaf springs 156*a* and 156*b* in order to provide additional retaining members. Thus, in some embodiments four retaining members or leaf springs can be used. In some embodiments, the extensions 162*a* and 162*b* are not arced inward. In some embodiments, the extensions 162*a* and 162*b* can shield the yoke strap 150, for example to prevent the yoke strap 150 from rubbing against the wearer's head 104, or against the inside of the helmet 100, as the yoke strap 150 slides through the slide clamp 152.

Figure 9A:
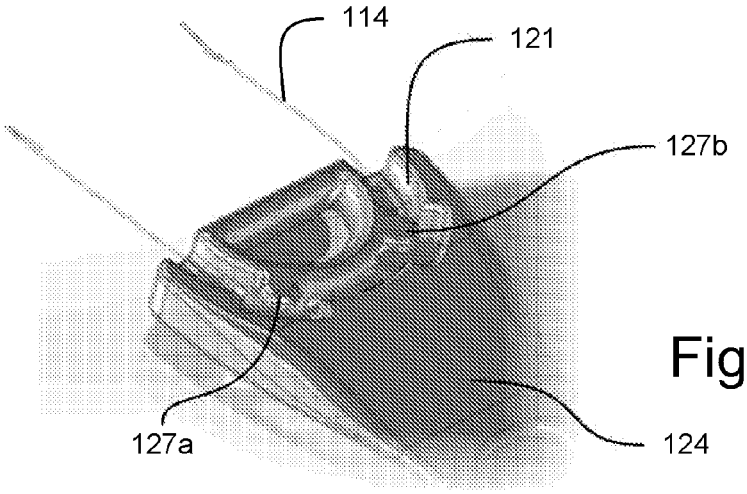
FIG. 9A shows an example embodiment of a lace guide.

Many variations can be made the embodiments disclosed above. For example, FIG. 9A shows an isometric view of a lace guide 124, which can be used, for example, with a support member, such as a forward support member like the forehead strap 108. The lace guide 124 can have a lace channel 121, which can be generally U-shaped allowing the lace 114 to enter one side of the lace channel 121 in one direction and exit the lace channel 121 in substantially the opposite direction. The channel 121 can be an open channel, as shown, and one or more tabs 127*a* and 127*b* can retain the lace 114 in the channel 121. Such open guides can facilitate replacement of one or more components of the system 102 (e.g., the lace 114, the tightening mechanism 116, etc.). In some embodiments, the lace channel 121 can be a closed lace channel. As discussed above, the lace path can provide a lace loop with the lace 114 extending twice across the gap between the yoke 110 and the forehead strap 108. Thus, the lace path can create a 2:1 ratio between the amount of lace 114 drawn into the tightening mechanism 116 and the amount of closure applied to the tightening system 102.

Figure 9B:
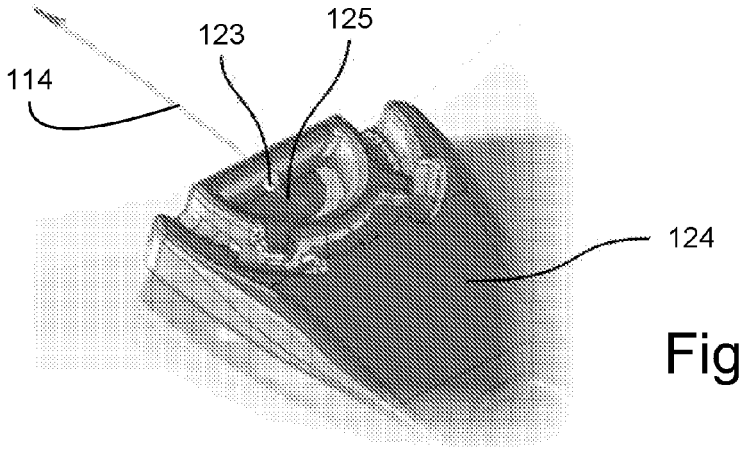
FIG. 9B shows another example embodiment of a lace guide.

With reference now to FIG. 9B, in some embodiments, the lace 114 can extend a single time (on one side) between the yoke 110 and the forehead strap 108, thereby creating a 1:1 ration between the amount of lace 114 drawn into the tightening mechanism 116 and the amount of closure applied to the tightening system 102. The lace end 125 can couple to the forehead strap 108 so that the lace 114 terminates at the forehead strap 108. For example, the lace end 125 can pass through a hole 123, and a knot or other lace retaining structure can prevent the lace 114 from pulling back through the hole 123. In some embodiments, the lace channel 121 can be omitted. The 1:1 configuration, e.g., as shown in FIG. 9B, can allow the tightening system 102 to be adjusted (e.g., tightened or loosened) more quickly than the 2:1 configuration of FIG. 9A. The 2:1 configuration, e.g., as shown in FIG. 9A, can allow the tightening system 102 to be more finely adjusted and tuned to fit the wearer than the 1:1 configuration of FIG. 9B.

Figure 9C:
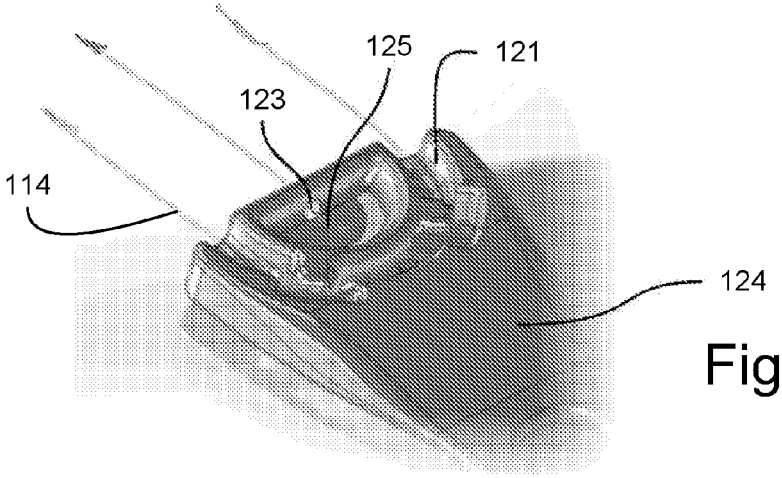
FIG. 9C shows another example embodiment of a lace guide.

With reference to FIG. 9C, in some embodiments, other lace paths can be used to provide, for example, a 3:1 ratio (or various other ratios: 4:1, etc.) between the amount of lace 114 drawn into the tightening mechanism 116 and the amount of closure applied to the tightening system 102. For example, the lace 114 can engage the lace channel 121, and the lace 114 can be turned back to the forehead strap 108 (e.g., by a lace guide (not shown) on the yoke 110 or on the intermediate tender 112*a* or 112*b*. The lace end 125 can terminate at the forehead strap 108, e.g., as discussed in connection with FIG. 9B. Thus, the lace 114 can extend between the yoke 110 and the forehead strap 108 three times, on one side. The 3:1 ratio configuration of FIG. 9C, can provide increased resolution as compared to the configuration of FIG. 9A, allowing more fine adjustment of the tightening system 102. In some embodiments, the intermediate tenders 112*a* and 112*b* can include three lace guides to accommodate the lace path shown in FIG. 9C.

Figure 10:
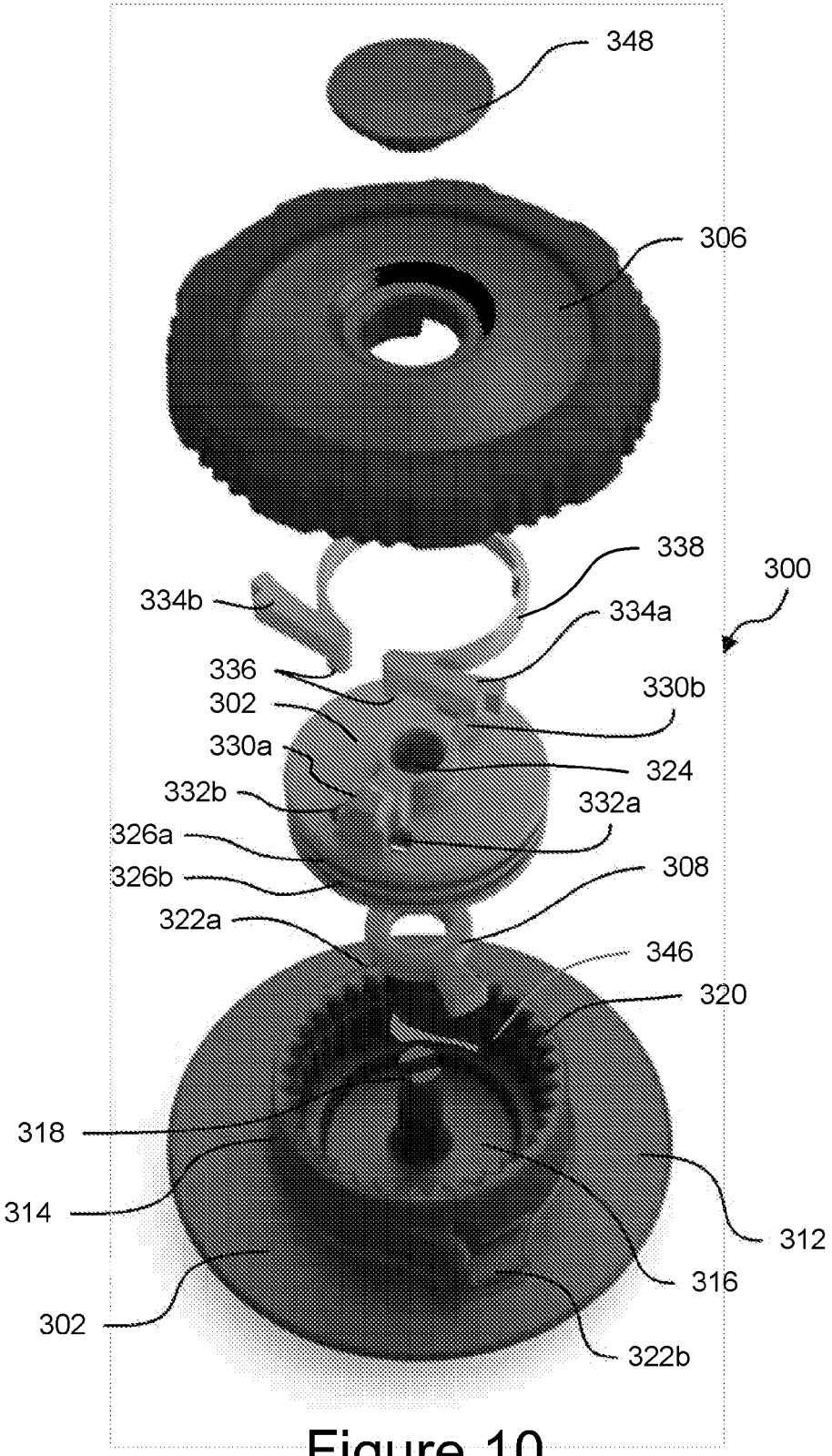
FIG. 10 shows an exploded view of an example implementation of a tightening mechanism.
Figure 11:
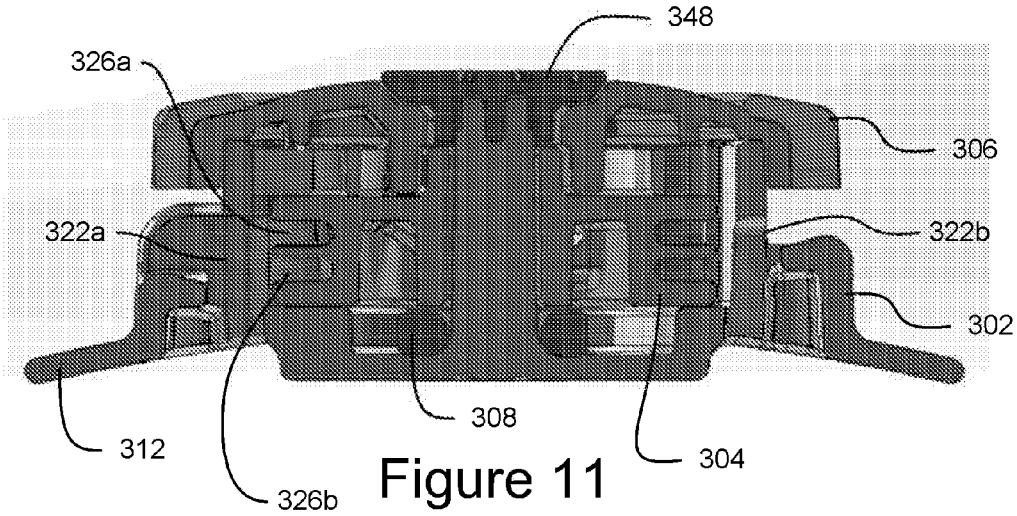
FIG. 11 is a cross-sectional view of the tightening mechanism of FIG. 10.

FIG. 10 shows an exploded view of a tightening mechanism 300, which can be used as the tightening mechanism 116 for the helmet 100, although other tightening mechanisms can also be used in the helmet 100. FIG. 11 is a cross-sectional view of the tightening mechanism 300. The tightening mechanism 300 can also be used with other wearable articles (e.g., shoes, boots, other footwear, bindings, braces, belts, hats, headwear, gloves, backpacks, etc.), or with other devices that have a variable distance between multiple objects or parts that can be adjusted using a tightening system. The tightening mechanism 300 can include a housing 302, a spool 304, and a knob 306. In some embodiments, the tightening mechanism 300 can include a rotation limiter 308. The tightening mechanism 300 can include a pawl ring 310, as discussed herein. The housing 302 can include a flange 312, which can facilitate securing the tightening mechanism 300 to an article (e.g., to the helmet 100), such as be stitching the flange 312 to a material of the article or by engagement features (e.g., that provide a snap-fit, friction-fit, etc.). A side wall 314 can extend upward from the flange 312 and can surround a recess 316, which can have a post 318 extending upward therein. The tightening mechanism 300 can have teeth 320, which can be configured to engage the pawl ring 310. The teeth 320 can be formed on the inner surface of the side wall 314 and can extend radially inwardly. Lace holes 322*a* and 322*b* can allow a lace 328 to enter the recess 316 (e.g., through the side walls 314).

Figure 12:
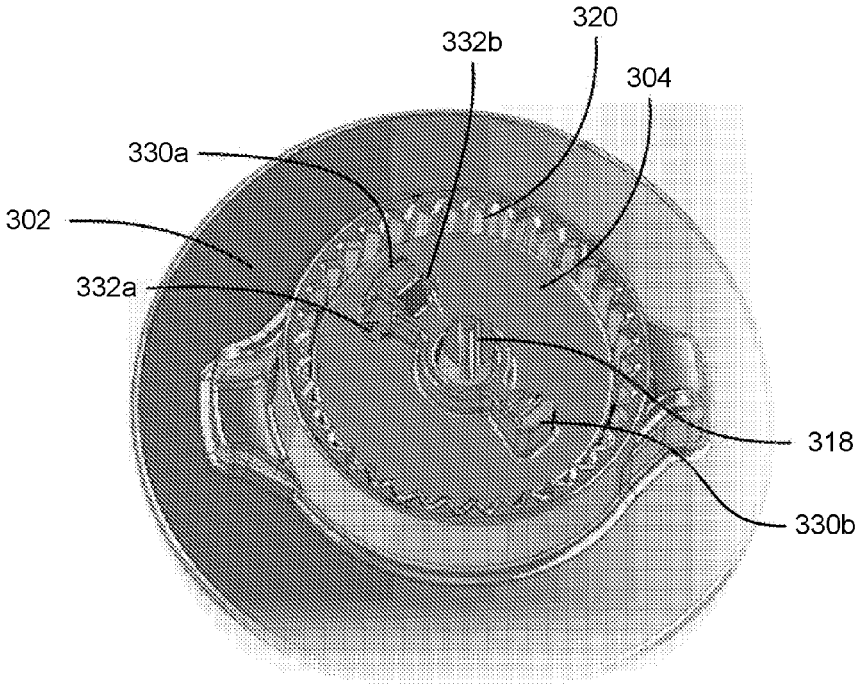
FIG. 12 shows a spool disposed in a cavity of a housing of the tightening mechanism of FIG. 10.
Figure 13:
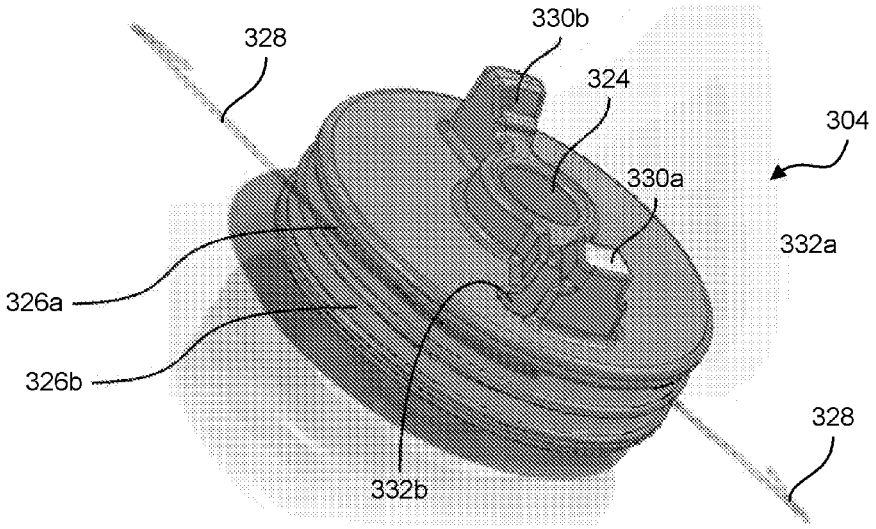
FIG. 13 shows an example implementation of a spool having a lace coupled thereto.
Figure 14:
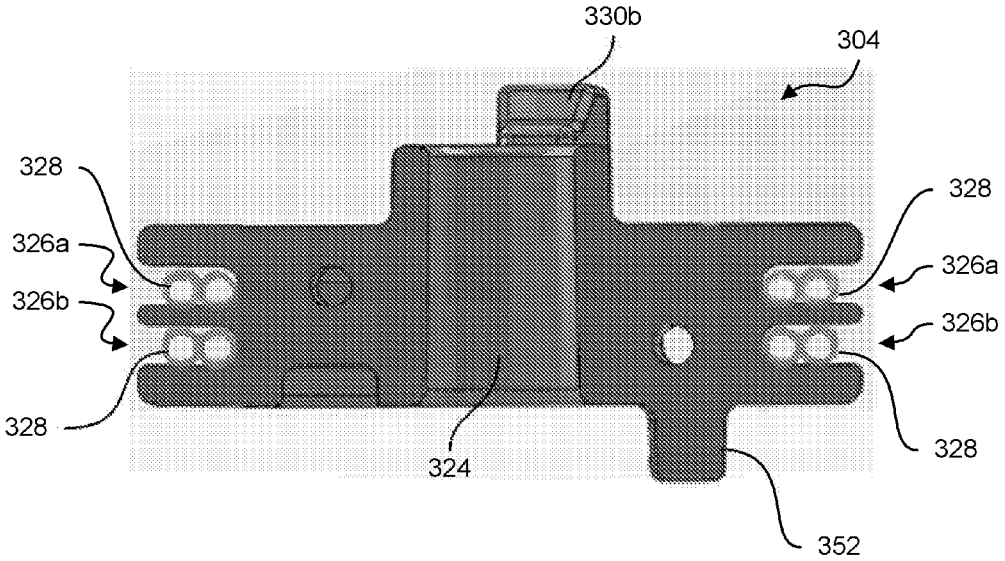
FIG. 14 is a cross-sectional view of the spool with a lace gathered therein.

The spool 304 can be configured to fit into the recess 316 and can be rotatable relative to the housing 302 (e.g., rotatable about an axis, which can extend through the center of the post 318). For example, the post 318 can extend through a hole 324 in the spool 304 (as shown in FIG. 12). The spool 304 can have one or more lace channels 326*a* and 326*b*. As shown in FIG. 13, in some embodiments, the spool 304 has two lace channels 326*a* and 326*b*, although the spool 304 can have one lace channel, or three, or four, or more lace channels as appropriate for the tightening system. The spool 304 can be configured to receive one or more lace ends to secure the lace 328 to the spool 304. Rotation of the spool 304 in a tightening direction can gather lace 328 into the lace channels 326*a* and 326*b* to tighten the tightening system. Rotation of the spool 304 in the loosening direction can release lace 328 from the lace channels 326*a* and 326*b* to loosen the tightening system. In some embodiments, the lace channels 326*a* and 326*b* can have a width that substantially equals the diameter of the lace 328 so that the lace 328 stacks over itself once the spool 304 is tightened past one revolution (as shown in FIG. 14). The lace channels 326*a* and 326*b* can prevent the lace 328 from wrapping next to a previously wrapped layer of the lace 328, and can prevent the lace 328 from wedging or jamming (e.g., with previously gather lace 328). The spool 304 can have one or more (e.g., two) boss structures 330*a* and 330*b* extending upward from the top surface thereof. The spool 304 can have one or more (e.g., two) holes 322*a* and 322*b* formed in the top thereof. The tightening mechanism 300 can include features to facilitate ejection of the lace when the lace is loosened. Various features that can be included in the tightening mechanism 300 (e.g., to facilitate ejection of the lace during loosening) are disclosed in U.S. patent application Ser. No. 13/273,060, filed Oct. 13, 2011, and titled REEL-BASED LACING SYSTEM, the entirety of which is incorporated by reference and made a part of this specification.

Figure 15:
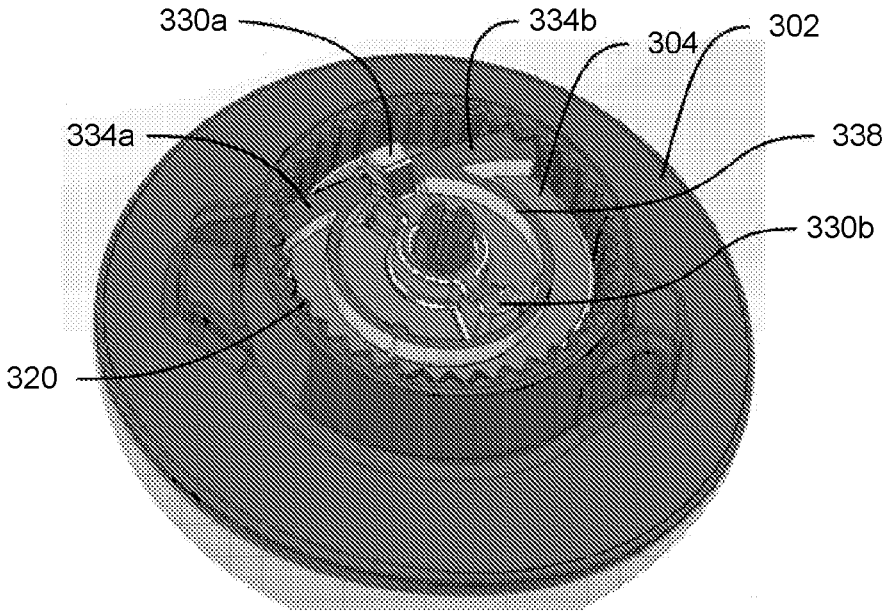
FIG. 15 is an isometric view of a pawl ring coupled to a housing and spool in a tightening mechanism.
Figure 16:
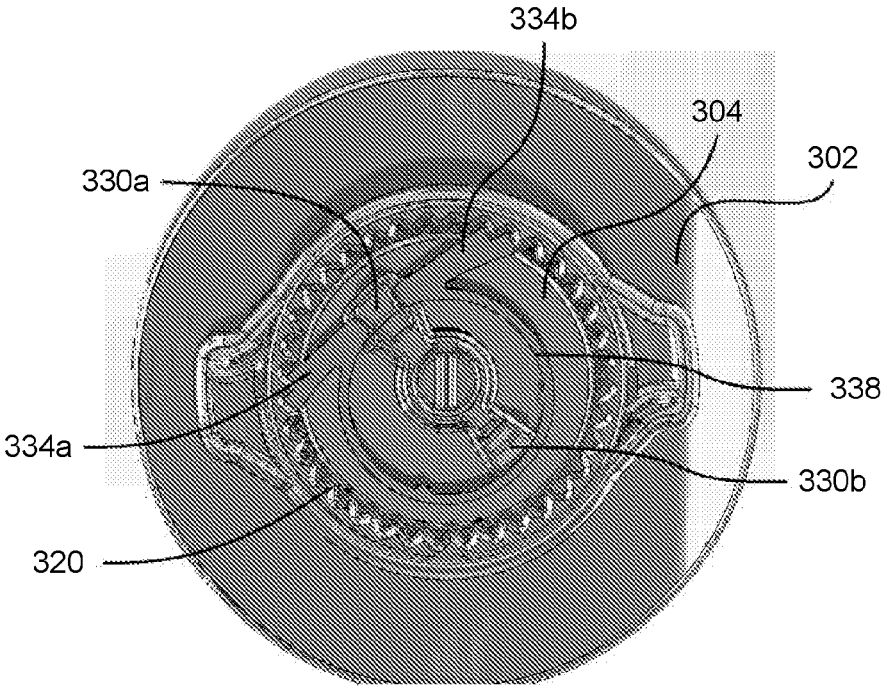
FIG. 16 is a top view of the pawl ring coupled to the housing and spool in the tightening mechanism.
Figure 17:
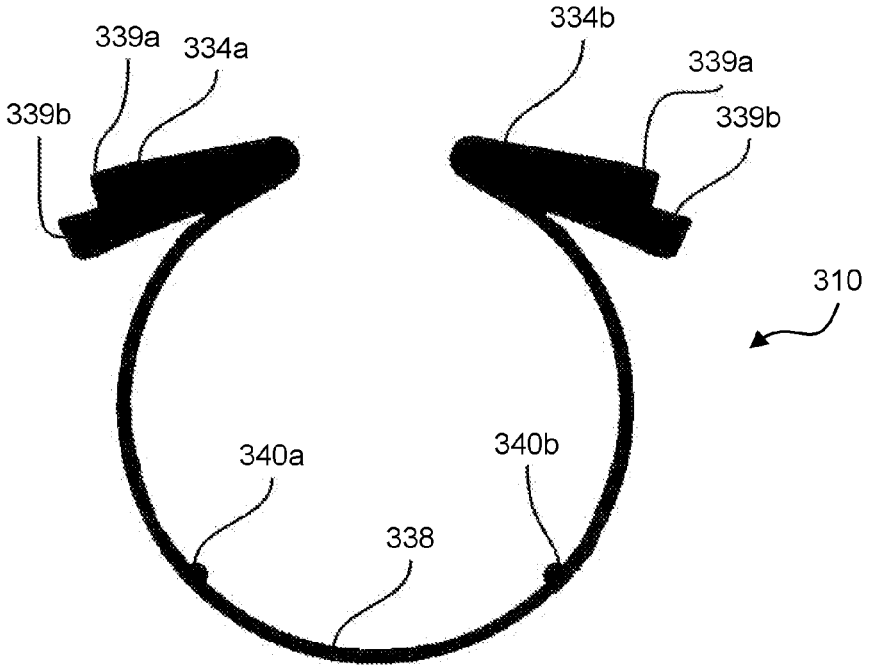
FIG. 17 shows an example embodiment of a pawl ring in a relaxed or low tension state.
Figure 18:
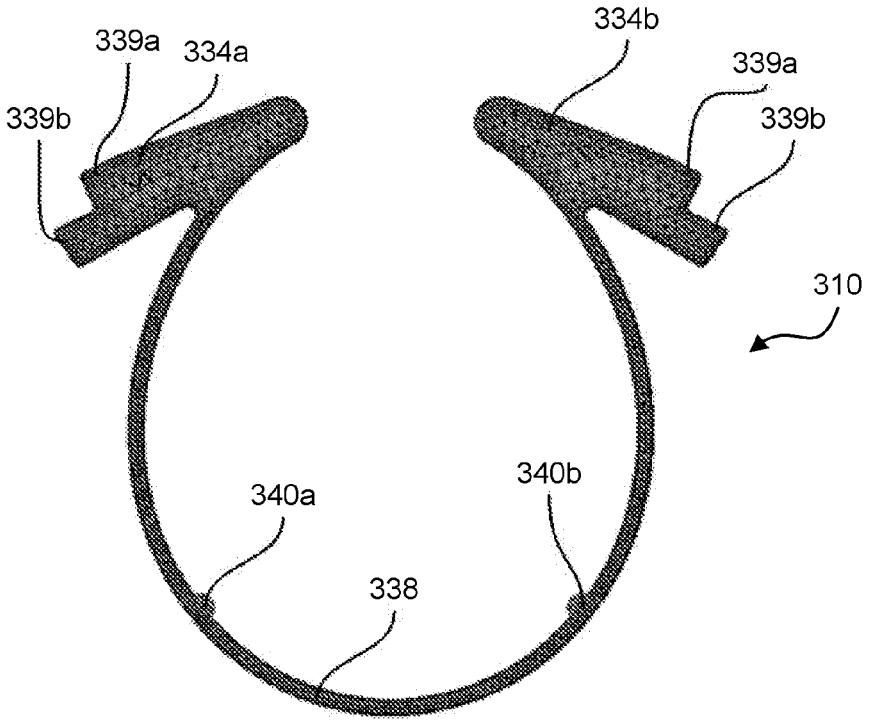
FIG. 18 shows the pawl ring of FIG. 17 in a flexed state.

FIG. 15 shows an isometric view of the pawl ring 310 engaged with the housing 302 and the spool 304. FIG. 16 is a top view of the pawl ring 310 engaged with the housing 302 and the spool 304. The pawl ring 310 can include a first pawl 334*a* and a second pawl 334*b*. The pawls 334*a* and 334*b* can include a pin 336 extending downward therefrom. The pins 336 can be configured to insert into the holes 332*a* and 332*b* in the top of the spool 304 thereby coupling the pawls 334*a* and 334*b* to the spool 304. The pawls 334*a* and 334*b* and pivot about the pins 336 and holes 332*a* and 332*b*. The pawls 334*a* and 334*b* can have one or more teeth 339*a* and 339*b* at the end opposite the pin 336, and the teeth 339*a* and 339*b* can be configured to engage (e.g., radially) with the teeth 320. In some embodiments the pawls 334*a* and 334*b* can have a single tooth, or two, three, four, or more teeth can be used. In some cases, multiple teeth can be used to distribute the forces, which can improve the strength, reliability, durability, and longevity of the tightening mechanism 300. A spring 338 can be used to bias the pawls 334*a* and 334*b* towards the teeth 320. In some embodiments the spring 338 can be a ring or arcuate segment that extends between the pawls 334 and 334*b*. For example, the ends of the spring 338 can connect to the pawls 334*a* and 334*b* at or near the pins 336 or pivoting locations, although other configurations are possible. The spring 338 can be integrally formed with the pawls 334*a* and 334*b*, or the spring 338 and the pawls 334*a* and 334*b* can be separately formed. Pivoting the pawls 334*a* and 334*b* can cause the spring 338 to flex, so that the spring 338 creates a force that resists the pivoting of the pawls 334*a* and 334*b* and biases the pawls 334*a* and 334*b* radially outwardly towards the teeth 320. For example, the spring 338 can be preloaded to a first flexed position when the pawls 334*a* and 334*b* are coupled to the housing 302 and spool 304, and the preload can apply a force that causes the pawls 334*a* and 334*b* to press radially outwardly against the teeth 320. FIG. 17 shows the pawl ring 310 with the spring 338 in a relaxed or lower tension position, and FIG. 18 shows the pawl ring 310 with the spring 338 in a higher tension position. The spring 338 can include bumps 340*a* and 340*b* thereon. In some embodiments, the pawls 334*a* and 334*b* can extend generally away from each other, and the pawl ring can have a generally omega-shape.

Figure 19:
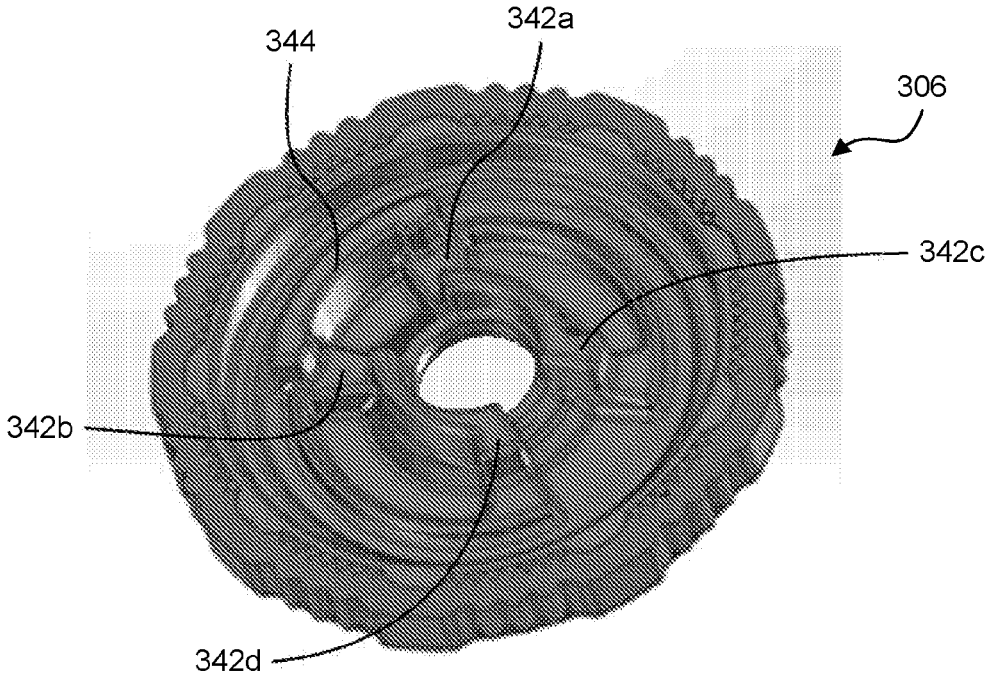
FIG. 19 shows the underside of an example embodiment of a knob for use with a tightening mechanism.

As can be seen in FIG. 15, the boss structures 330*a* and 330*b* of the spool 304 can extend axially upward past the pawls ring 310. The knob 306 can engage the boss structures 330*a* and 330*b* so that rotation of the knob 306 applies a rotational force to the spool 304. FIG. 19 shows the underside of the knob 306. The knob 306 can include drivers 342*a-d* which can be configured to engage the boss structures 330*a* and 330*b*. For example, the drivers 342*a* and 342*b* can be positioned on either side of the boss structure 330*a*, so that rotation of the knob in the clockwise direction causes the driver 342*a* to press against the boss structure 330*a* and so that rotation of the knob in the counterclockwise direction causes the driver 342*b* to press against the boss structure 330*a*. For example, the drivers 342*c* and 342*d* can be positioned on either side of the boss structure 330*b*, so that rotation of the knob in the clockwise direction causes the driver 342*d* to press against the boss structure 330*b* and so that rotation of the knob in the counterclockwise direction causes the driver 342*c* to press against the boss structure 330*b*. In some embodiments, the engagement features between the knob 306 and the spool 304 can be reversed. For example, a driver on the knob 306 can be positioned between two boss structures on the spool 204 (instead of one spool boss structure being positioned between two drivers).

Figure 20:
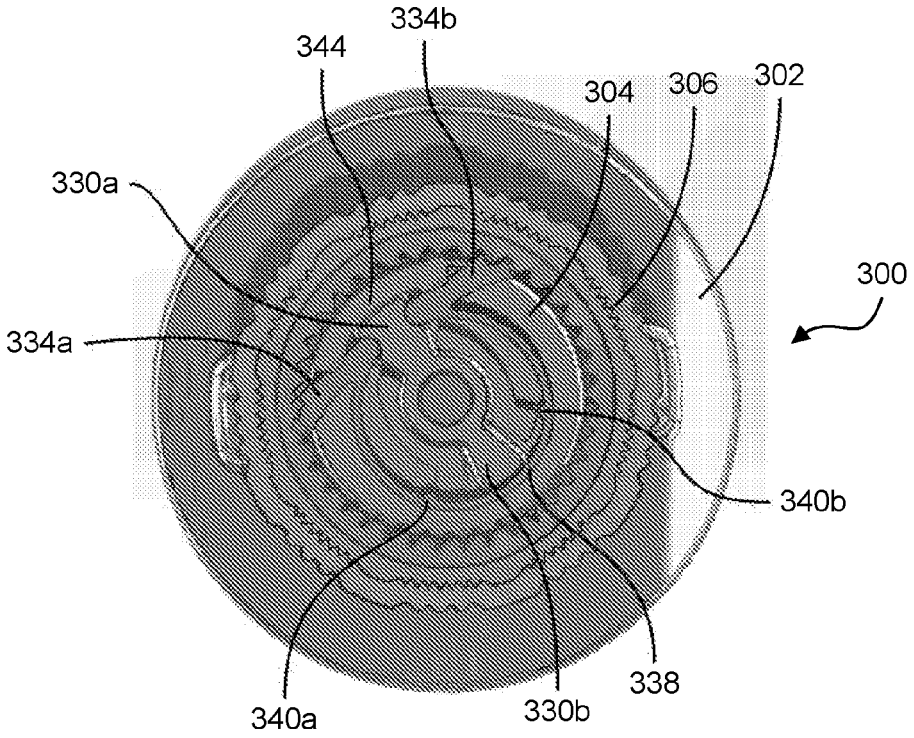
FIG. 20 is a cross-sectional view of tightening mechanism taken through a plane that contains the pawl ring.
Figure 21:
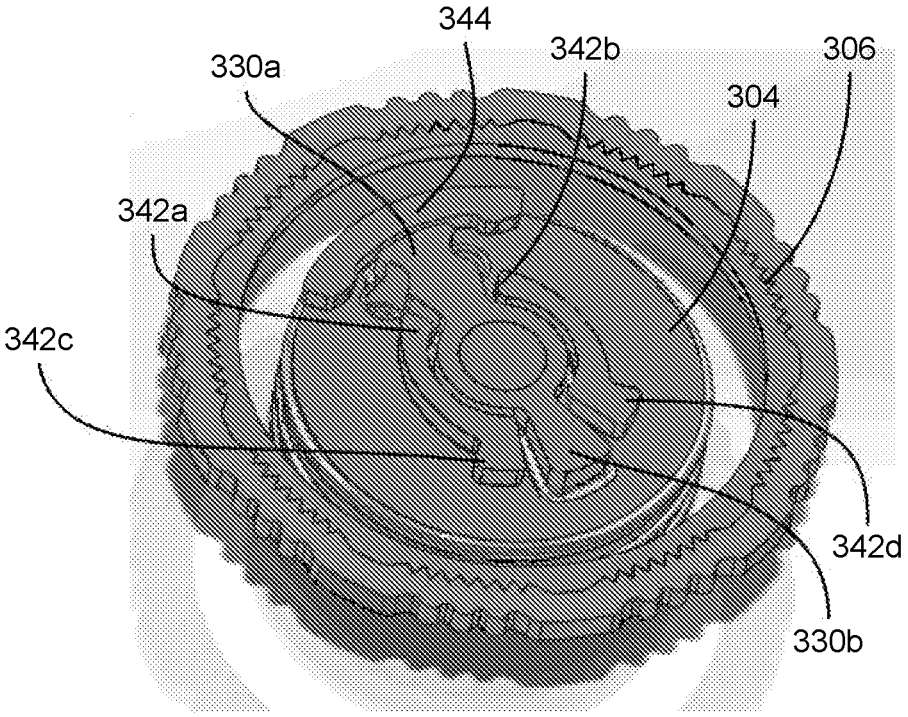
FIG. 21 is a cross-sectional view of the knob and spool.
Figure 22:
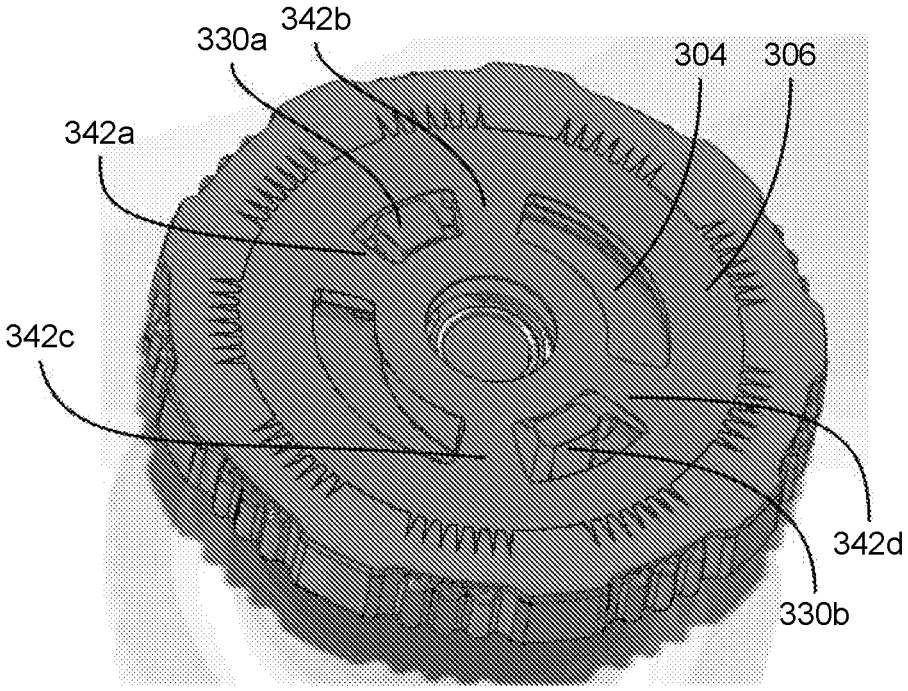
FIG. 22 is another cross-sectional view of the knob and spool.

FIG. 20 is a cross-sectional view of the tightening mechanism 300. As can be seen in FIG. 20, the pawls 334*a* and 334*b* can prevent the spool 304 from rotating in either direction when the pawls 334*a* and 334*b* are engaged with the teeth 320. The knob 306 can include a sweeper 344 that is configured to displace the pawls 334*a* and 334*b* to allow the spool 304 to rotate. FIGS. 21 and 22 are cross sectional views of the knob 306 and spool 304 of the tightening mechanism 300 taken in planes where the drivers 342*a-d* engage the boss structures 330*a* and 330*b*. As can be seen in FIGS. 21 and 22, the boss structures 330*a* and 330*b* can be smaller than the spaces between the drivers 342*a* and 342*b* and 342*c* and 342*d* respectively. Thus, the knob 306 can be free to rotate across a limited range independent of the spool 304. The limited range of motion can be at least about 5°, at least about 10°, at least about 15°, less than or equal to about 20°, less than or equal to about 15°, and/or less than or equal to about 10°, although values outside these ranges can also be used. The knob 306 can rotate across this limited range without rotating the spool 304 because rotation within the limited range can cause the drivers 342*a-d* to shift back and forth without moving the boss structures 330*a* and 330*b*. The limited range of free rotation provided by the boss structures 330*a* and 330*b* and the drivers 342*a-d* can be sufficient to allow the sweeper 344 to rotate far enough to displace the pawls 334*a* and 334*b* away from the teeth 320 to allow the spool 304 to rotate.

Figure 23:
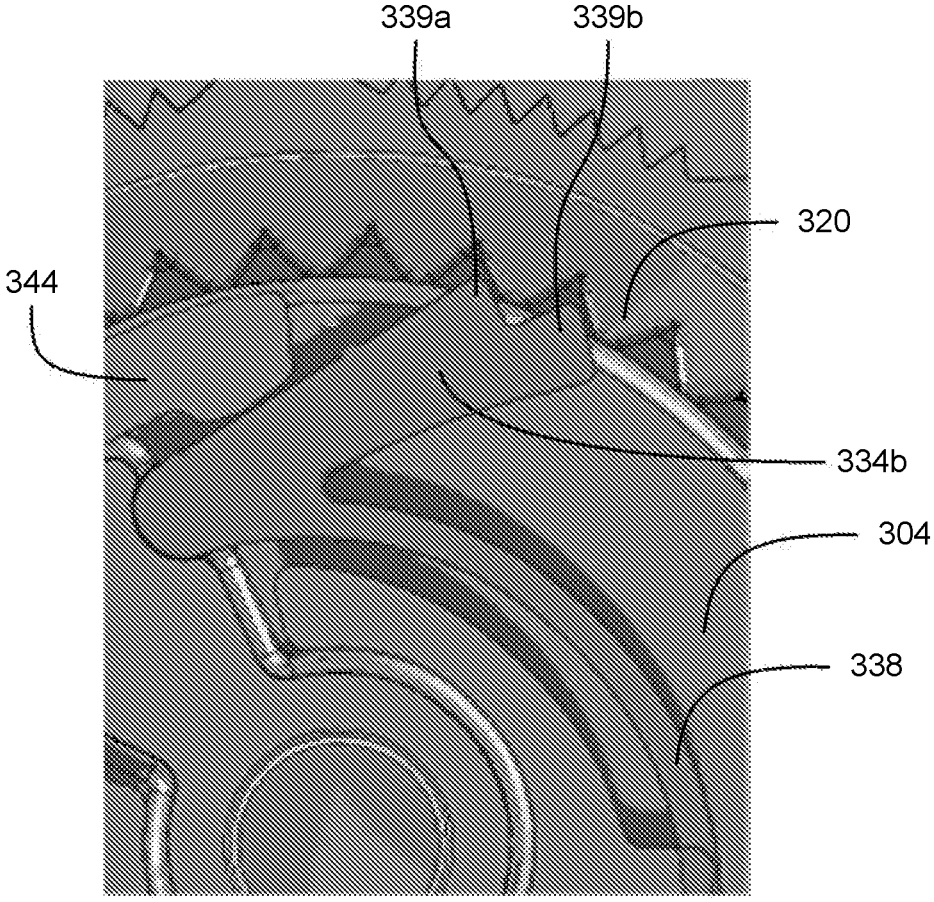
FIG. 23 is a cross-sectional view showing the a pawl partially displaced away from the corresponding teeth.
Figure 24:
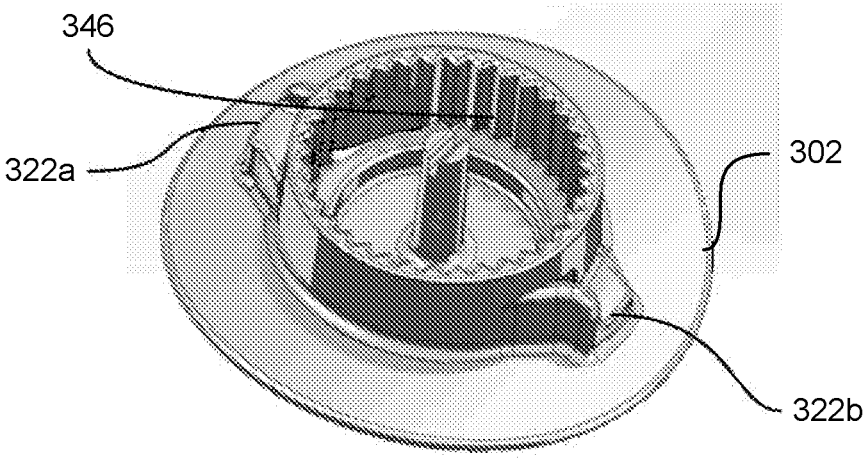
FIG. 24 is an isometric view of an example embodiment of a housing for a tightening mechanism.

For example, as shown in FIG. 23, rotating the knob 306 in the clockwise direction causes the sweeper 344 to press against the right pawl 334*b* displacing the pawl 334*b* radially inward away from the teeth 320, without rotating the spool 304. As the pawl 334*b* is displaced sufficiently to disengage from the teeth 320 (to allow rotation of the spool 304) the drivers 342*a* and 342*d* engage the boss structures 330*a* and 330*b* on the spool 304 so that further rotation of the knob 306 (past the limited range of free motion discussed above) causes the spool 304 to rotate in the clockwise direction along with the knob 306. The sweeper 344 can hold the right pawl 334*b* off of the teeth 320 as the knob 306 and spool 304 are rotated in the clockwise direction so that the right pawl 334*b* does not impede rotation of the spool 304 in the clockwise direction.

As the spool 304 rotates in the clockwise direction, the left pawl 334*a* is dragged across the teeth 320 and makes a clicking sound. The left pawl 320 remains biased against the teeth 320 as the spool rotates in the clockwise direction because the sweeper 344 is not displacing the left pawl 334*a*. In some embodiments, the displacement of the right pawl 334*b* by the sweeper 344 causes the spring 338 to deform and flex, which can import additional biasing force that presses the left pawl 334*a* even harder against the teeth 320, thereby increasing the intensity of the clicking sound and sensation as the user rotates the knob 306 in the clockwise direction. The distinct clicking sound and sensation that occurs as the left pawl 334*a* ratchets across the teeth 320 can serve as an indication to the user that the tightening mechanism 300 is properly tightening (or loosening) the lace 328. Because the pawls 334*a* and 334*b* are coupled such that displacement of one pawl 334*a* cause the other pawl 334*b* to press more strongly against the teeth 320, the intensity of the clicking sound produced by the trailing pawl 334*b* can be increased without increasing the amount of force needed to display the leading pawl 334*a*, which can result in less wear on the pawls 334*a* and 334*b*. The intensity of the clicking sound can depend on the tension of the spring 338, and can be generally independent of the tension force applied to the lace 328. For example, as the knob 306 is rotated in the tightening direction (e.g., clockwise), the leading pawl (e.g., the right pawl 334*b* can be held off of the teeth 320 by the sweeper 344 so that the leading pawl does not ratchet across the teeth 320. The trailing pawl (e.g., the left pawl 334*a*) can ratchet across the teeth 320 to generate the clicking sound. The tension in the spring 338, which controls the strength with which the trailing pawl 334*a* snaps against the teeth 320, can be substantially independent of tension on the lace 328 so that the tightening mechanism produces substantially the same clicking sound during tightening against lace tension regardless of the strength of the lace tension. In some embodiments, when loosening under lace tension, the leading pawl (e.g., the left pawl 334*a* when loosening in the counterclockwise direction) can reengage the teeth 320 as the spool 304 is incrementally loosened (as discussed herein), and in some cases, the reengaging of the leading pawl during loosening under load can contribute to the clicking sound. Because the lace tension affects the force with which the leading pawl reengages the teeth 320 when loosening under lace tension, the clicking sound can depend on the amount of lace tension when loosening under load, in some embodiments.

In some embodiments, the pawls 334*a* and 334*b* can be configured to pivot to displace away from the teeth 320, substantially without deformation or flexing of the pawls

334*a* and 334*b*. Because the spring 338 is configured to flex during displacement of the pawls 334*a* and 334*b* instead of the pawls 334*a* and 334*b* flexing themselves, the force required to displace the pawls 334*a* and 334*b* (which can be dictated by the features of the spring 338, such as thickness, material type, and shape of the spring 338) can be substantially independent of the load bearing strength of the pawls 334*a* and 334*b* (which can be dictated by the features of the pawls 334*a* and 334*b*, such as the thickness of the pawl arm, the material type, and the shape of the pawls 334*a* and 334*b*). For example, the pawls 334*a* and 334*b* can be made thick so that they can withstand a large force (e.g., applied by tension on the lace 328), while at the same time the spring 338 can be made relatively thin to allow the pawls to be displaced by a force that is lower than the amount of force that the pawls 334*a* and 334*b* are able to withstand.

Although not shown in the figures, rotation of the knob 306 in the counterclockwise direction can function in a similar manner. For example, in some embodiments, the lace 328 can be tightened by rotating the spool 304 in either the clockwise or counterclockwise directions (after which loosening of the lace 328 would be performed by rotating the spool 304 back in the opposite direction). In some embodiments, the tightening mechanism 300 can have a rotation limiter 308 or other features that restrict tightening rotation to a single direction, as described herein. Thus, in some embodiments, tightening is performed by rotating the spool 304 in the clockwise direction, for example, and loosening is performed by rotating the spool 304 in the counterclockwise direction (although a configuration with tightening in the counterclockwise direction is possible).

Loosening of the lace 328 will be described in connection with rotation of the spool 304 in the counterclockwise direction. In some embodiments, the tightening mechanism 300 can provide an incremental release that locks incrementally at each tooth 320 when the spool 304 is loosened under tension (e.g., applied by the lace 328). For example, tension on the lace 328 can tend to pull the spool 304 in the loosening direction (e.g., counterclockwise in some embodiments). The left pawl 334*a* can engage the teeth 320 to prevent the spool 304 from rotating in the loosening direction. By rotating the knob 306 in the loosening direction (e.g., counterclockwise in some embodiments), the sweeper 344 can displace the left pawl 334*a* away from the teeth 320 until the pawl 334*a* disengages the teeth 320, allowing the spool 304 to rotate in the loosening direction. Thus, in some embodiments, a single sweeper 344 can be used to displace one pawl during tightening (e.g., the right pawl 334*b* when tightening is performed by rotation in the clockwise direction) and to displace the other pawl during loosening (e.g., the left pawl 334*a* when loosening is performed by rotation in the counterclockwise direction). When loosening under load, the tension on the lace 328 can pull the spool 304 in the loosening direction once the left pawl 334*a* clears the teeth 320. In some embodiments, the lace tension can pull the spool 304 in the loosening direction faster than the user rotates the knob 306 in the loosening direction, thereby causing the left pawl 334*a* to move away from the sweeper 344 and causing the left pawl 334*a* to reengage with the teeth 320 (e.g., at the teeth that are adjacent to the previously engaged teeth). Thus, by rotating the knob 306 in the loosening direction, the user can cause the spool 304 to advance in the loosening direction by one tooth 320 at a time, with the pawl 334*a* reengaging the teeth 320 after each advancement under lace tension. Loosening the spool 304 will cause a clicking sound similar to when the spool 304 is tightened because the right pawl 334*b* will ratchet along the teeth 320 as the spool 304 is loosened (e.g., in the counterclockwise direction). In some cases loosening the spool 304 under lace tension will cause the leading pawl (e.g., the left pawl 334*a* when loosening in the counterclockwise direction) to also produce a clicking sound when the left pawl 334*a* reengaged the teeth 320 during the incremental release.

In some situations, the spool 304 can be loosened when there is not lace tension that biases the spool 304 in the loosening direction, which can sometimes cause the lace 328 to tend to back up inside the tightening mechanism instead of ejecting out of the lace holes 322*a* and 322*b*. As discussed above, winding the lace 328 in lace channels 326*a* and 326*b* having a width substantially equal to the diameter of the lace 328 can prevent the lace 328 from pinching or jamming against previously wound lace 328, which can thereby facilitate ejection of the lace 328. In some embodiments, a lace 328 can be used that is somewhat stiff thereby providing sufficient column strength to allow the lace 328 to be pushed out of the lace holes 322*a* and 322*b*. In some embodiments, a monofilament of nylon can be used to form the lace 328 or a twisted steel wire can be used to form the lace 328. In some cases, when the lace 328 is loosened and there is insufficient lace tension to pull the lace 328 out of the tightening mechanism 300, the lace 328 can be pushed radially outwardly against the inner surface of the side wall 314 of the housing 302. If the contact force between the lace 328 and the inner surface of the side wall 314 is sufficient, the lace 328 can buckle and fold back on itself as the spool 304 loosens, which can cause the lace 328 to bend or kink, can cause the lace 328 to pile up in the tightening mechanism 300, and can jam the tightening mechanism 300. To reduce friction between the inner surface of the side wall 314 and the lace 328, the inner surface 346 of the side walls 314 in the region that contacts the loosening lace 328 can have an non-smooth surface configured to reduce the surface area of contact between the lace 328 and the inner surface 346. For example, in some embodiments the teeth 320 structure can extend down inner surface 346 of the side wall 314 past the area in which the pawls 334*a* and 334*b* engage the teeth 320 and into the area where the lace 328 contacts the inner surface 346 when being ejected during loosening. In some embodiments, scalloped shaped recesses, or recesses having other shapes, can be formed in the inner surface 346 instead of extending the teeth 320 downward. Various other configurations are possible. Thus, when loosening with insufficient lace tension, the lace 328 can bear against the ends of the teeth or scallops or other recesses in order to reduce the amount of surface area contact between the lace 328 and the inner surface 346.

Figure 25:
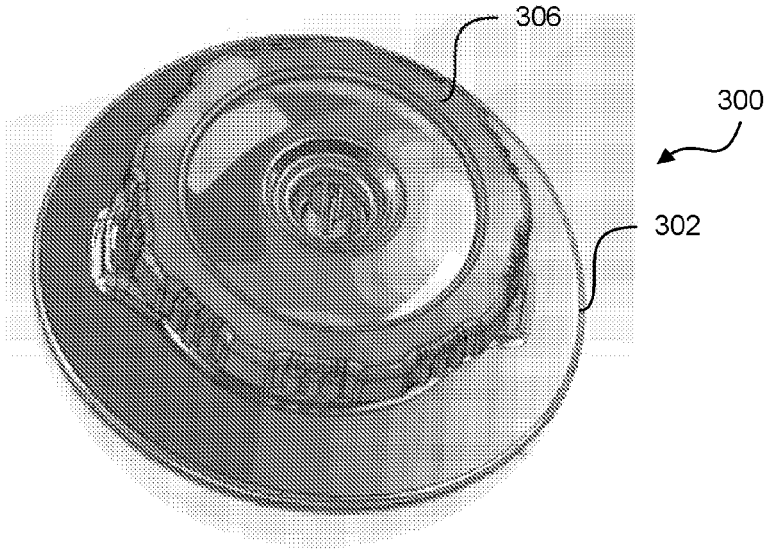
FIG. 25 is an isometric view of a tightening mechanism with a knob positioned on the housing.
Figure 26:
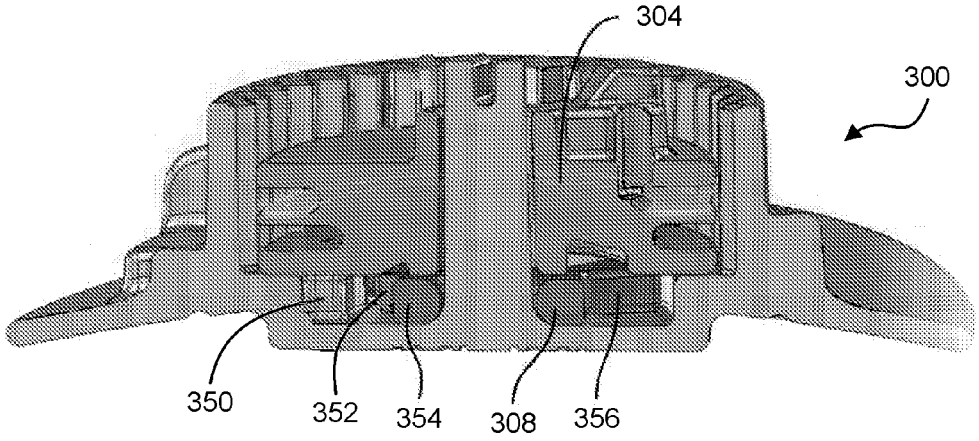
FIG. 26 is a cross-sectional view of a tightening mechanism having a rotation limiter.

FIG. 25 is an isometric view of the tightening mechanism 300 with the knob 306 placed onto the housing 302. As can be seen in FIG. 10, a fastener 348 (e.g., a screw) can be used to secure the knob 306 to the housing 302. Many variations to the tightening mechanism 300 can be made. As discussed above, in some embodiments the tightening mechanism 300 can include a rotation limiter 308. The housing 302 can include a housing boss 350, which can be a protrusion into the recess 316. The spool 304 can include a spool boss 352 extending from the spool 304 towards the rotation limiter 308 (e.g., downward from the bottom of the spool 304). The rotation limiter 308 can be rotatable relative to the housing 302. For example, the rotation limiter 308 can have a ring 354, which can engage the post 318 so that the rotation limiter 308 can rotate about the post 318. The rotation limiter can rotate independent of the spool 304. A tab 356 can extend from the ring 354 and the tab 356 can contact the housing boss 350 in some orientations. The housing boss 350 can restrict rotation of the rotation limiter 308, which can limit rotation of the spool 304 via the spool boss 352. For example, the rotation limiter 308 can prevent the spool 304 from rotating in a loosening direction past the orientation in which the lace 328 is fully loosened from the spool 304. Thus, the rotation limiter 308 can prevent the spool 304 from gathering lace by over-rotation in the loosening direction. The rotation limiter can also restrict rotation of the spool 304 in the tightening direction to prevent over-tightening of the spool 304, which can jam the tightening mechanism 300 by drawing too much lace 328 into the tightening mechanism 300. In some embodiments, the rotation limiter 308 can be configured to restrict rotation of the spool 304 to about 1.75 revolutions, e.g., as shown in FIGS. 27-31. The rotation limiter 308 can restrict rotation to at least about 0.75 revolutions, at least about 1.0 revolutions, at least about 1.5 revolutions, at least about 1.75 revolutions, less than or equal to about 2.0 revolutions, and/or less than or equal to about 1.75 revolutions, although values outside of these ranges can also be used.

Figure 27:
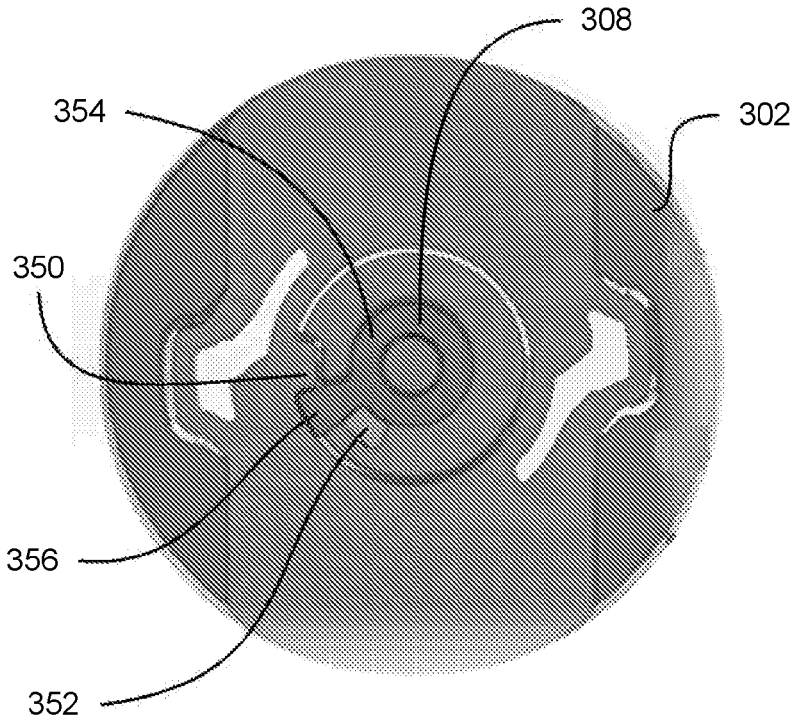
FIG. 27 is a cross-sectional view of a tightening mechanism with a spool at a fully clockwise rotated position.
Figure 28:
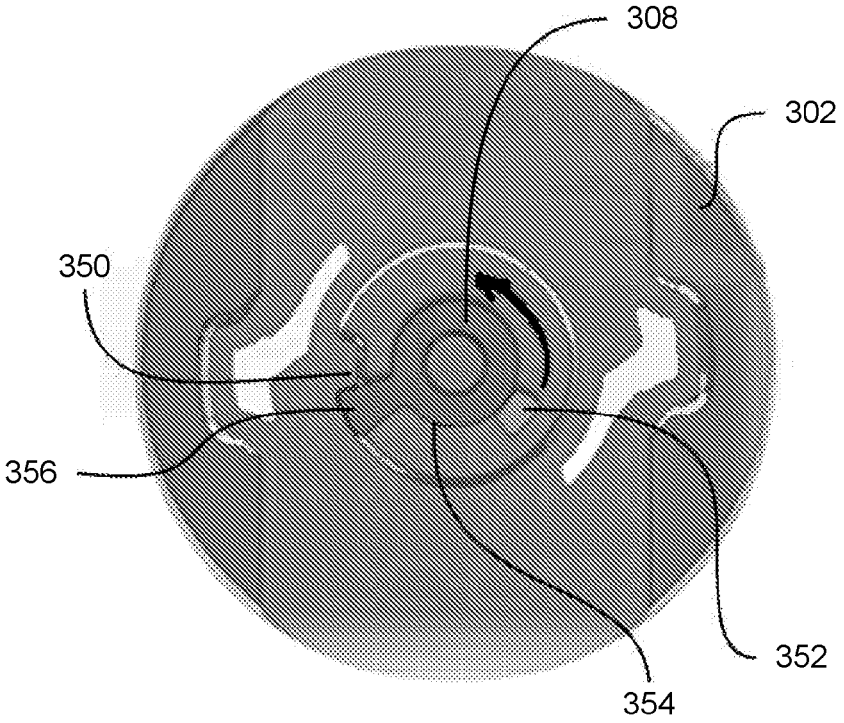
FIG. 28 is a cross-sectional view of the tightening mechanism with the spool rotated counterclockwise from the position shown in FIG. 27.
Figure 29:
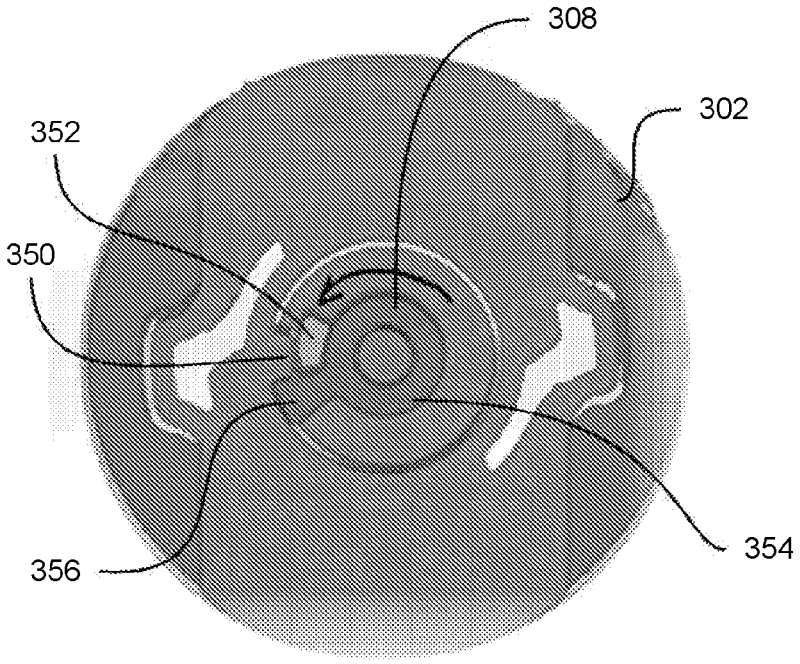
FIG. 29 is a cross-sectional view of the tightening mechanism with the spool rotated counterclockwise from the position shown in FIG. 28.
Figure 30:
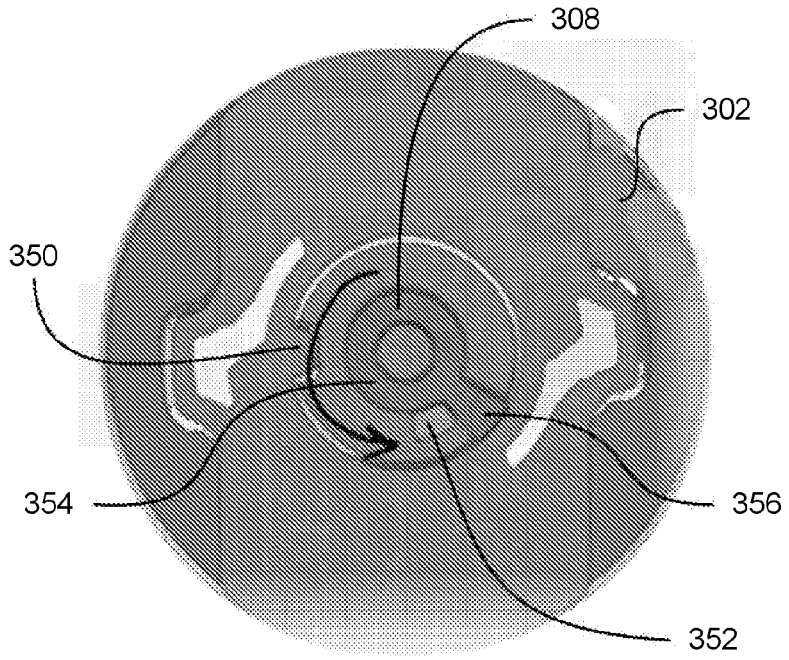
FIG. 30 is a cross-sectional view of the tightening mechanism with the spool rotated counterclockwise from the position shown in FIG. 29.
Figure 31:
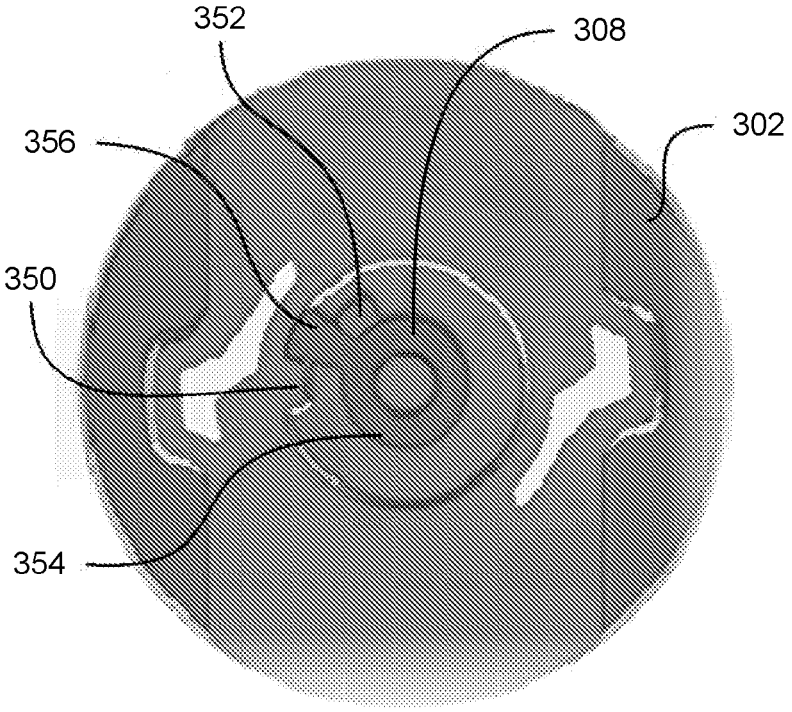
FIG. 31 is a cross-sectional view of the tightening mechanism with the spool at a fully counterclockwise rotated position.

FIG. 27 shows the spool 304 in a fully clockwise rotated position. The rotation limiter 308 is abutted against the housing boss 350 so that the rotation limiter 308 is prevented from rotating further in the clockwise direction. The spool boss 352 is abutted against the rotation limiter 308 so that the spool 304 is prevented from rotating further in the clockwise direction (e.g., to prevent over-tightening). As the spool 304 is rotated in the counterclockwise direction, the spool boss 352 can move away from the housing boss 350 and/or away from the rotation limiter 308, as shown in FIG. 28. Although the rotation limiter 308 is shown as continuing to abut against the housing boss 350 in FIG. 28, the rotation limiter 308 can be free to rotate between the spool boss 352 and the housing boss 350. The spool boss 352 can be configured to not directly contact the housing boss 350 during rotation, so that rotation of the spool 304 is prevented when the rotation limiter 308 is disposed between the housing boss 350 and the spool boss 352. For example, as shown in FIG. 29, as the spool 304 is rotated, the spool boss 352 can pass by the housing boss 350, for example on the radially inward side thereof. As mentioned above, the rotation limiter 308 can be free to rotate instead of continuing to abut against the housing boss 350 as shown in FIG. 29. When the housing boss 350 and spool boss 352 are aligned, the rotation limiter 308 can be free to rotate across substantially the full range between sides of the housing boss 350, but in this configuration, the rotation limiter 308 does not prevent rotation of the spool 304 in either direction, because the rotation limiter 308 is not disposed between the housing boss 350 and spool boss 352. As the spool 304 continues to rotate in the counterclockwise direction, the spool boss 352 can drive the rotation limiter 308 in the counterclockwise direction. In FIG. 30, the rotation limiter 308 can be free to rotate between the spool boss 352 and the housing boss 350. Further rotation of the spool 304 in the counterclockwise direction can limit the available range of motion of the rotation limiter 308 until the rotation limiter abuts against the housing boss 350 with the spool boss 352 abutted against the opposite side of the rotation limiter 308, thereby preventing the rotation limiter and the spool 304 from rotating further in the counterclockwise direction (e.g., to prevent over-loosening, which can cause lace 328 to be gathered by the spool 304 by rotation in a loosening direction).

Many variations are possible. For example, in some embodiments, a single pawl can be used instead of the dual pawl 334*a* and 334*b* system. However, the dual pawl 334*a* and 334*b* system can provide a more uniform clicking sound and sensation during rotation in both directions. The orientations mentioned herein (e.g., top, over, under) are used by way of example, and can refer to the illustrated orientation or to the orientation of intended use (e.g., worn on a user's head 104 held upright), and it will be understood that many of the embodiments discussed herein can be oriented differently than shown or described.

Figure 32:
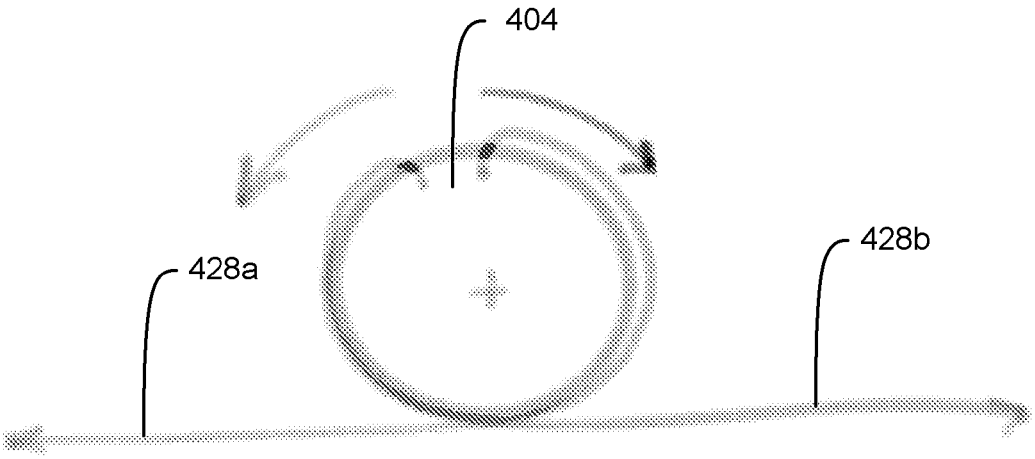
FIG. 32 schematically shows an embodiment of a pair of laces engaging a spool.
Figure 33:
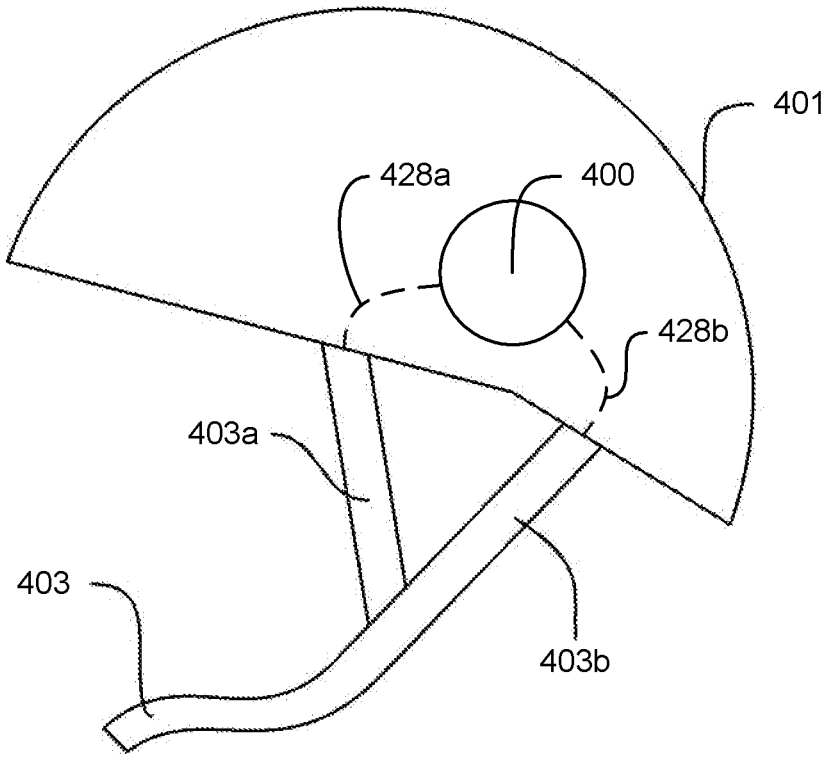
FIG. 33 schematically shows a helmet having an adjustment mechanism.

Although the lace 328 can be coupled to the spool 304 so that rotating the spool 304 in the tightening direction tightens both sides of the lace 328 around the spool 304, other configurations are possible. For example, as shown schematically in FIG. 32, two lace ends 428*a* and 428*b* (which can be ends of a single lace, or of two separate laces) can be coupled to the spool 404 in different directions so that rotating the spool 404 in the clockwise direction causes one lace side 428*b* to be gathered around the spool 404, and causes the other lace side 428*a* to be released from the spool 404. Rotation in the counterclockwise direction causes the lace side 428*a* to be gathered around the spool 404 while the lace side 428*b* is released. Thus, in some embodiments, rotating the spool 404 does not substantially tighten or loosen the system, but rather adjusts the position of the spool 404 relative to the lace sides 428*a* and 428*b*. For example, if two laces are used and the ends of the laces are fixed, rotation of the spool 404 can cause the spool 404 (and the rest of the tightening mechanism) to track back and forth across the laces (e.g., to the left and right in FIG. 32). The configuration can be used to draw one object attached to the first lace side 428*a* towards the tightening mechanism while allowing a second object attached to the second lace side 428*b* to move away from the tightening mechanism, e.g., without substantially drawing the objects together. This configuration can be used to adjust the position of objects in various contexts, such for opening and closing vents on a jacket or other wearable article or for adjusting the positions of features on a helmet or wearable article. For example, with reference to FIG. 33, a helmet 401 can have a chin strap 403 that attaches to the helmet at two locations. A tightening mechanism 400 can have two laces 428*a* and 428*b* (or other tensioning members), which can be mounted in the configuration shown in FIG. 32. By rotating the tightening mechanism 400 in a first direction, the first lace 428*a* can be tightened while the second lace 428*b* can be loosened. Rotating the tightening mechanism in the opposite direction can cause the second lace 428*b* to be tightened while the first lace 428*a* is loosened. The laces 428*a* and 428*b* can be coupled to the strap sides 403*a* and 403*b* so that the tightening mechanism 400 can be used to adjust the angle of the strap 403, e.g., to fit different head shapes.

Figure 34:
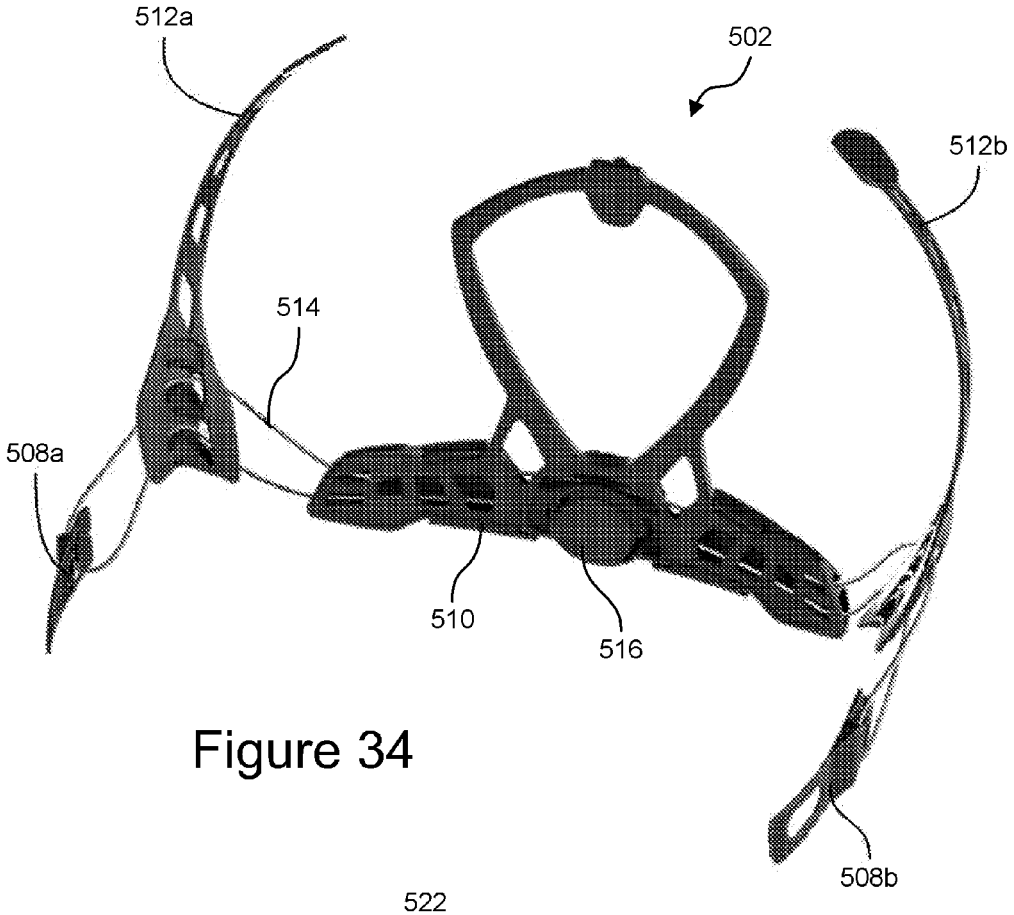
FIG. 34 shows an isometric view of another example embodiment of a tightening system.

FIG. 34 shows an isometric view of a tightening system 502 for use with an article, such as a wearable article like headwear (e.g., a helmet). The tightening system 502 can be similar to the tightening system 102 discussed herein, and many features of the tightening system 502 are not discussed in detail since they correspond to features described in connection with the tightening system 102. The tightening system 502 can include a rear support member, such as a yoke 510, and intermediate tenders 512*a* and 152*b*. The tightening system can include one or more front support members, such as the temple guides 508*a* and 508*b* shown in FIG. 34. A lace 514 can extend across the yoke 510, the intermediate tenders 512*a* and 512*b*, and the temple guides 508*a* and 508*b*, and a tightening mechanism 516 can be configured to adjust tension on the lace 514. The temple guides 508*a* and 508*b* can be secured to a helmet or other headwear (e.g., at or near the temple areas on each side of the helmet), such as by a snap, clip, friction-fit, adhesive, hook and loop combination, or other securing mechanism. Tightening of the lace 514 can pull the yoke 510 towards the temple guides 508*a* and 508*b*, thereby tightening the helmet onto the head of the wearer.

Figure 35:
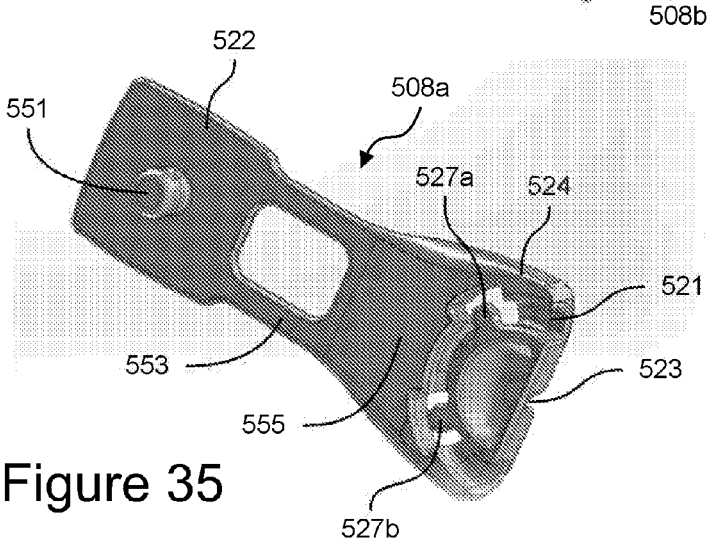
FIG. 35 shows an example embodiment of a temple guide of the tightening system of FIG. 34.

FIG. 35 shows an example embodiment of a temple guide 508*a*. The temple guide 508*a* can include an engagement portion 522, which can include a snap mechanism 551 (as shown in FIG. 35) or other engagement feature configured to secure the temple guide 508*a* to the helmet or other headwear via a complementary mechanism. A lace guide 524 can be configured to receive the lace 514, and can be configured, for example, similar to the designs shown in FIGS. 9A-9C. For example, the temple guide 508*a* can include a lace channel 521 and/or a hole 523 for receiving the lace 514. The lace channel 521 can be a closed channel or an open channel (as shown) and can include tabs 527*a* and 527*b* for retaining the lace 514 in the open lace channel 521. A strap 553 can extend between the engagement portion 522 and the lace guide 524 portion. The strap 553 can be similar to the strap 118 of the forehead strap 108 discussed above, but can be shorter. In some embodiments, the strap 553 can be omitted, and the engagement feature (e.g., snap 551) can extend from the lace guide 524 portion (e.g., a rear portion 555 thereof). In some embodiments, the forehead strap 108 can include features similar to those discussed in connection with FIG. 35.

Figure 36:
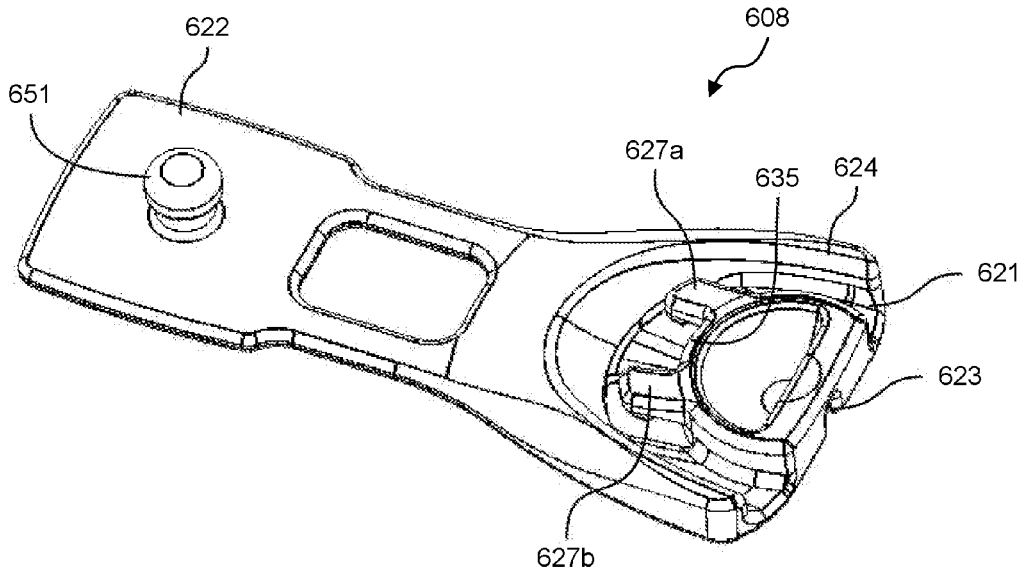
FIG. 36 shows another example embodiment of a temple guide.
Figure 37:
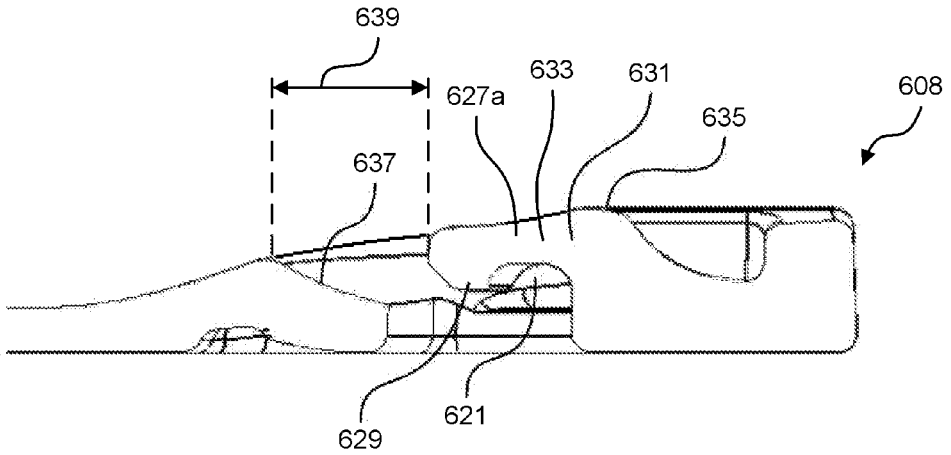
FIG. 37 is a cross-sectional view of a portion of the temple guide of FIG. 36.

FIG. 36 shows another example embodiment of a temple guide 608. FIG. 37 is a cross-sectional view of a portion of the temple guide 608. The temple guide 608 can include features similar to those of the temple guide 608 or the forehead strap 108, and many of those features are not discussed in detail with relation to the temple guide 608 because the description of the temple guide 508*a* and the forehead strap 108 can be applicable also to the temple guide 608. Similarly, in some embodiments, the forehead strap 108 and the temple guide 508*a* can include features similar to those discussed in connection with the temple guide 608. The temple guide 608 can include an engagement portion 622, which can include an engagement feature 651 configured to secure the temple guide 508*a* to the helmet or other headwear via a complementary mechanism. A lace guide 624 can be configured to receive a lace, and can be configured, for example, similar to the designs shown in FIGS. 9A-9C. For example, the temple guide 608 can include a lace channel 621 and/or a hole 623 for receiving the lace. The lace channel 621 can be an open channel and can include one or more (e.g., two) tabs 627*a* and 627*b* for retaining the lace. The tabs 627*a* can have protrusions 629 (e.g., on an underside of the tabs 627*a* and 627*b*) configured to facilitate retention of the lace in the lace channel 621. The tabs 627*a* and 627*b* can have a connection point 631 that is thicker than an extension portion 633 of the tab 627*a* or 627*b*, which can extend from the connection point 631 to the protrusion 629. In some embodiments, a ridge 635 can be disposed at the connection point 631 to strengthen the tabs 627*a* and 627*b*.

In some embodiments, the temple guide 608 (or the forehead strap 108 or the temple guide 508*a*) can include a lace entry portion 637 that is configured to facilitate the entry of the lace into the lace channel 621 and to facilitate the engagement of the tabs 627*a* and 627*b* with the lace. For example, the lace entry portion 637 can be inclined or recessed and can be disposed adjacent or near the one or more tabs 627*a* and 627*b*. The recessed or inclined portion 637 can have a width that is at least as wide at the thickness of the lace, so that the lace can be place in or on the lace entry portion 637. To couple the lace to the temple guide 608 a user can place the lace (e.g., a lace loop) in or on the lace entry portion 637, and the user can pull the lace towards the tabs 627*a* and 627*b* such that the lace passes the protrusions 629 and engages the lace channel 621 in the desired configuration. The protrusions 629 can retain the lace in the lace channel 621. This can allow a user to couple the lace into the lace guide 621 more easily than threading an end of the lace through the lace channel 621 and under the tabs 627*a* and 627*b*. The lace entry portion 637 can be particularly useful for coupling a lace loop into the lace channel 621 when no lace end is available. In some embodiments, the lace channel 621 can include the lace entry portion 637. For example, at least a portion of the lace channel 621 can have a width that is wide enough that a distance 639 between an end of the tab 627*a* and the edge of the lace channel is at least as wide as the lace. In embodiments, the lace entry portion 637 can have a scalloped shape.

Figure 38:
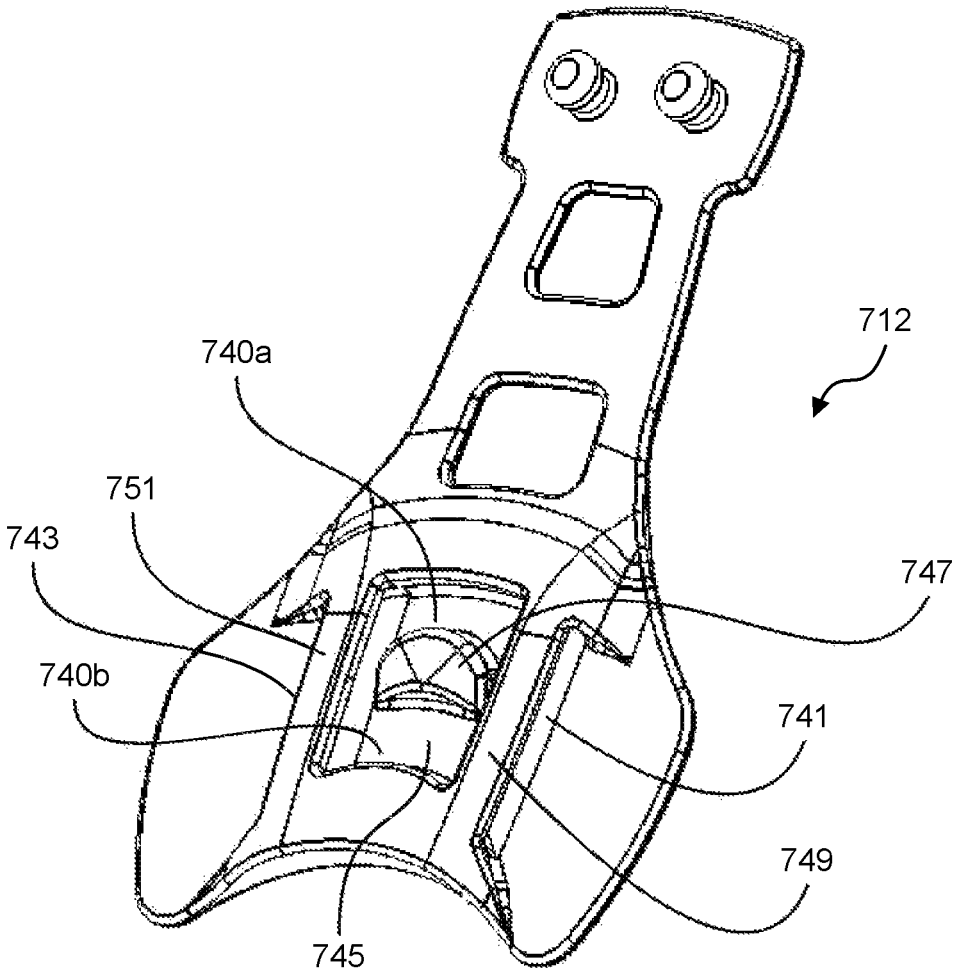
FIG. 38 shows an example embodiment of an intermediate lace tender.
Figure 39:
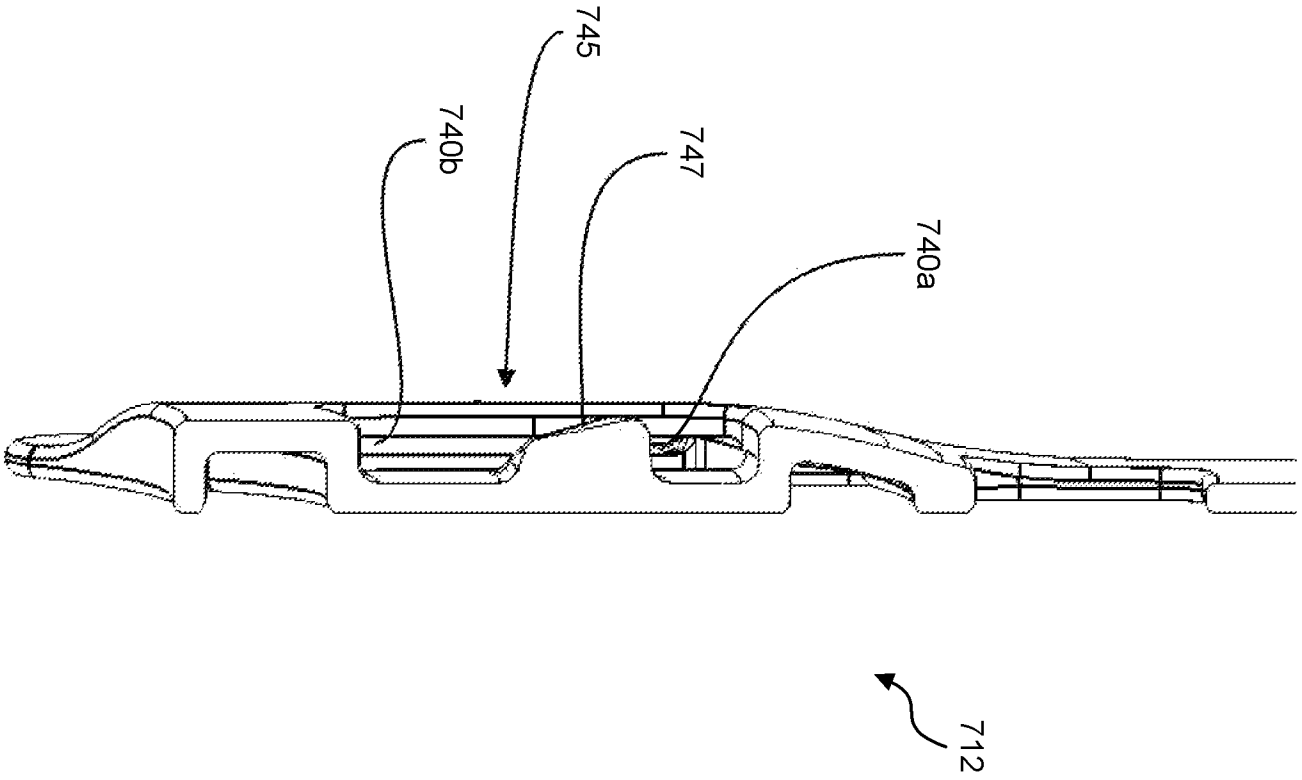
FIG. 39 is a cross-sectional view of a portion of the intermediate lace tender of FIG. 38.

FIG. 38 shows an example embodiment of an intermediate tender 712, which can have features similar to the other intermediate tenders 112*a*, 112*b*, 512*a*, and 512*b* disclosed herein. Many of the features of the intermediate tender 712 are not discussed in detail and the disclosure associated with the intermediate tenders 112*a*, 112*b*, 512*a*, and 512*b* can be applicable to the intermediate tender 712 as well. Similarly, features of the intermediate tender 712 can be incorporated into the other embodiments disclosed herein. FIG. 39 is a cross-sectional view of a portion of the intermediate lace tender 712. The intermediate lace tender 712 can have a first lace guide path 740*a* and a second lace guide path 740*b*. The intermediate tender 712 can be configured to allow a lace loop to be threaded therethrough so that a top portion of the lace loop engages the upper lace guide path 740*a* and a bottom portion of the lace loop engages the lower lace guide path 740*b*. The intermediate tender 712 can include a first opening 741 that forms part of both the first lace guide path 740*a* and 740*b* and a second opening 743 that forms a part of both the first lace guide path 740*a* ad 740*b*. A third opening 745, which can be positioned between the first opening 741 and the second opening 743 can be configured to provide access to the lace after the lace is threaded through one or both of the openings 741 and 743.

Figure 40:
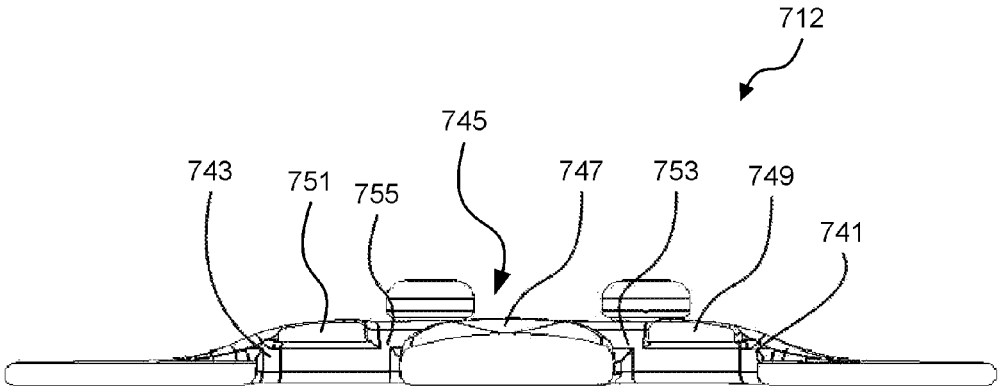
FIG. 40 is another cross-sectional view of the intermediate lace tender of FIG. 38.

A dividing element 747 (which can be a protrusion) can separate the lace guide paths 740*a* and 740*b*. The dividing element 747 can be inside the opening 745, and the dividing element 747 can be spaced apart from the edges of the opening 745 to allow for a lace that is threaded through one or both of the openings 741 and 743 to pass from a second side of the dividing member 747 (e.g., below the dividing member 747) to a first side of the dividing member 747 (e.g., above the dividing member). Accordingly, to thread a lace loop through the intermediate tender 712, a user can thread the lace loop through one or both of the openings 741 and 743 on a second side of the dividing element 747 (e.g., below the dividing element 747), and the user can pull the a first portion of the lace loop over the dividing element 747 such that the first portion of the lace loop engages the first lace guide path 740*a* on the first side of the dividing element 747 and a second portion of the lace engages the second lace guide path 740*b* on the second side of the dividing element 747. Thus, the dividing element 747 and/or the opening 745 can be configured to allow a user to move a lace (e.g., one side of a lace loop) from the second lace guide path 740*b* (e.g., positioned on the to the first lace guide path 740*b* (e.g., positioned above the dividing element 747). In some embodiments, a surface of the dividing element 747 can be sloped to facilitate sliding the lace portion from the second side to the first side. For example, the dividing element 747 can be thinner or shorter on the second (e.g., lower) side than on the first (e.g., upper) side, as can be seen, for example, in FIG. 39. The dividing element 747 can also be tapered in the generally horizontal direction. FIG. 40 is a cross-sectional view of the intermediate tender 712 taken through the dividing element 747 in a generally horizontal plane. The dividing element 747 can be tapered on both sides in the generally horizontal direction such that both the right and left sides of the dividing element 747 are thinner than a central region of the dividing element 747. The taper can facilitate moving the lace over the dividing element 747, as discussed herein.

The first side (e.g., the upper side), which can be thicker or taller than the second side (e.g., the lower side), of the dividing element 747 can have a height that is configured to retain the first lace portion on the first side of the dividing element 747. For example, the distances 753 and 755 between the dividing element 747 and the edges of the opening 745 can be less than the thickness of the lace at or near the first (e.g., upper) side of the dividing element 747. The distances 753 and 755 can be larger at the second side (e.g., the lower side) of the dividing element 747 than at the first side (e.g., the upper side) (e.g., due to the slope of the dividing element 747), and the distances 753 and 755 can gradually get smaller moving from the second side of the dividing element 747 to the first side. In some embodiments, the distances 753 and 755 can be larger than or substantially equal to the thickness of the lace at or near the second side (e.g., the lower side) of the dividing element 747. The intermediate tender 712 can include one or more flexible portions that are configured to flex when the lace is moved over the dividing element 747 so the distances 753 and 755 temporarily increase to allow the lace to pass from the second side of the dividing element 747 to the first side. For example, the one or more flexible portions can include the edges of the opening 745. The intermediate tender 712 can include cover portions 749 and 751 that can be made of a material and thickness that allows the cover portions 749 and 751 to flex to allow the lace to pass over the dividing element 747. In some embodiments, the dividing element 747 can be flexible (e.g., compressible) or the dividing element 747 can be coupled to a flexible component that allows the dividing element 747 to displace to allow the lace to pass over the dividing element 747, as discussed herein. In some embodiments, the cover portions 749 and 751 can define the openings 741 and 743 (e.g., on outer edges of the cover portions 749 and 751) and the cover portions can define the opening 745 (e.g., on inner edges of the cover portions 749 and 751). The cover portions 749 and 751 can be configured to retain the lace in the first lace guide path 740*a* and the second lace guide path 740*b*.

Figure 41:
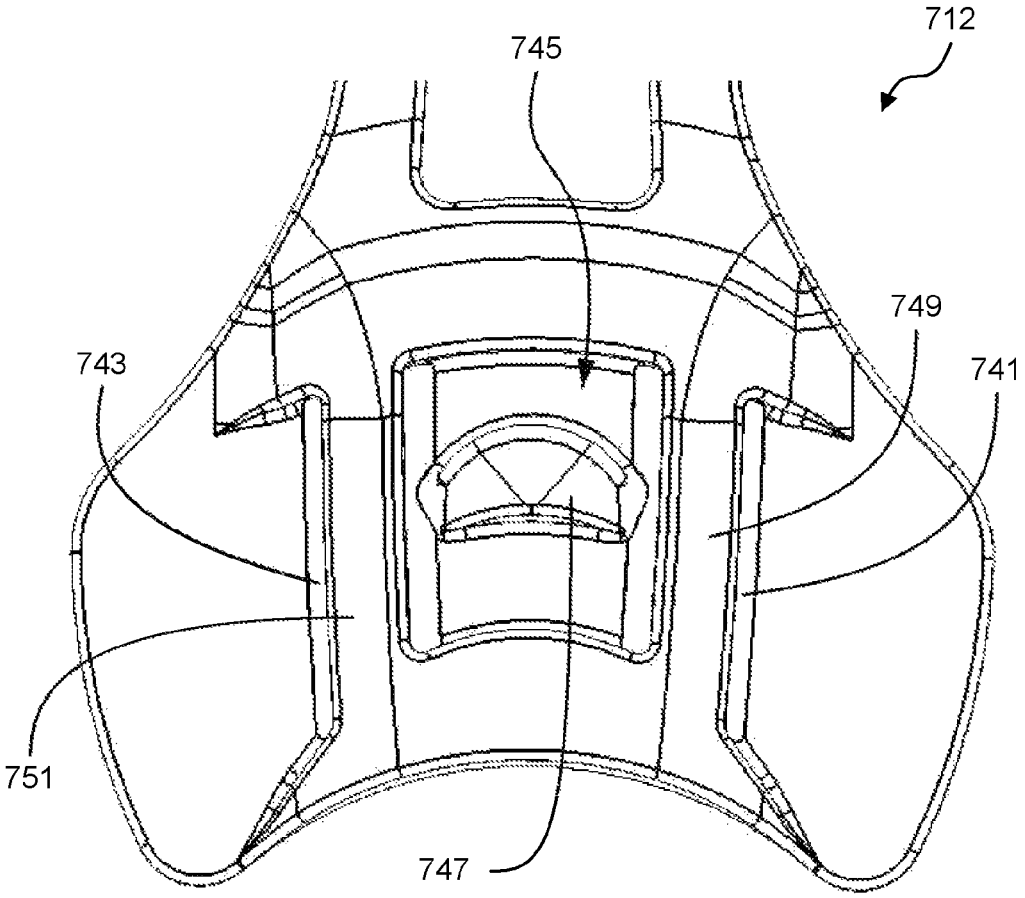
FIG. 41 shows another example embodiment of an intermediate lace tender.

In some embodiments, the edges of the opening 745 (e.g., the inside edges of the cover portions 749 and 751) can be angled with respect to the dividing element 747 such that the distances 753 and 755 gradually narrow (e.g., from the bottom up), as discussed above. Accordingly, in some embodiments, the dividing element 747 is not sloped or tapered, and the narrowing of the distances 753 and 755 (e.g., from the bottom up) can be due to the angled edges of the opening 745 (e.g., the inside edges of the cover portions 749 and 751). Also, in some embodiments the dividing element 747 can have a width that increased from the second side (e.g., the bottom side) to the first side (e.g., the upper side), as shown in FIG. 41.

In some embodiments, one or more surfaces of the dividing element 747 can form a part of the lace guide path 740*a* and/or the lace guide path 740*b*. For example, as shown in FIG. 38, an upper surface of the dividing element 747 can form a part of the first (e.g., upper) lace guide path 740*a*.

Although disclosed in the context of certain illustrated embodiments and examples, it will be understood by those of skill in the art that the present disclosure extends beyond the specifically described embodiments. While a number of variations have been shown and described, other modifications, which are within the scope of this disclosure, will be apparent to those of skill in the art based upon this disclosure. It is also contemplated that various combination and subcombinations of the specific features and aspects of the embodiments can be made. Thus, it is intended that the scope of the disclosure should not be limited by the particular embodiments illustrated and described herein.

What is claimed is:

1. A tightening system for use with a helmet or other headwear, the tightening system comprising:

a front support member;

a rear support member spaced apart from the front support member forming a gap therebetween;

a lace coupled to the front support member and to the rear support member, the lace extending across the gap between the front support member and the rear support member;

a tightening mechanism configured to adjust tension on the lace, wherein the tightening mechanism comprises a rotatable spool and a knob configured to rotate the spool, wherein rotation of the spool in a tightening direction winds the lace around the spool to tighten the lace; and at least one intermediate tender configured to engage the lace between the front support member and the rear support member, wherein the at least one intermediate tender comprises at least one lace guide, wherein the lace is configured to slide through the lace guide as the tension on the lace changes, wherein the at least one intermediate tender comprises an attachment portion configured to couple the at least one intermediate tender to an inside of a helmet shell.

2. A helmet comprising the tightening system of claim 1.

3. The tightening system of claim 1, wherein the at least one intermediate tender is configured to engage the lace to form a non-linear lace path across the gap between the front support member and the rear support member.

4. The tightening system of claim 1, wherein the front support member comprises a forehead strap configured to engage a forehead portion of a wearer's head.

5. The tightening system of claim 1, wherein the front support member comprises one or more temple guides configured to be positioned near the temples of a wearer's head.

6. The tightening system of claim 1, wherein the rear support member comprises a yoke configured to engage the back of the wearer's head.

7. The tightening system of claim 1, wherein the lace forms a single lace loop that extends across a right side of the tightening system and across a left side of the tightening system, to provide a dynamic fit between the right side and the left side.

8. The tightening system of claim 1, wherein an angle between the lace path from the intermediate tender towards front support member and the lace path from the intermediate tender towards the rear support member is between 30° and 60°.

9. The tightening system of claim 1, wherein the rear support comprises a height adjustment system configured to allow the rear support to slide across a range of motion, wherein the rear support is infinitely positionable within the range of motion.

10. The tightening system of claim 9, wherein the height adjustment system is configured to allow movement of the rear support while the helmet or other headwear is worn.

11. The tightening system of claim 9, wherein the height adjustment system comprises:

a strap; and a slide clamp configured to slidably receive the strap.

12. The tightening system of claim 11, wherein the slide clamp comprises one or more retaining members configured to apply friction on the strap to resist sliding of the strap relative to the slide clamp, wherein a pulling force on the strap below a threshold value is insufficient to overcome the friction and slide the strap relative to the slide clamp, and wherein a pulling force on the strap above the threshold value overcomes the friction and causes the strap to slide relative to the slide clamp.

13. The tightening system of claim 11, wherein the slide clamp is configured to be coupled to the helmet or other headwear, and wherein the strap is coupled to the rear support member.

14. The tightening system of claim 1, wherein the at least one intermediate tender is configured such that tightening the lace causes the at least one intermediate tender to move inwardly to apply a tightening force to a wearer's head.

15. The tightening system of claim 1, wherein the at least one intermediate tender comprises:

a first lace guide path;

a second lace guide path;

a dividing element disposed between the first lace guide path and the second lace guide path; and an opening configured to allow a lace to move from the second lace guide path to the first lace guide path.

16. The tightening system of claim 15, wherein the at least one intermediate tender comprises:

one or more cover portions configured to retain the lace in the first lace guide path and the second lace guide path;

wherein a distance between the dividing element and the one or more cover portions narrows in a direction from the second lace guide path to the first lace guide path.

17. The tightening system of claim 16, wherein the dividing element is comprises a sloped or tapered surface.

18. The tightening system of claim 16, wherein the one or more cover portions is angled with respect to the dividing element.

19. The tightening system of claim 16, wherein the distance between the dividing element and the one or more cover portions is less than the thickness of the lace for at least a portion of the dividing element.

20. The tightening system of claim 19, wherein the intermediate tender comprises one or more flexible portions that are configured to flex to increase the distance between the dividing element and the one or more cover portions to allow the lace to pass through the area between the dividing element and the one or more cover portions.

21. The tightening system of claim 15, wherein a surface of the dividing element defines a portion of the first lace guide path.

22. The tightening system of claim 1, wherein the front support member comprises a lace guide that includes a hole configured to receive an end of the lace such that the lace terminates at the lace guide.

23. The tightening system of claim 1, wherein the front support member comprises a lace guide configured to receive the lace, the lace guide comprising:

a lace channel;

one or more tabs extending over the lace channel, wherein the tabs are configured to retain the lace in the lace channel;

a lace entry portion configured to facilitate entry of the lace into the lace channel, wherein the lace entry portion comprise a recessed or inclined portion adjacent to the one or more tabs.

24. The tightening system of claim 23, wherein the recessed or inclined portion has a width that is at least as wide as the thickness of the lace.

25. The tightening system of claim 23, wherein the lace channel comprises the lace entry portion, wherein at least a portion of the lace channel has a width that is wide enough such that a distance between an end of the one or more tabs and the edge of the lace channel is at least as wide as the thickness of the lace.

26. The tightening system of claim 23, wherein the one or more tabs include a protrusion configured to retain the lace in the lace channel.

27. The tightening system of claim 23, where in the lace can be coupled into the lace channel by positioning the lace in or on the lace entry portion and pulling the lace generally towards the one or more tabs.

28. The tightening system of claim 1, wherein the tightening mechanism comprises:

a housing;

the spool rotatable relative to the housing;

a plurality of teeth;

a first pawl configured to engage the teeth to prevent rotation of the spool in a first direction and to allow rotation of the spool in a second direction;

a second pawl configured to engage the teeth to prevent rotation of the spool in the second direction and to allow rotation of the spool in the first direction; and a sweeper configured to displace the first pawl away from the teeth to allow rotation of the spool in the first direction, wherein rotation of the spool in the first direction causes the second pawl to ratchet across the teeth, wherein the first pawl is coupled to the second pawl such that displacement of first pawl increases the force with which the second pawl presses against the teeth.

29. The tightening system of claim 28, wherein the spool comprises a first lace channel configured to gather a first lace side, and a second lace channel configured to gather a second lace side.

30. The tightening system of claim 29, wherein rotation of the spool in the tightening direction causes the first lace side to be gathered into the first lace channel and the second lace side to be gathered into the second lace channel, and rotation of the spool in the loosening direction causes the first lace side to be released from the first lace channel and the second lace side to be released from the second lace channel.

31. The tightening system of claim 1, wherein the front support member comprises an attachment portion configured to couple the front support member to the inside of the helmet shell.

32. The tightening system of claim 31, wherein the rear support member comprises an engagement portion configured to couple the rear support member to the inside of the helmet shell.

33. The tightening system of claim 1, wherein the rear support member comprises at least one lace channel having at least one lace exit location, wherein the at least one lace guide on the at least one intermediate tender comprises at least one lace entrance location, wherein the lace extends from the at least one lace exit location on the rear support member to the at least one lace entrance location on the at least one intermediate tender, and wherein the at least one lace entrance location on the at least on intermediate tender is disposed above the at least one lace exit location on the rear support member.

34. A tightening system for use with a helmet or other headwear, the tightening system comprising:

a front support member;

a rear support member spaced apart from the front support member forming a gap therebetween, wherein the rear support member comprises at least one lace channel having at least one lace exit location;

a lace coupled to the front support member and to the rear support member, the lace extending across the gap between the front support member and the rear support member;

a tightening mechanism configured to adjust tension on the lace, wherein the tightening mechanism comprises a rotatable spool and a knob configured to rotate the spool, wherein rotation of the spool in a tightening direction winds the lace around the spool to tighten the lace; and at least one intermediate tender configured to engage the lace between the front support member and the rear support member, wherein the at least one intermediate tender comprises at least one lace guide having at least one lace entrance location, wherein the lace is configured to slide through the lace guide as the tension on the lace changes, wherein the lace extends from the at least one lace exit location on the rear support member to the at least one lace entrance location on the at least one intermediate tender, and wherein the at least one lace entrance location on the at least on intermediate tender is disposed above the at least one lace exit location on the rear support member.

35. A helmet comprising the tightening system of claim 34.

36. The tightening system of claim 34, wherein the at least one intermediate tender is configured to engage the lace to form a non-linear lace path across the gap between the front support member and the rear support member.

37. The tightening system of claim 34, wherein the front support member comprises a forehead strap configured to engage a forehead portion of a wearer's head.

38. The tightening system of claim 34, wherein the rear support member comprises a yoke configured to engage the back of the wearer's head.

39. The tightening system of claim 34, wherein the lace forms a single lace loop that extends across a right side of the tightening system and across a left side of the tightening system, to provide a dynamic fit between the right side and the left side.

40. The tightening system of claim 34, wherein an angle between the lace path from the intermediate tender towards front support member and the lace path from the intermediate tender towards the rear support member is between 30° and 60°.

41. The tightening system of claim 34, wherein the rear support comprises a height adjustment system configured to allow the rear support to slide across a range of motion, wherein the rear support is infinitely positionable within the range of motion.

42. The tightening system of claim 41, wherein the height adjustment system is configured to allow movement of the rear support while the helmet or other headwear is worn.

43. The tightening system of claim 34, wherein the at least one intermediate tender is configured such that tightening the lace causes the at least one intermediate tender to move inwardly to apply a tightening force to a wearer's head.

44. The tightening system of claim 34, wherein the tightening mechanism comprises:

a housing;

the spool rotatable relative to the housing;

a plurality of teeth;

a first pawl configured to engage the teeth to prevent rotation of the spool in a first direction and to allow rotation of the spool in a second direction;

a second pawl configured to engage the teeth to prevent rotation of the spool in the second direction and to allow rotation of the spool in the first direction; and a sweeper configured to displace the first pawl away from the teeth to allow rotation of the spool in the first direction, wherein rotation of the spool in the first direction causes the second pawl to ratchet across the teeth, wherein the first pawl is coupled to the second pawl such that displacement of first pawl increases the force with which the second pawl presses against the teeth.

* * * * *